US010730044B2

(12) United States Patent
Khaing Oo et al.

(10) Patent No.: US 10,730,044 B2
(45) Date of Patent: Aug. 4, 2020

(54) ASSAY PLATE AND USES THEREOF

(71) Applicant: THE REGENTS OF THE UNIVERSITY OF MICHIGAN, Ann Arbor, MI (US)

(72) Inventors: Maung Kyaw Khaing Oo, Ann Arbor, MI (US); Xudong Fan, Ann Arbor, MI (US)

(73) Assignee: THE REGENTS OF THE UNIVERSITY OF MICHIGAN, Ann Arbor, MI (US)

( * ) Notice: Subject to any disclaimer, the term of this patent is extended or adjusted under 35 U.S.C. 154(b) by 331 days.

(21) Appl. No.: 15/944,962

(22) Filed: Apr. 4, 2018

(65) Prior Publication Data

US 2018/0221876 A1 Aug. 9, 2018

Related U.S. Application Data

(63) Continuation-in-part of application No. 15/280,093, filed on Sep. 29, 2016, now abandoned.
(Continued)

(51) Int. Cl.
*B01L 3/00* (2006.01)

(52) U.S. Cl.
CPC . *B01L 3/502715* (2013.01); *B01L 2300/0627* (2013.01); *B01L 2300/0829* (2013.01);
(Continued)

(58) Field of Classification Search
CPC ..... B01L 3/502715; B01L 2300/168; B01L 2300/0627; B01L 2300/0832;
(Continued)

(56) References Cited

U.S. PATENT DOCUMENTS 5,779,907 A 7/1998 Yu
6,103,199 A * 8/2000 Bjornson ..... B01J 19/0046 204/450
(Continued)

FOREIGN PATENT DOCUMENTS

EP 2356249 A1 8/2011
EP 2781907 7/2015
(Continued)

OTHER PUBLICATIONS

"ANSI SLAS Apr. 2004 (R2012) (formerly recognized as ANSI/SBS Apr. 2004)" American National Standards Institute and Society for Laboratory Automation and Screening Oct. 2011 (Year: 2011).*
(Continued)

*Primary Examiner* — Samuel P Siefke
*Assistant Examiner* — Quocan B Vo
(74) *Attorney, Agent, or Firm* — Casimir Jones, S.C.; Tanya Arenson

(57) ABSTRACT

An assay plate assembly comprising a plurality of microfluidic modules arranged in a rectilinear matrix of rows and columns microfluidic channels. Each microfluidic module has an inlet well leading to a serpentine microfluidic channel that is set at a cant angle. The well is laterally offset from the detection area to avoid optical interference. The geometric center of each detection area is positioned according to ANSI/SLAS standards for well-centers. A drain from each microfluidic channel is located so that it does not interfere with any detection areas. An array of optically-transmissive micro-posts are disposed within each microfluidic channel. The micro-posts extend perpendicularly from the top surface of the top plate toward the underside and are equally distributed throughout the entire detection area. The plate assembly provides reduced assay time and sample volume,
(Continued)

and increased sensitivity and specificity in biological and chemical assays.

9 Claims, 38 Drawing Sheets

Related U.S. Application Data

(60) Provisional application No. 62/235,795, filed on Oct. 1, 2015.

(52) U.S. Cl.
CPC ..... *B01L 2300/0832* (2013.01); *B01L 2300/0883* (2013.01); *B01L 2300/168* (2013.01)

(58) Field of Classification Search
CPC ..... B01L 2300/0829; B01L 2300/0883; B01L 2200/0647; B01L 3/502761; B01L 3/50851; B01L 3/5085
See application file for complete search history.

(56) References Cited

U.S. PATENT DOCUMENTS 6,623,613 B1 * 9/2003 Mathies ..... B01L 3/5025 204/450
6,803,019 B1 * 10/2004 Bjornson ..... G01N 27/44791 422/504
6,827,906 B1 * 12/2004 Bjornson ..... G01N 27/44791 204/601
6,881,315 B2 * 4/2005 Iida ..... B01L 3/502761 204/164
8,202,492 B2 6/2012 Linder et al.
8,431,090 B2 4/2013 Cheung et al.
8,475,715 B2 7/2013 Masters et al.
8,528,589 B2 * 9/2013 Miller ..... B01F 15/00285 137/487.5
8,807,879 B2 8/2014 Toner et al.
8,883,491 B2 11/2014 Lin et al.
9,212,977 B2 12/2015 Tang et al.
9,500,664 B2 * 11/2016 Ness ..... B01L 3/502723
9,733,232 B1 8/2017 Stolovitzky et al.
2002/0168364 A1 11/2002 Gorczynski et al.
2003/0034306 A1 * 2/2003 Schulte ..... F16K 99/0001 210/650
2003/0087300 A1 * 5/2003 Knapp ..... B01L 3/50273 435/6.19
2003/0096268 A1 * 5/2003 Weiner ..... B01J 19/0046 435/6.12
2003/0224531 A1 12/2003 Brennen et al.
2003/0228603 A1 12/2003 Cload et al.
2004/0026250 A1 * 2/2004 Cummings ..... B03C 5/005 204/547
2005/0003459 A1 1/2005 Krutzik
2005/0239210 A1 10/2005 Iida et al.
2005/0266582 A1 * 12/2005 Modlin ..... B01L 3/502723 436/164
2007/0003448 A1 1/2007 Kanigan et al.
2007/0014695 A1 * 1/2007 Yue ..... B01L 3/502707 422/400
2007/0053797 A1 3/2007 Muraishi et al.
2007/0059212 A1 3/2007 Masters et al.
2007/0166771 A1 7/2007 Kapur et al.
2008/0219615 A1 * 9/2008 Cunningham ..... B01L 3/5085 385/12
2009/0269767 A1 * 10/2009 Soderlund ..... G01N 33/54366 435/6.11
2010/0071418 A1 * 3/2010 Dannoux ..... B81C 99/0085 65/83
2010/0196207 A1 * 8/2010 Steinmiller ..... G01N 33/54366 422/82.09
2011/0011781 A1 * 1/2011 Blankenstein .... B01L 3/502715 210/205
2011/0096327 A1 4/2011 Papautsky et al.
2011/0135814 A1 6/2011 Miyauchi et al.
2011/0234757 A1 9/2011 Zheng et al.
2012/0328488 A1 * 12/2012 Puntambekar ..... B01L 3/50273 422/503
2013/0260447 A1 * 10/2013 Link ..... B03C 5/005 435/287.2
2014/0030788 A1 * 1/2014 Chen ..... B01L 3/502746 435/177
2014/0220606 A1 * 8/2014 Puntambekar ..... B01L 3/5025 435/7.94
2015/0132742 A1 * 5/2015 Thuo ..... B01L 3/502707 435/5
2015/0132837 A1 5/2015 Frenz et al.
2015/0166956 A1 * 6/2015 Puleo ..... B01D 21/2444 435/2
2015/0177233 A1 6/2015 Puntambekar et al.
2017/0097345 A1 4/2017 Khaing Oo et al.

FOREIGN PATENT DOCUMENTS

WO 2004092702 10/2004
WO 2009120363 A1 10/2009
WO 2011011350 A2 1/2011
WO 2012103533 A3 11/2012
WO 20170059038 A1 4/2017

OTHER PUBLICATIONS

Hegab et al. "In-Flow DNA Extraction Using on-Chip Microfluidic Amino-Coated Silicon Micropillar Array Filter". Biosens Bioelectron 4: 140, 2013 (Year: 2013).*
Liu et al. "Development of integrated microfluidic system for genetic analysis" J. Microlith., Microfab., Microsyst., vol. 2 No. 4, Oct. 2003, hereinafter Liu (Year: 2003).*
International Search Report of related PCT PCT/US2016/054387, dated Dec. 2, 2016, 8 pages.

* cited by examiner

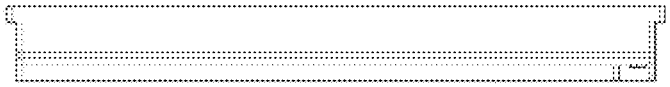
FIG. 1D
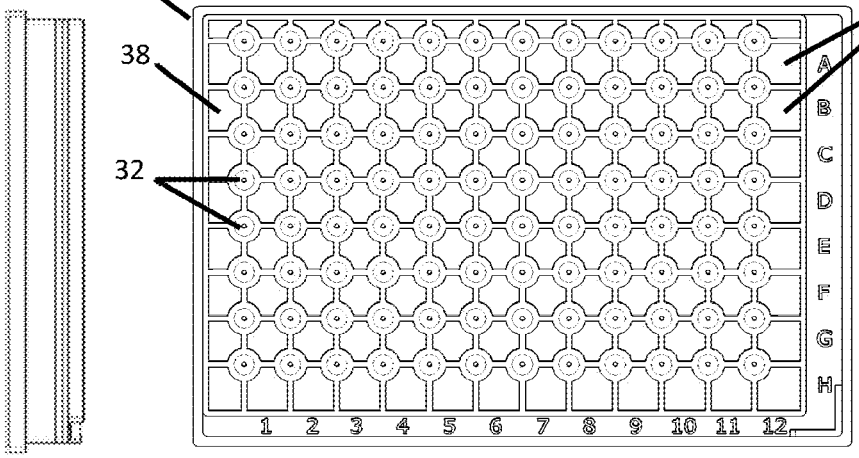
FIG. 1E
FIG. 1A
FIG. 1F
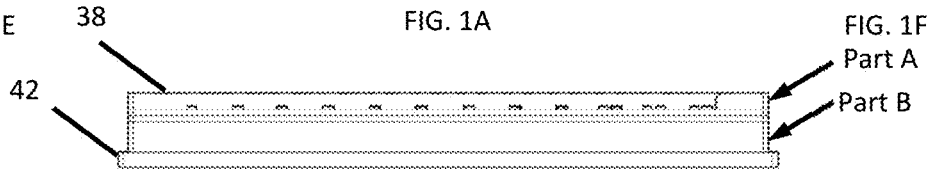
FIG. 1C
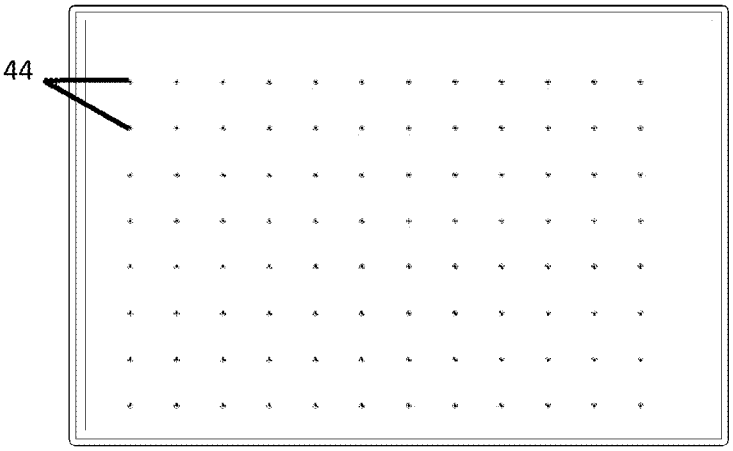
FIG. 1B

ASSAY PLATE AND USES THEREOF

CROSS REFERENCE TO RELATED APPLICATIONS

The present Application is a Continuation-in-Part of U.S. Ser. No. 15/280,093, filed Sep. 29, 2016, which claims priority to U.S. Provisional Patent Application Ser. No. 62/235,795 filed Oct. 1, 2015, the disclosures of which are herein incorporated by reference in entirety.

FIELD

Provided herein are assay plates and uses thereof. In particular, provided herein are assay plates for performing biological and chemical assays and detecting assay results.

BACKGROUND

A powerful and widely used current diagnostic technique, Enzyme-linked immunosorbent assay (ELISA), is demanded to improve sensitivity and reduce assay times. The main detection principles of current ELISA are based on Ultraviolet-visible absorption, chemiluminescence, and fluorescence detections. Drawbacks of traditional ELISA are: (1) long testing time (3-6 hours+overnight coating), which makes the ELISA almost useless when dealing with emergency care (such as heart attack, septic shock, traumatic brain injury, etc.) where the results should be obtained within 15-30 minutes; (2) large sample and reagent consumption (50-100 μL per sensor well), which adds significant costs to customers (~$200 per test); and (3) inadequate detection limit, typically on the order of 10-100 pg/mL, which makes it impossible to measure many clinically significant biomarkers at low concentrations. All those drawbacks hinder the employment of ELISA in various applications that needs rapid, low cost, high sensitivity testing of trace quantity of analytes.

SUMMARY

According to a first aspect of this disclosure, a microfluidic plate assembly comprises a top plate having a periphery that is defined at least in part by a left edge and a perpendicular upper edge. A plurality of microfluidic modules are disposed within the top plate, arranged in a rectilinear matrix of rows and columns. Each row is spaced apart from the next adjacent row a lateral distance of 9 mm. Each column is spaced apart from the next adjacent column a lateral distance of 9 mm. Each microfluidic module has an elongated microfluidic channel extending between an upstream inlet and a downstream outlet. The portion of the microfluidic channel between the upstream inlet and downstream outlet comprises a detection area adapted for taking optical measurements. Each microfluidic module includes a well disposed in fluid communication with the corresponding the upstream inlet of the microfluidic channel. The well is laterally offset from the detection area. Each detection area has a geometric center that is spaced apart from the left edge of the top plate according to the formula 14.38 mm+(9*x) mm where x is a non-negative integer. The geometric center of each detection area is spaced apart from upper edge of the top plate according to the formula 11.24 mm+(9*y) mm where y is a non-negative integer.

According to a second aspect of this disclosure, a microfluidic plate assembly comprises a top plate. A plurality of microfluidic modules are disposed within the top plate. The plurality of microfluidic modules are arranged in a rectilinear matrix of rows and columns. Each microfluidic module has an elongated microfluidic channel that extends between an upstream inlet and a downstream outlet. The portion of the microfluidic channel between the upstream inlet and the downstream outlet comprises a detection area that is adapted for taking optical measurements. Each microfluidic module includes a well disposed in fluid communication with the corresponding the upstream inlet of the microfluidic channel. Each detection area is formed in a serpentine pattern composed of a plurality of alternating runs connected by intervening loop ends. Each run is spaced apart from the next adjacent run by a generally consistent lateral spacing. Each of the runs in the serpentine pattern extend parallel to one another, and each run is canted relative to the rows of the matrix at a cant angle.

According to a third aspect of this disclosure, a microfluidic plate assembly comprises a top plate that has a top surface and an underside. A plurality of microfluidic modules are disposed within the top plate, arranged in a rectilinear matrix of rows and columns. Each microfluidic module has an elongated microfluidic channel that extends between an upstream inlet and a downstream outlet. The portion of the microfluidic channel between the upstream inlet and downstream outlet comprises a detection area adapted for taking optical measurements. Each microfluidic module includes a well disposed in fluid communication with the corresponding the upstream inlet of the microfluidic channel. And each detection area is formed in a serpentine pattern composed of a plurality of alternating runs connected by intervening loop ends. Each run is spaced apart from the next adjacent run by a generally consistent lateral spacing. Each of the runs in the serpentine pattern extending parallel to one another. An array of optically-transmissive micro-posts are disposed within each microfluidic channel. The micro-posts extend perpendicularly from the top surface of the top plate toward the underside. The array of micro-posts are equally distributed throughout the entire detection area, and each micro-post has a generally cylindrical shape.

The unique arrangement of components within each microfluidic module, as expressed through these various combinations or aspects of the disclosure, help assure consistent optical measurements from one test to the next. The various aspects of this disclosure also help expedite the molecule capture efficiency and can enable increased detection of light intensity.

DESCRIPTION OF THE FIGURES

The accompanying figures facilitate an understanding of the various, non-limiting embodiments of this technology.

FIG. 1A shows a top view of a micro-post array embedded microfluidic multi-well plate; FIG. 1B shows a bottom view thereof; FIG. 1C shows a front elevational view thereof; FIG. 1D shows a rear elevational view thereof; FIG. 1E shows a left side elevational view thereof and FIG. 1F shows a right side elevational view thereof.

DEFINITIONS

Figure 2A:
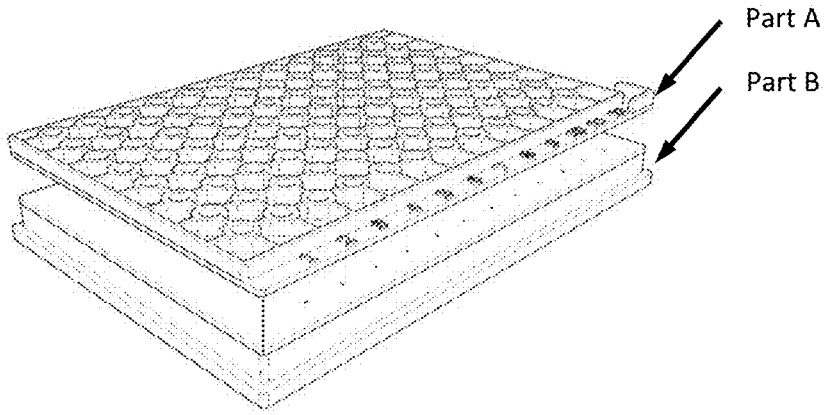
FIG. 2A shows an exploded perspective view of a micro-post array embedded microfluidic multi-well plate.

To facilitate an understanding of the present disclosure, a number of terms and phrases are defined below, or terms may be defined elsewhere in the disclosure:

The term "sample" is used in its broadest sense. On the one hand it is meant to include a specimen or culture. On the other hand, it is meant to include both biological and environmental samples.

Biological samples may be animal, including human, fluid, solid (e.g., stool) or tissue, as well as liquid and solid food and feed products and ingredients such as dairy items, vegetables, meat and meat by-products, and waste. Biological samples may be obtained from the various families of domestic animals, as well as feral or wild animals, including, but not limited to, such animals as ungulates, bear, fish, lagamorphs, rodents, etc. or combinations thereof.

Environmental samples include environmental material such as surface matter, soil, water and industrial samples, as well as samples obtained from food and dairy processing instruments, apparatus, equipment, utensils, disposable and non-disposable items or combinations thereof. These examples are not to be construed as limiting the sample types applicable to the present disclosure.

As used herein, the term "in vitro" refers to an artificial environment and to processes or reactions that occur within an artificial environment. In vitro environments can consist of, but are not limited to, test tubes and/or cell culture. The term "in vivo" refers to the natural environment (e.g., an animal or a cell) and to processes or reactions that occur within a natural environment.

The terms "test compound" and "candidate compound" refer to any chemical entity, pharmaceutical, drug, and the like that is a candidate for use to treat or prevent a disease, illness, sickness, or disorder of bodily function. Test compounds comprise both known and potential therapeutic compounds. A test compound may be determined to be therapeutic by screening using the screening methods, devices, and/or systems of the present disclosure. In certain embodiments of the present disclosure, test compounds may include antisense, siRNA and/or shRNA compounds.

The term "spheroid" refers to clusters or aggregates of cells and/or cell colonies.

Spheroids may be formed from various cell types, for example, primary cells, cell lines, tumor cells, stem cells, etc. Spheroids may have sphere-like or irregular shapes. Spheroids may contain heterogeneous populations of cells, cell types, cells of different states, such as proliferating cells, quiescent cells, and necrotic cells.

DETAILED DESCRIPTION

The following description is provided in relation to several embodiments which may share common characteristics and features. It is to be understood that one or more features of one embodiment may be combinable with one or more features of the other embodiments. In addition, a single feature or combination of features in any of the embodiments may constitute additional embodiments.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

The subject headings used in the detailed description are included only for the ease of reference of the reader and should not be used to limit the subject matter found throughout the disclosure or the claims. The subject headings should not be used in construing the scope of the claims or the claim limitations.

Provided herein are assay plates and uses thereof. In particular provided herein are assay plates for performing biological and chemical assays and detecting assay results. In some embodiments, the plates comprise multi (e.g., 96) microfluidic modules 22 that conform to the dimensions of a standard 96-well or other size plates. Thus, the plate can be used to measure fluorescence, luminescence, Raman scattering, surface enhanced Raman scattering, and absorption with any available standard plate readers in the market. The present disclosure is not limited to a 96-microfluidic well plate. In some embodiments, the design is customized based on customer requirements such as desired number of microfluidic modules 22 and their positions, and the size of individual microfluidic module 22. Furthermore, in some embodiments, a reflective layer is coated on an outside surface of the plate to improve optical detection efficiency.

The plates described herein provide significant advantages over existing technologies. For example, placing the inlet away from the detection region avoids potential interference with optical measurements and any residual liquid left in the inlet. This significantly reduces measurement variability and improves signal intensity (See experimental section). In addition, symmetrical channels allow a large tolerance in optical detection position without signal variation. The inclusion of posts within the microfluidic channels increases surface to volume ratio and/or mass transport rate to improve analyte capture efficiency and the total number of captured analytes. This reduces overall assay time and increases signal intensity. In addition, each post may work as an optical waveguide to direct the light to the light detector, which further increases signal intensity. The addition of an outlet nozzle and optional pump improves flow inside the fluid channel, which reduces assay time and measurement variation. The inclusion of an optional reflective layer at the bottom of the assay plate reflects light back to the detector and increases signal.

Exemplary plates are shown in FIGS. 1-12. The plates illustrated in the Figures utilize a 96 well configuration, although other configurations are contemplated. The plate has two parts, a top, Part A and a bottom, Part B. They are attached together and hermetically sealed with adhesive film 58 or glue or using ultrasonic plastic welding technique or other suitable method. Alternatively, the Part B can be replaced with adhesive film 58 with die cut holes. In the top Part A, 96 microfluidic modules 22 are arranged and positioned in 8×12 format array for reading with market available standard plate readers. Each module 22 has a fluidic inlet and a loop of microfluidic channel. 96 open-bottom fluidic outlets are located in the bottom of Part B or die cut adhesive film 58. Microstructured posts are systematically arranged in the loop of microfluidic channel that connects to the inlet and the outlet. In some embodiments, the plate's footprint, height, bottom and outside flange are adapted from ANSI (the American National Standards Institute)/SLAS (Society for Laboratory Automation and Screening) 96-well plate standard. During the measurement, reagents and samples are added from the inlet, then flow through the loop channel, and eventually drain from the outlet by a wicking method or pressure differential. Optical signal can be detected at the center of the loop of channel without adjusting standard micro plate reader.

The dimension of each microfluidic module 22 can be scaled either smaller or larger than that in this disclosure. In some embodiments, an optional reflective layer is coated on the surface of the plate on the opposite side of detection (e.g., to improve optical detection efficiency).

The advantages of this design are: (1) It is completely compatible with standard well plate readers; (2) The micro-structured post increases the surface-to-volume ratio and/or mass transport rate, which improves analyte capture efficiency and the total number captured analytes, and boost sensitivity; (3) Flow-through design simplifies the sample (solution) addition and withdrawal for reduced assay time; (4) Part of emitted light is guided and accumulated along the longitudinal direction of the microstructured post that enhances signal collection and hence sensitivity; and (5) (Optional) The collection efficiency can be further increased using reflective coating or reflective mirror at an outside surface of the plate.

I. Plates

FIG. 1A-F exhibit a micro-post array embedded microfluidic multi-well plate according to one exemplary embodiment of the disclosure. In some embodiments, plates are shown as standard round wells, although other shapes and sizes of wells are specifically contemplated (e.g., larger or smaller wells than ANSI standards or square or abstract shaped wells). The Figure shows (1) funnel-shape-well attached micro-post array embedded microfluidic modules 22, Part A, and (2) drain holes or adhesive film with die cut holes, Part B. The microfluidic outlets 34 (in FIG. 3) are well aligned with corresponding drain holes 44 in the Part B (in FIG. 4). The plate's footprint, height, bottom and outside flange, and well position dimensions are adapted from ANSI (the American National Standards Institute)/SLAS (Society for Laboratory Automation and Screening) 1-2004, 2-2004, 3-2004, and 4-2004 respectively. Thus, the plate is compatible with any standard plate reader. The outside dimensions of the base footprint length and width of the plate are 5.0299 and 3.3654 inches respectively. The height of the plate is 0.565 inch. The plate has a surrounding skirt 42, a top surface 38 and an array of funnel-shape-wells 32 attached to the micro-post array embedded microfluidic channels 36 (in FIG. 3). The detection areas 56 are arranged in a rectilinear matrix comprising 12 rows and 8 columns corresponding to the standard microplate reader excitation and collection positions established by ANSI/SLAS. Centers of adjacent detection areas are spaced apart 0.3542 inch. The microfluidic 96-well can be adapted for any customized number of modules 22 in a similar manner described in this disclosure. (E.g., FIGS. 9 and 10 portray an embodiment having nine modules 22 arranged in a 3×3 matrix.) In some embodiments, Part A and Part B are formed by injection molding and made of plastic (e.g., polystyrene, PMMA (Poly(methyl methacrylate)). In some embodiments, they are bonded and hermetically sealed with adhesive film 58 or glue or using ultrasonic plastic welding technique or other suitable method.

Figure 5A:
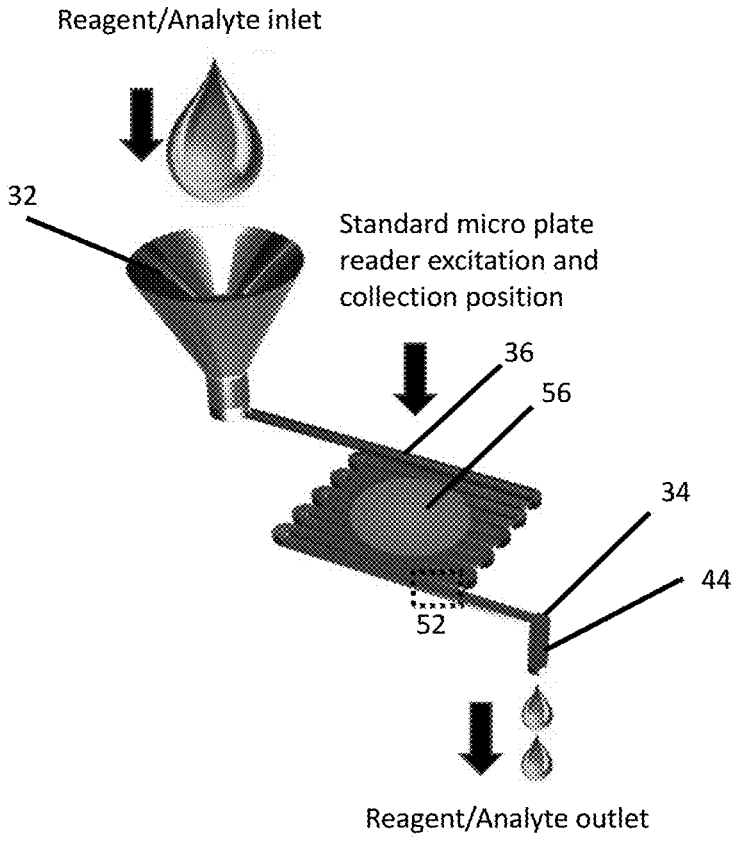
FIG. 5A shows a schematic detail of a microfluidic module.

The wells 32 comprise respective inlets and are shown in some embodiments as funnel shaped, although other shapes are specifically contemplated. The inlet may be funnel shaped as shown in FIG. 5A, cylindrical, triangular, inverted funnel, or other configurations. Any configuration that allows reagents, samples, etc. to enter the wells may be utilized.

Figure 2B:
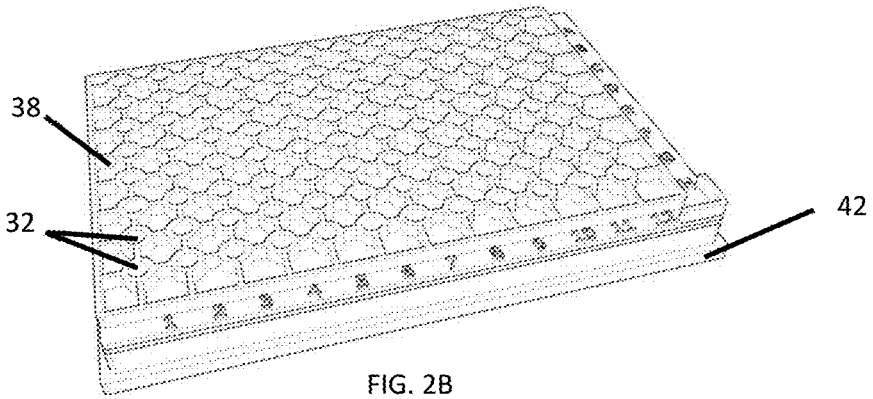
FIG. 2B shows a perspective view of thereof.
Figure 2C:
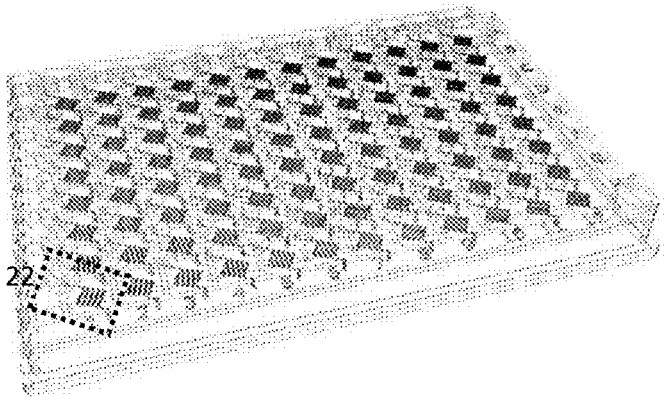
FIG. 2C shows a perspective view with hidden line of thereof.

FIG. 2A, FIG. 2B, and FIG. 2C show an exploded perspective view, a perspective view, and a perspective view with hidden lines of the present disclosure. The Part A and Part B are stacked and aligned as shown in FIG. 2A, and then bonded together as shown in FIG. 2B. The array of 96 individual microfluidic modules 22 can be seen in FIG. 2C.

Figure 3A:
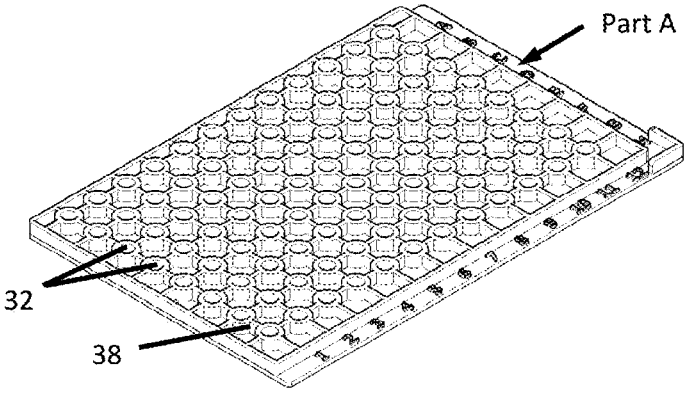
FIG. 3A shows an isometric view of Part A.
Figure 3B:
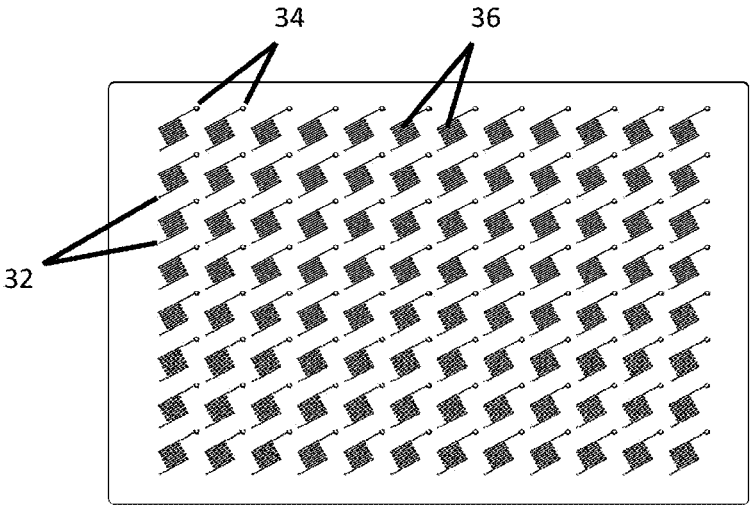
FIG. 3B shows a bottom view thereof.

FIG. 3A is an isometric view of Part A, and FIG. 3B is a bottom view of it. The array of microfluidic modules 22 are arranged in 12 rows with 8 columns. Centers of adjacent modules 22 are spaced apart 0.3542 inch. Each module 22 has funnel-shape-well 32, which has a depth of 0.118 inch, diameters of 0.118 inch at the entrance, and 0.039 inch at the exit that located next to the entrance of microfluidic channel 36. The microfluidic channels 36 are not limited to particular sizes and shapes.

In some embodiments, the microfluidic channels 36 are circular, oval, square or another shape and are approximately 0.001-0.1 inch in diameter. In some embodiments, microfluidic channels 36 are arranged in a series (e.g., at least 1, 2, 3, 4, 5, 10, 50, or more) U or S shaped curves, although other configurations are specifically contemplated, depending on the application. The other end of the micro-post array 54 embedded loop microfluidic channel 36 has an outlet 34 with diameter of 0.02 inch. Other sizes are specifically contemplated based on space and assay configuration. The funnel-shape-well 32 on the top layer of the Part A delivers samples/reagents to the corresponding microfluidic channel 36 with easy, convenient, and efficient way.

Figure 4A:
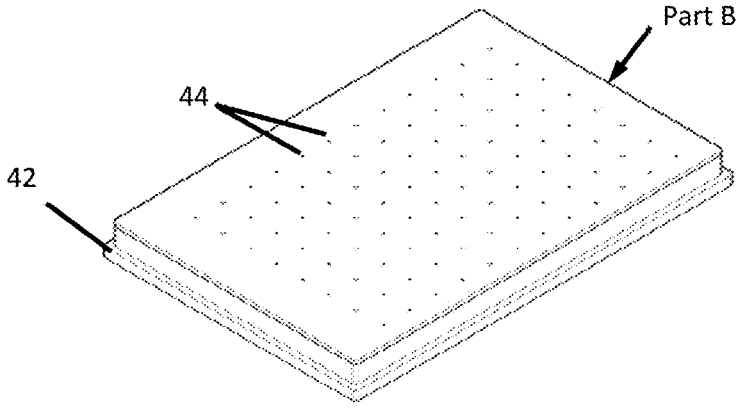
FIG. 4A shows an isometric view of Part B.
Figure 4B:
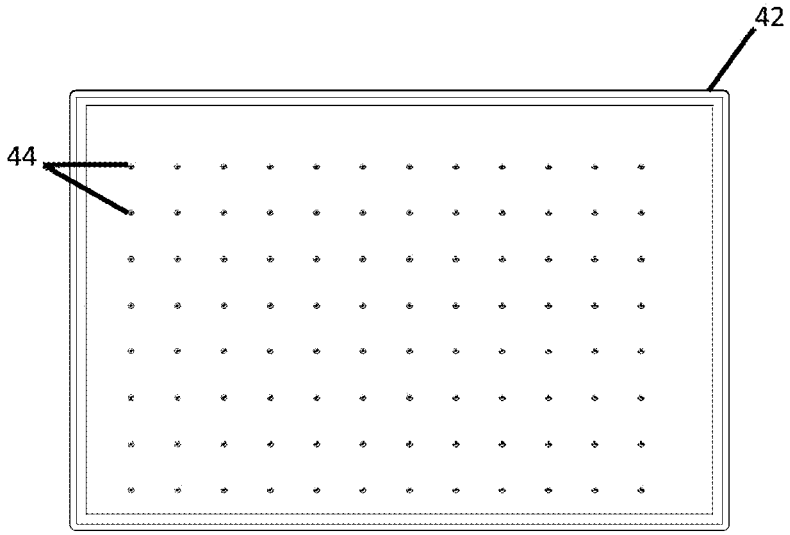
FIG. 4B shows a bottom view thereof.

FIG. 4A is an isometric view of Part B and FIG. 4B is a bottom view of it. The Part B of the skirt 42 fits any standard plate readers. Cylindrical drain tubes or holes 44 with heights of 0.078 inch, inner diameters of 0.02 inch, and outer diameters of 0.059 inch, are arranged in 12 rows with 8 columns. The drain holes 44 are aligned with fluid exit openings of Part A.

Figure 5B:
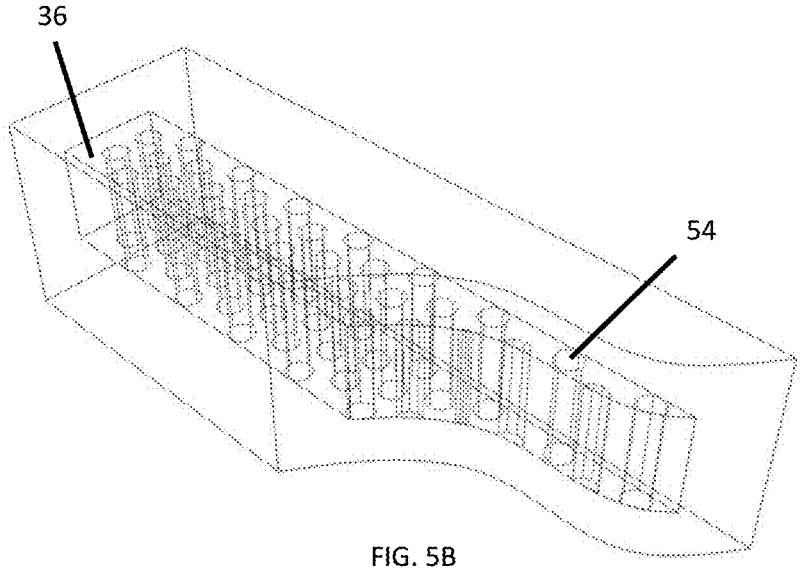
FIG. 5B is a detail of a fragment of the micro-post array embedded within the microfluidic channel of a module like that depicted in FIG. 5A.

FIG. 5A is a schematic detail of a microfluidic module 22 according to an embodiment of the disclosure. Samples and reagents can flow from the funnel-shape-well 32 through the micro-post array 54 embedded loop microfluidic channel 36. Those fluids can be withdrawn from the outlet 34 and the cylindrical drain tube 44 or adhesive film 58 with openings that are aligned with the outlet 34 (FIG. 24) with die cut holes using a wicking method or pressure differential. The optical signal can be acquired at the center of the microfluidic loop, i.e. the detection area 56, located at standard micro plate reader optical excitation and collection position. FIG. 5B is a fragmentary detail of micro-post array 54 embedded microfluidic channel 36 at the call-out section 52 of the loop microfluidic channel 36. The depth and width of microfluidic channel 36 may be about 0.008 inch and 0.008 inch, however further discussion of exemplary dimensional specifications are provided below. Between adjacent two loops of the microfluidic channel 36 is a 0.008 inch thick wall. In the channel 36, micro-posts 54 which have 0.002 inch in diameter and 0.008 inch in height (the same as or slightly less than the depth of the channel 36) are located 0.003 inch apart. The desired range of depth and width of the microfluidic channel 36, height, and diameter of the micro-posts, and allocation of the micro-posts (See e.g., Examples) are adjusted based on manufacturing feasibility and use.

A plurality of micro-posts 54 are shown. The present disclosure is not limited to the number, size, or shape of the posts. In some embodiments, each microfluidic channel 36 has from 10-1000 (e.g., 20-750, 50-500, or 50-250) posts 54. In some embodiments, the micro-posts 54 are cylindrical, prism, rectangular, trapezoidal, or other shape. In some embodiments, the micro-posts 54 are approximately 0.002 to 0.004 inch in diameter and 0.0002 to 0.008 inch in height, although other sizes are specifically contemplated. In some embodiments, the micro-posts 54 serve to increase sensitivity of the assay by providing additional binding locations for assay reagents (e.g., antibodies or nucleic acids). This is described in greater detail below in connection with FIGS. 23-33.

Figure 6A:
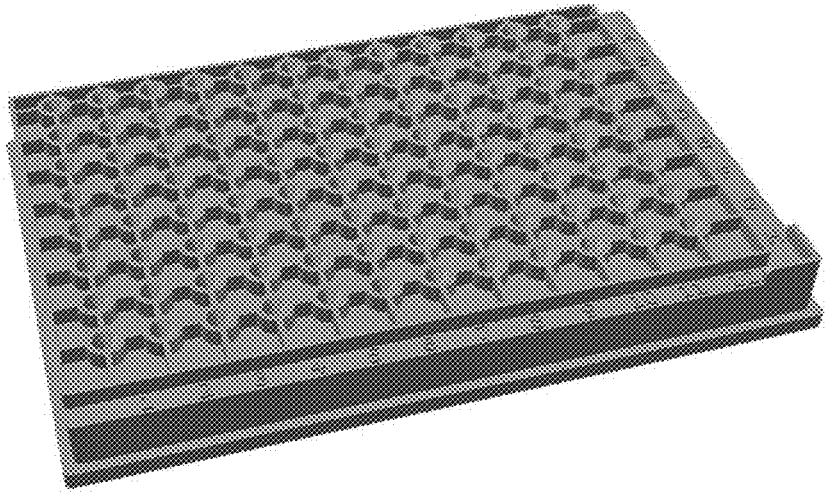
FIG. 6A illustrates rendered 3D image at top perspective view of a fully-assembled micro-post array embedded microfluidic multi-well plate.
Figure 6B:
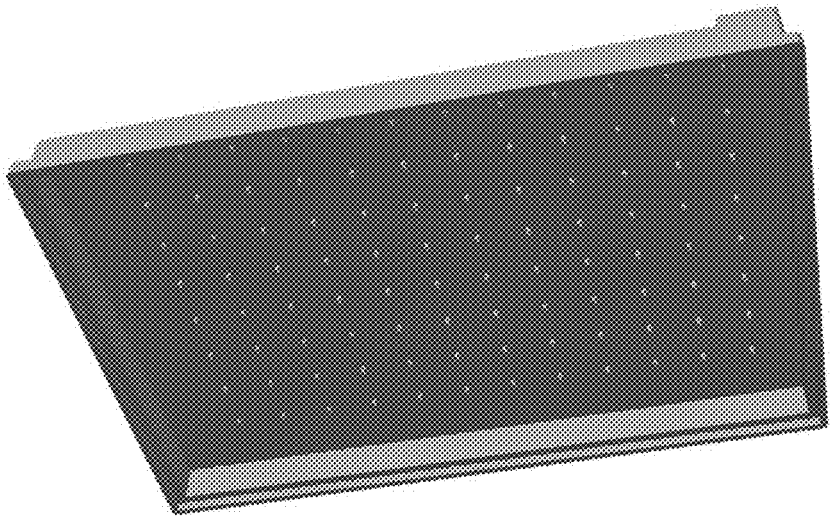
FIG. 6B illustrates rendered 3D image at bottom perspective view thereof.
Figure 7C:
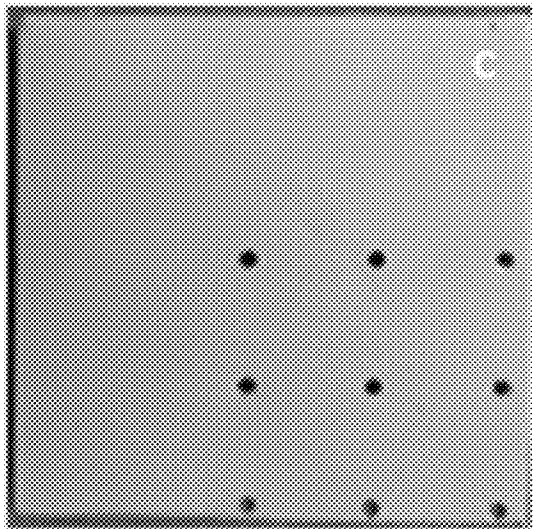
FIG. 7A-C shows photographs of manufactured (A) Part A, (B) Part B, and (C) die cut adhesive film.
Figure 7B:
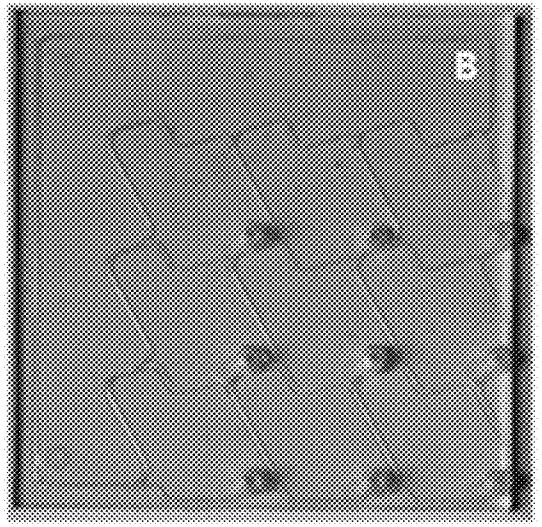
Figure 7A:
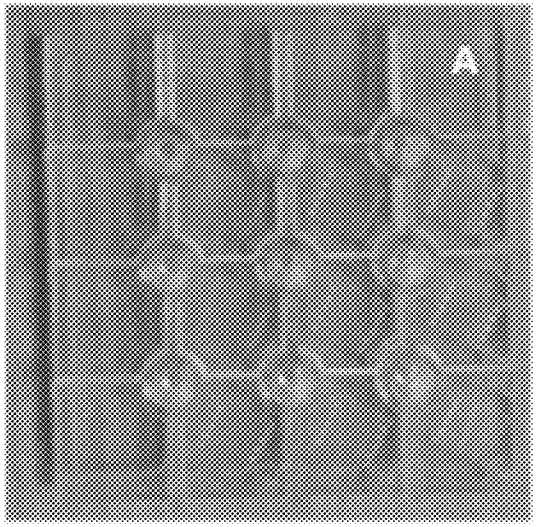

FIGS. 6A and 6B illustrate the visual appearance of a fully-assembled micro-post array 54 embedded microfluidic multi-well plate at a top perspective view and a bottom perspective view respectively.

In some embodiments, the present disclosure provides systems and/or kits comprising devices (e.g., comprising assay plates), alone or in combination with reagents for performing assays (e.g., nucleic acid primers and probes, antibodies, detection reagents, buffers, test compounds, controls, etc.). In some embodiments, systems and kits comprise robotics for use in high throughput analysis (e.g., sample handling and analysis (e.g., plate readers) equipment). In some embodiments, systems further comprise detection components (e.g., plate readers and spectrophotometers)

II. Uses

The assay plate devices of certain embodiments of the present disclosure find use in a variety of applications (e.g., diagnostic, screening, and research applications). In some embodiments, assays are performed to determine the presence of an analyte in a sample (e.g., biological sample). A variety of nucleic acid and amino acid detections assays can be performed in the assay plates. Exemplary assays are described below.

In some embodiments, reagents (e.g., capture nucleic acids or antibodies) are added to each microfluidic module 22 through the associated sample well 32 which functions as the inlet. Reagents then adhere to the micro-posts 54 and the interior walls of the microfluidic channel 36. Next, sample (e.g., test samples suspected of containing an analyte) are added via the well 32. Excess reagents are removed via the outlet. Once the assay is completed, a plate reader (FIG. 29) or spectrometer is used to visualize assay results in the microfluidic channel 36. In some embodiments, computer systems and/or computer software is used to determine and report assay results (e.g., presence of analytes in the test sample) to the user via a user interface (e.g., computer screen, tablet, smart phone, etc.). In some embodiments, the results are used in research, diagnosis, or determining a treatment course of action.

Illustrative non-limiting examples of immunoassays include, but are not limited to: immunoprecipitation; Western blot; ELISA; immunohistochemistry; immunocytochemistry; immunochromatography; flow cytometry; and, immuno-PCR. Polyclonal or monoclonal antibodies detectably labeled using various techniques known to those of ordinary skill in the art (e.g., colorimetric, fluorescent, chemiluminescent or radioactive labels) are suitable for use in the immunoassays.

Immunoprecipitation is the technique of precipitating an antigen out of solution using an antibody specific to that antigen. The process can be used to identify proteins or protein complexes present in cell extracts by targeting a specific protein or a protein believed to be in the complex. The complexes are brought out of solution by insoluble antibody-binding proteins isolated initially from bacteria, such as Protein A and Protein G. The antibodies can also be coupled to sepharose beads that can easily be isolated out of solution. After washing, the precipitate can be analyzed using mass spectrometry, Western blotting, or any number of other methods for identifying constituents in the complex.

A Western blot, or immunoblot, is a method to detect protein in a given sample of tissue homogenate or extract. It uses gel electrophoresis to separate denatured proteins by mass. The proteins are then transferred out of the gel and onto a membrane, typically polyvinyldiflroride, or nitrocellulose, where they are probed using antibodies specific to the protein of interest. As a result, researchers can examine the amount of protein in a given sample and compare levels between several groups.

An ELISA, short for Enzyme-Linked ImmunoSorbent Assay, is a biochemical technique to detect the presence of an antibody or an antigen in a sample. It utilizes a minimum of two antibodies, one of which is specific to the antigen and the other of which is coupled to an enzyme. The second antibody will cause a chromogenic or fluorogenic substrate to produce a signal. Variations of ELISA include sandwich ELISA, competitive ELISA, and ELISPOT. Because the ELISA can be performed to evaluate either the presence of antigen or the presence of antibody in a sample, it is a useful tool both for determining serum antibody concentrations and also for detecting the presence of antigen.

Immunohistochemistry and immunocytochemistry refer to the process of localizing proteins in a tissue section or cell, respectively, via the principle of antigens in tissue or cells binding to their respective antibodies. Visualization is enabled by tagging the antibody with color producing or fluorescent tags. Typical examples of color tags include, but are not limited to, horseradish peroxidase and alkaline phosphatase. Typical examples of fluorophore tags include, but are not limited to, fluorescein isothiocyanate (FITC) or phycoerythrin (PE).

Flow cytometry is a technique for counting, examining and optionally sorting microscopic particles or cells suspended in a stream of fluid. It allows simultaneous multiparametric analysis of the physical and/or chemical characteristics of single cells flowing through an optical/electronic detection apparatus. A beam of light (e.g., a laser) of a single frequency or color is directed onto a hydrodynamically focused stream of fluid. A number of detectors are aimed at the point where the stream passes through the light beam; one in line with the light beam (Forward Scatter or FSC) and several perpendicular to it (Side Scatter (SSC) and one or more fluorescent detectors). Each suspended particle passing through the beam scatters the light in some way, and fluorescent chemicals in the particle may be excited into emitting light at a lower frequency than the light source. The combination of scattered and fluorescent light is picked up by the detectors, and by analyzing fluctuations in brightness at each detector, one for each fluorescent emission peak, it is possible to deduce various facts about the physical and chemical structure of each individual particle. FSC correlates with the cell volume and SSC correlates with the density or inner complexity of the particle (e.g., shape of the nucleus, the amount and type of cytoplasmic granules or the membrane roughness).

Immuno-polymerase chain reaction (IPCR) utilizes nucleic acid amplification techniques to increase signal generation in antibody-based immunoassays. Because no protein equivalence of PCR exists, that is, proteins cannot be replicated in the same manner that nucleic acid is replicated during PCR, the only way to increase detection sensitivity is by signal amplification. The target proteins are bound to antibodies which are directly or indirectly conjugated to oligonucleotides. Unbound antibodies are washed away and the remaining bound antibodies have their oligonucleotides amplified. Protein detection occurs via detection of amplified oligonucleotides using standard nucleic acid detection methods, including real-time methods.

Exemplary nucleic acid detection methods that can be performed in the assay plates described herein include, but are not limited to, sequencing assays, amplification assays, and hybridization assays.

Illustrative non-limiting examples of nucleic acid sequencing techniques include, but are not limited to, chain terminator (Sanger) sequencing and dye terminator sequencing, or high throughput sequencing methods. The present disclosure is not intended to be limited to any particular methods of sequencing. Those of ordinary skill in the art will recognize that because RNA is less stable in the cell and more prone to nuclease attack experimentally RNA is usually reverse transcribed to DNA before sequencing.

In some embodiments, the sequencing is the real-time single molecule sequencing system developed by Pacific Biosciences (Voelkerding et al., Clinical Chem., 55: 641-658, 2009; MacLean et al., Nature Rev. Microbiol., 7: 287-296; U.S. Pat. No. 7,170,050; U.S. Pat. No. 7,302,146; U.S. Pat. No. 7,313,308; U.S. Pat. No. 7,476,503; all of which are herein incorporated by reference) utilizes reaction wells 50-100 nm in diameter and encompassing a reaction volume of approximately 20 zeptoliters (10×10-21 L). Sequencing reactions are performed using immobilized template, modified phi29 DNA polymerase, and high local concentrations of fluorescently labeled dNTPs. High local concentrations and continuous reaction conditions allow incorporation events to be captured in real time by fluor signal detection using laser excitation, an optical waveguide, and a CCD camera.

A number of other DNA sequencing techniques can be used, including fluorescence-based sequencing methodologies (See, e.g., Birren et al., Genome Analysis: Analyzing DNA, 1, Cold Spring Harbor, N.Y.; herein incorporated by reference in its entirety). In some embodiments, automated sequencing techniques understood in that art are utilized. In some embodiments, DNA sequencing is achieved by parallel oligonucleotide extension (See, e.g., U.S. Pat. No. 5,750,341 to Macevicz et al., and U.S. Pat. No. 6,306,597 to Macevicz et al., both of which are herein incorporated by reference in their entireties). Additional examples of sequencing techniques include the Church polony technology (Mitra et al., 2003, Analytical Biochemistry 320, 55-65; Shendure et al., 2005 Science 309, 1728-1732; U.S. Pat. No. 6,432,360, U.S. Pat. No. 6,485,944, U.S. Pat. No. 6,511,803; herein incorporated by reference in their entireties) the 454 picotiter pyrosequencing technology (Margulies et al., 2005 Nature 437, 376-380; US 20050130173; herein incorporated by reference in their entireties), the Solexa single base addition technology (Bennett et al., 2005, Pharmacogenomics, 6, 373-382; U.S. Pat. No. 6,787,308; U.S. Pat. No. 6,833,246; herein incorporated by reference in their entireties), the Lynx massively parallel signature sequencing technology (Brenner et al. (2000). Nat. Biotechnol. 18:630-634; U.S. Pat. No. 5,695,934; U.S. Pat. No. 5,714,330; herein incorporated by reference in their entireties) and the Adessi PCR colony technology (Adessi et al. (2000). Nucleic Acid Res. 28, E87; WO 00018957; herein incorporated by reference in its entirety).

A set of methods referred to as "next-generation sequencing" techniques have emerged as alternatives to Sanger and dye-terminator sequencing methods (Voelkerding et al., Clinical Chem., 55: 641-658, 2009; MacLean et al., Nature Rev. Microbiol., 7: 287-296; each herein incorporated by reference in their entirety). Next-generation sequencing (NGS) methods share the common feature of massively parallel, high-throughput strategies, with the goal of lower costs in comparison to older sequencing methods. NGS methods can be broadly divided into those that require template amplification and those that do not. Amplification-requiring methods include pyrosequencing commercialized by Roche as the 454 technology platforms (e.g., GS 20 and GS FLX), the Solexa platform commercialized by Illumina, and the Supported Oligonucleotide Ligation and Detection (SOLiD) platform commercialized by Applied Biosystems. Non-amplification approaches, also known as single-molecule sequencing, are exemplified by the HeliScope platform commercialized by Helicos BioSciences, and emerging platforms commercialized by VisiGen, Oxford Nanopore Technologies Ltd., and Pacific Biosciences, respectively.

In pyrosequencing (Voelkerding et al., Clinical Chem., 55: 641-658, 2009; MacLean et al., Nature Rev. Microbiol., 7: 287-296; U.S. Pat. No. 6,210,891; U.S. Pat. No. 6,258,568; each herein incorporated by reference in its entirety), template DNA is fragmented, end-repaired, ligated to adaptors, and clonally amplified in-situ by capturing single template molecules with beads bearing oligonucleotides complementary to the adaptors. Each bead bearing a single template type is compartmentalized into a water-in-oil microvesicle, and the template is clonally amplified using a technique referred to as emulsion PCR. The emulsion is disrupted after amplification and beads are deposited into individual wells of a picotitre plate functioning as a flow cell during the sequencing reactions. Ordered, iterative introduction of each of the four dNTP reagents occurs in the flow cell in the presence of sequencing enzymes and luminescent reporter such as luciferase. In the event that an appropriate dNTP is added to the 3' end of the sequencing primer, the resulting production of ATP causes a burst of luminescence within the well, which is recorded using a CCD camera. It is possible to achieve read lengths greater than or equal to 400 bases, and 1×106 sequence reads can be achieved, resulting in up to 500 million base pairs (Mb) of sequence.

In the Solexa/Illumina platform (Voelkerding et al., Clinical Chem., 55: 641-658, 2009; MacLean et al., Nature Rev. Microbiol., 7: 287-296; U.S. Pat. No. 6,833,246; U.S. Pat. No. 7,115,400; U.S. Pat. No. 6,969,488; each herein incorporated by reference in its entirety), sequencing data are produced in the form of shorter-length reads. In this method, single-stranded fragmented DNA is end-repaired to generate 5'-phosphorylated blunt ends, followed by Klenow-mediated addition of a single A base to the 3' end of the fragments. A-addition facilitates addition of T-overhang adaptor oligonucleotides, which are subsequently used to capture the template-adaptor molecules on the surface of a flow cell that is studded with oligonucleotide anchors. The anchor is used as a PCR primer, but because of the length of the template and its proximity to other nearby anchor oligonucleotides, extension by PCR results in the "arching over" of the molecule to hybridize with an adjacent anchor oligonucleotide to form a bridge structure on the surface of the flow cell. These loops of DNA are denatured and cleaved. Forward strands are then sequenced with reversible dye terminators. The sequence of incorporated nucleotides is determined by detection of post-incorporation fluorescence, with each fluor and block removed prior to the next cycle of dNTP addition. Sequence read length ranges from 36 nucleotides to over 50 nucleotides, with overall output exceeding 1 billion nucleotide pairs per analytical run.

Sequencing nucleic acid molecules using SOLiD technology (Voelkerding et al., Clinical Chem., 55: 641-658, 2009; MacLean et al., Nature Rev. Microbiol., 7: 287-296; U.S. Pat. No. 5,912,148; U.S. Pat. No. 6,130,073; each herein incorporated by reference in their entirety) also involves fragmentation of the template, ligation to oligonucleotide adaptors, attachment to beads, and clonal amplification by emulsion PCR. Following this, beads bearing template are immobilized on a derivatized surface of a glass flow-cell, and a primer complementary to the adaptor oligonucleotide is annealed. However, rather than utilizing this primer for 3' extension, it is instead used to provide a 5' phosphate group for ligation to interrogation probes containing two probe-specific bases followed by 6 degenerate bases and one of four fluorescent labels. In the SOLiD system, interrogation probes have 16 possible combinations of the two bases at the 3' end of each probe, and one of four fluors at the 5' end. Fluor color and thus identity of each probe corresponds to specified color-space coding schemes. Multiple rounds (usually 7) of probe annealing, ligation, and fluor detection are followed by denaturation, and then a second round of sequencing using a primer that is offset by one base relative to the initial primer. In this manner, the template sequence can be computationally re-constructed, and template bases are interrogated twice, resulting in increased accuracy. Sequence read length averages 35 nucleotides, and overall output exceeds 4 billion bases per sequencing run.

In certain embodiments, nanopore sequencing in employed (see, e.g., Astier et al., J Am Chem Soc. 2006 Feb. 8; 128(5):1705-10, herein incorporated by reference). The theory behind nanopore sequencing has to do with what occurs when the nanopore is immersed in a conducting fluid and a potential (voltage) is applied across it: under these conditions a slight electric current due to conduction of ions through the nanopore can be observed, and the amount of current is exceedingly sensitive to the size of the nanopore. If DNA molecules pass (or part of the DNA molecule passes) through the nanopore, this can create a change in the magnitude of the current through the nanopore, thereby allowing the sequences of the DNA molecule to be determined.

In certain embodiments, HeliScope by Helicos BioSciences is employed (Voelkerding et al., Clinical Chem., 55: 641-658, 2009; MacLean et al., Nature Rev. Microbiol., 7: 287-296; U.S. Pat. No. 7,169,560; U.S. Pat. No. 7,282,337; U.S. Pat. No. 7,482,120; U.S. Pat. No. 7,501,245; U.S. Pat. No. 6,818,395; U.S. Pat. No. 6,911,345; U.S. Pat. No. 7,501,245; each herein incorporated by reference in their entirety). Template DNA is fragmented and polyadenylated at the 3' end, with the final adenosine bearing a fluorescent label. Denatured polyadenylated template fragments are ligated to poly(dT) oligonucleotides on the surface of a flow cell. Initial physical locations of captured template molecules are recorded by a CCD camera, and then label is cleaved and washed away. Sequencing is achieved by addition of polymerase and serial addition of fluorescently-labeled dNTP reagents. Incorporation events result in fluor signal corresponding to the dNTP, and signal is captured by a CCD camera before each round of dNTP addition. Sequence read length ranges from 25-50 nucleotides, with overall output exceeding 1 billion nucleotide pairs per analytical run.

In certain embodiments, the Ion Torrent technology (Life Technologies) is employed to sequence purified target nucleic acid sequences. The Ion Torrent technology is a method of DNA sequencing based on the detection of hydrogen ions that are released during the polymerization of DNA (see, e.g., Science 327(5970): 1190 (2010); U.S. Pat. Appl. Pub. Nos. 20090026082, 20090127589, 20100301398, 20100197507, 20100188073, and 20100137143, incorporated by reference in their entireties for all purposes). A microwell contains a template DNA strand to be sequenced. Beneath the layer of microwells is a hypersensitive ISFET ion sensor. All layers are contained within a CMOS semiconductor chip, similar to that used in the electronics industry. When a dNTP is incorporated into the growing complementary strand a hydrogen ion is released, which triggers a hypersensitive ion sensor. If homopolymer repeats are present in the template sequence, multiple dNTP molecules will be incorporated in a single cycle. This leads to a corresponding number of released hydrogens and a proportionally higher electronic signal. This technology differs from other sequencing technologies in that no modified nucleotides or optics are used. The per-base accuracy of the Ion Torrent sequencer is ~99.6% for 50 base reads, with ~100 Mb generated per run. The read-length is 100 base pairs. The accuracy for homopolymer repeats of 5 repeats in length is ~98%. The benefits of ion semiconductor sequencing are rapid sequencing speed and low upfront and operating costs.

Another exemplary nucleic acid sequencing approach that may be adapted for use with the present disclosure was developed by Stratos Genomics, Inc. and involves the use of Xpandomers. This sequencing process typically includes providing a daughter strand produced by a template-directed synthesis. The daughter strand generally includes a plurality of subunits coupled in a sequence corresponding to a contiguous nucleotide sequence of all or a portion of a target nucleic acid in which the individual subunits comprise a tether, at least one probe or nucleobase residue, and at least one selectively cleavable bond. The selectively cleavable bond(s) is/are cleaved to yield an Xpandomer of a length longer than the plurality of the subunits of the daughter strand. The Xpandomer typically includes the tethers and reporter elements for parsing genetic information in a sequence corresponding to the contiguous nucleotide sequence of all or a portion of the target nucleic acid. Reporter elements of the Xpandomer are then detected. Additional details relating to Xpandomer-based approaches are described in, for example, U.S. Patent Publication No. 20090035777.

Other emerging single molecule sequencing methods include real-time sequencing by synthesis using a VisiGen platform (Voelkerding et al., Clinical Chem., 55: 641-658, 2009; U.S. Pat. No. 7,329,492; U.S. patent application Ser. No. 11/671,956; U.S. patent application Ser. No. 11/781,166; each herein incorporated by reference in their entirety) in which immobilized, primed DNA template is subjected to strand extension using a fluorescently-modified polymerase and florescent acceptor molecules, resulting in detectible fluorescence resonance energy transfer (FRET) upon nucleotide addition.

Illustrative non-limiting examples of nucleic acid hybridization techniques include, but are not limited to, in situ hybridization (ISH), microarray, and Southern or Northern blot. In situ hybridization (ISH) is a type of hybridization that uses a labeled complementary DNA or RNA strand as a probe to localize a specific DNA or RNA sequence in a portion or section of tissue (in situ), or, if the tissue is small enough, the entire tissue (whole mount ISH). DNA ISH can be used to determine the structure of chromosomes. RNA ISH is used to measure and localize mRNAs and other transcripts within tissue sections or whole mounts. Sample cells and tissues are usually treated to fix the target transcripts in place and to increase access of the probe. The probe hybridizes to the target sequence at elevated temperature, and then the excess probe is washed away. The probe that was labeled with radio-, fluorescent- or antigen-labeled bases is localized and quantitated in the tissue using autoradiography, fluorescence microscopy or immunohistochemistry. ISH can also use two or more probes, labeled with radioactivity or the other non-radioactive labels, to simultaneously detect two or more transcripts.

Illustrative non-limiting examples of nucleic acid amplification techniques include, but are not limited to, polymerase chain reaction (PCR), reverse transcription polymerase chain reaction (RT-PCR), transcription-mediated amplification (TMA), ligase chain reaction (LCR), strand displacement amplification (SDA), and nucleic acid sequence-based amplification (NASBA). Those of ordinary skill in the art will recognize that certain amplification techniques (e.g., PCR) require that RNA be reversed transcribed to DNA prior to amplification (e.g., RT-PCR), whereas other amplification techniques directly amplify RNA (e.g., TMA and NASBA).

Amplification products may be detected in real-time through the use of various self-hybridizing probes, most of which have a stem-loop structure. Such self-hybridizing probes are labeled so that they emit differently detectable signals, depending on whether the probes are in a self-hybridized state or an altered state through hybridization to a target sequence. By way of non-limiting example, "molecular torches" are a type of self-hybridizing probe that includes distinct regions of self-complementarity (referred to as "the target binding domain" and "the target closing domain") which are connected by a joining region (e.g., non-nucleotide linker) and which hybridize to each other under predetermined hybridization assay conditions. In a preferred embodiment, molecular torches contain single-stranded base regions in the target binding domain that are from 1 to about 20 bases in length and are accessible for hybridization to a target sequence present in an amplification reaction under strand displacement conditions. Under strand displacement conditions, hybridization of the two complementary regions, which may be fully or partially complementary, of the molecular torch is favored, except in the presence of the target sequence, which will bind to the single-stranded region present in the target binding domain and displace all or a portion of the target closing domain. The target binding domain and the target closing domain of a molecular torch include a detectable label or a pair of interacting labels (e.g., luminescent/quencher) positioned so that a different signal is produced when the molecular torch is self-hybridized than when the molecular torch is hybridized to the target sequence, thereby permitting detection of probe:target duplexes in a test sample in the presence of unhybridized molecular torches. Molecular torches and a variety of types of interacting label pairs, including fluorescence resonance energy transfer (FRET) labels, are disclosed in, for example U.S. Pat. Nos. 6,534,274 and 5,776,782, each of which is herein incorporated by reference in its entirety.

The interaction between two molecules can also be detected, e.g., using fluorescence energy transfer (FRET) (see, for example, Lakowicz et al., U.S. Pat. No. 5,631,169; Stavrianopoulos et al., U.S. Pat. No. 4,968,103; each of which is herein incorporated by reference). A fluorophore label is selected such that a first donor molecule's emitted fluorescent energy will be absorbed by a fluorescent label on a second, 'acceptor' molecule, which in turn is able to fluoresce due to the absorbed energy.

Alternately, the 'donor' protein molecule may simply utilize the natural fluorescent energy of tryptophan residues. Labels are chosen that emit different wavelengths of light, such that the 'acceptor' molecule label may be differentiated from that of the 'donor'. Since the efficiency of energy transfer between the labels is related to the distance separating the molecules, the spatial relationship between the molecules can be assessed. In a situation in which binding occurs between the molecules, the fluorescent emission of the 'acceptor' molecule label should be maximal. A FRET binding event can be conveniently measured through standard fluorometric detection means well known in the art (e.g., using a fluorimeter).

Another example of a detection probe having self-complementarity is a "molecular beacon." Molecular beacons include nucleic acid molecules having a target complementary sequence, an affinity pair (or nucleic acid arms) holding the probe in a closed conformation in the absence of a target sequence present in an amplification reaction, and a label pair that interacts when the probe is in a closed conformation. Hybridization of the target sequence and the target complementary sequence separates the members of the affinity pair, thereby shifting the probe to an open conformation. The shift to the open conformation is detectable due to reduced interaction of the label pair, which may be, for example, a fluorophore and a quencher (e.g., DABCYL and EDANS). Molecular beacons are disclosed, for example, in U.S. Pat. Nos. 5,925,517 and 6,150,097, herein incorporated by reference in its entirety.

Other self-hybridizing probes are well known to those of ordinary skill in the art. By way of non-limiting example, probe binding pairs having interacting labels, such as those disclosed in U.S. Pat. No. 5,928,862 (herein incorporated by reference in its entirety) might be adapted for use in method of embodiments of the present disclosure. Probe systems used to detect single nucleotide polymorphisms (SNPs) might also be utilized in the present disclosure. Additional detection systems include "molecular switches," as disclosed in U.S. Publ. No. 20050042638, herein incorporated by reference in its entirety. Other probes, such as those comprising intercalating dyes and/or fluorochromes, are also useful for detection of amplification products methods of embodiments of the present disclosure. See, e.g., U.S. Pat. No. 5,814,447 (herein incorporated by reference in its entirety).

EXPERIMENTAL

The following examples are provided in order to demonstrate and further illustrate certain preferred embodiments and aspects of the present disclosure and are not to be construed as limiting the scope thereof.

Example 1

Microfluidic Well Plate Fabrication (0.008 in Width×0.008 in Depth Channel with 0.002 in Diameter Micro-Post Array)

Figure 8B:
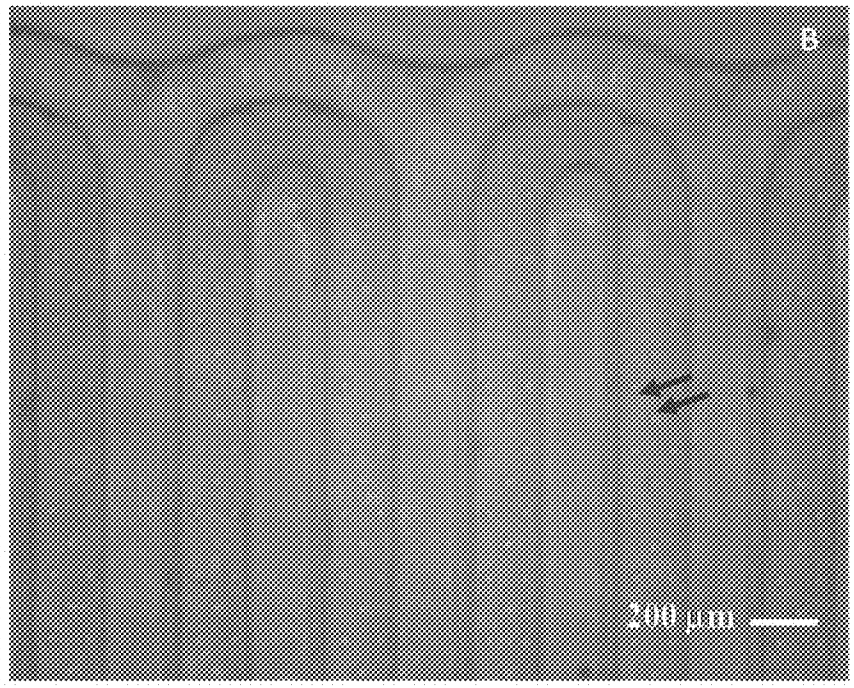
FIG. 8A-B shows microscope images of 3×3 well (0.008 in×0.008 in channel) (A) a microfluidic module, and (B) micro-post (arrows) array layout.
Figure 8A:
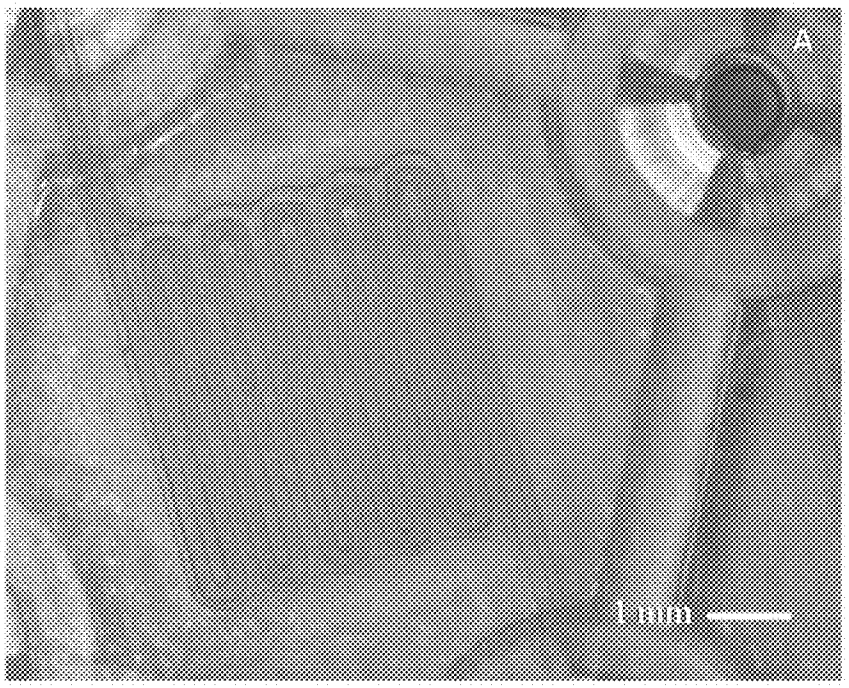

A 3×3 (3 rows with 3 columns) well lay-out of Part A (FIG. 7A) and Part B (FIG. 7B) of micro-post array embedded microfluidic multi-well plate were manufactured using polystyrene materials with injection mold. Alternatively, one-sided adhesive film with 9 die cut holes (FIG. 7C) was used as Part B for further experiments. FIGS. 8A and B exhibit over all layout of a microfluidic module 22 and micro-post array inside the channel of the Part A respectively.

Optical Performance Study: Variations of Optical Detections

Figure 13:
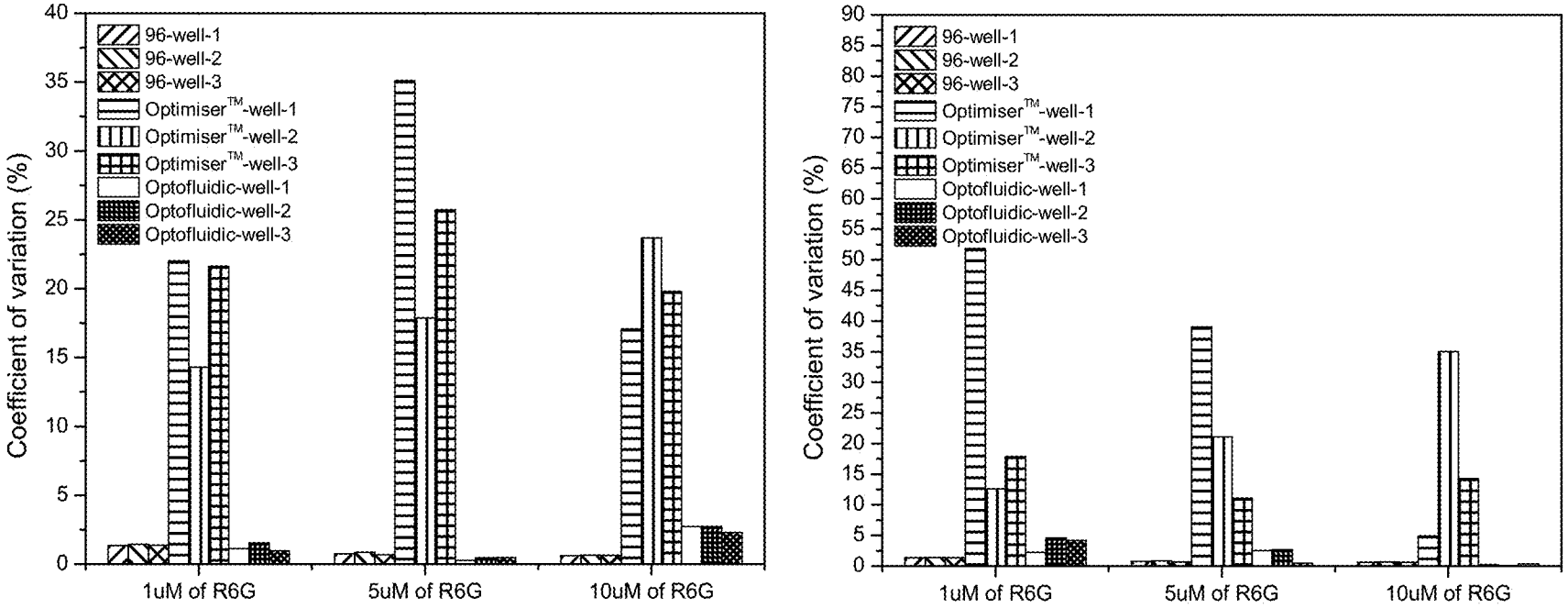
FIG. 13 shows a comparison of run-to-run variations of three different well plates; (1) a conventional 96-well plate, (2) an OPTIMISER™ well plate, and (3) a microfluidic well plate of embodiments of the present disclosure.
Figure 14:
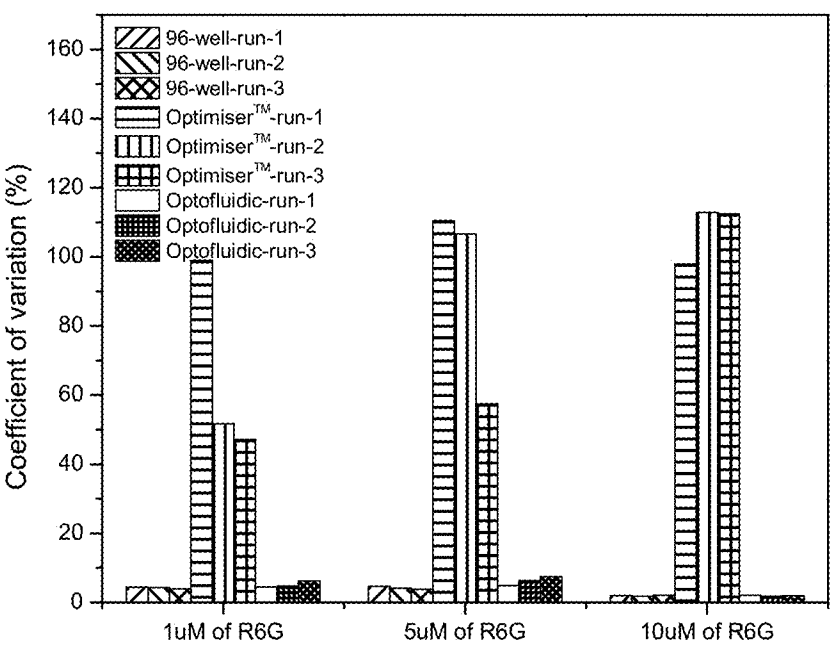
FIG. 14 shows a comparison of well-to-well variations of three different well plates; (1) a conventional 96-well plate, (2) an OPTIMISER™ well plate, and (3) a microfluidic well plate of embodiments of the present disclosure.
Figure 14:
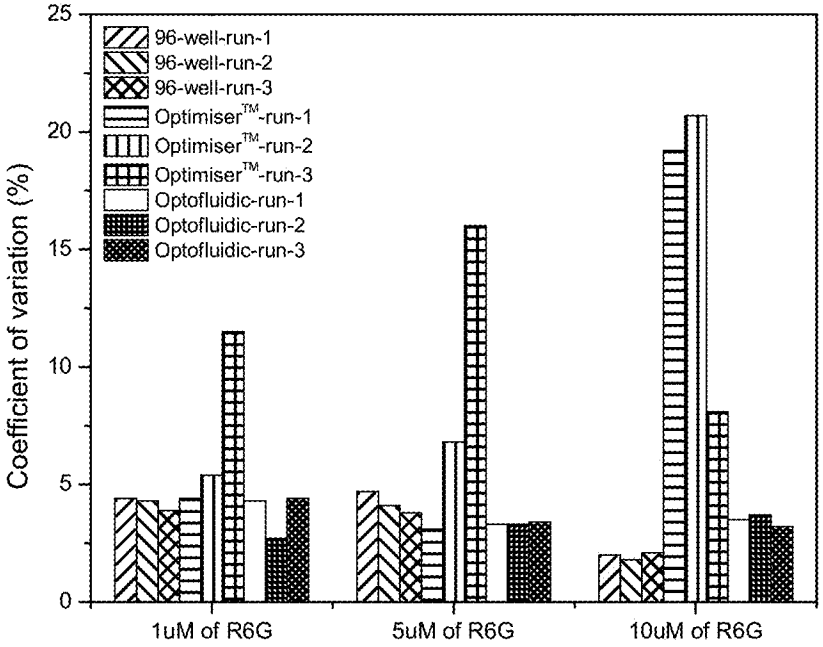

In order to evaluate optical signal detection variations, the microfluidic well plate of present disclosure performance against conventional 96-well and OPTIMISER™ well plates were compared (FIGS. 13 and 14).

ELISA Study

Various concentration of Human IL-6 dissolved in buffer solutions were tested with microfluidic well plates (FIG. 17). See more details in the ELISA protocol section.

Example 2

Microfluidic Well Plate Fabrication (0.018 in Width×0.022 in Depth Channel with 0.004 in Diameter Micro-Post Array)

Figure 9B:
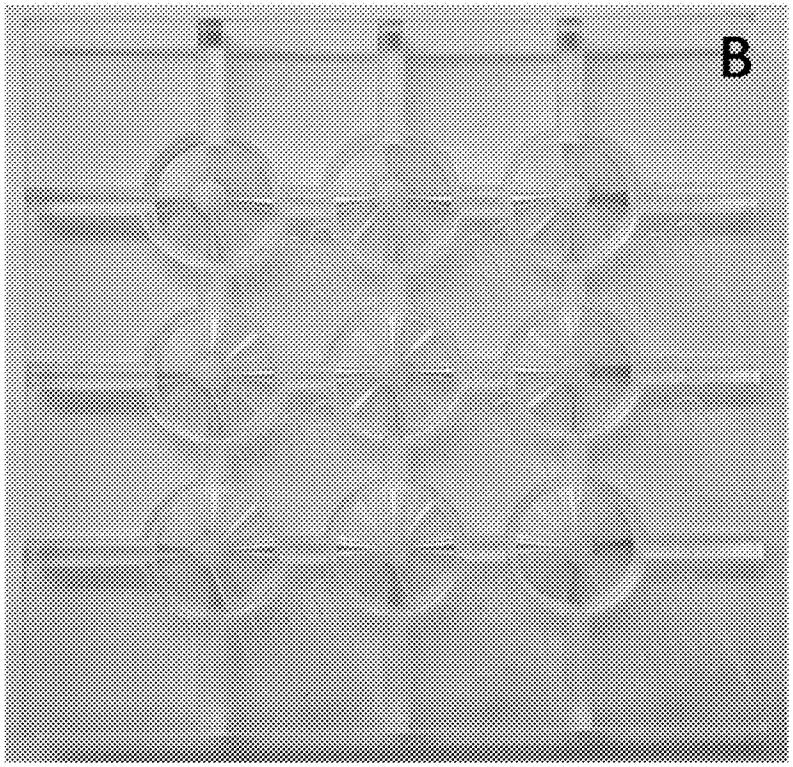
FIG. 9A-B shows photographs of manufactured Part A (0.018 in×0.022 in channel), (A) Front, and (B) Back views of clear and transparent microfluidic well plate.
Figure 9A:
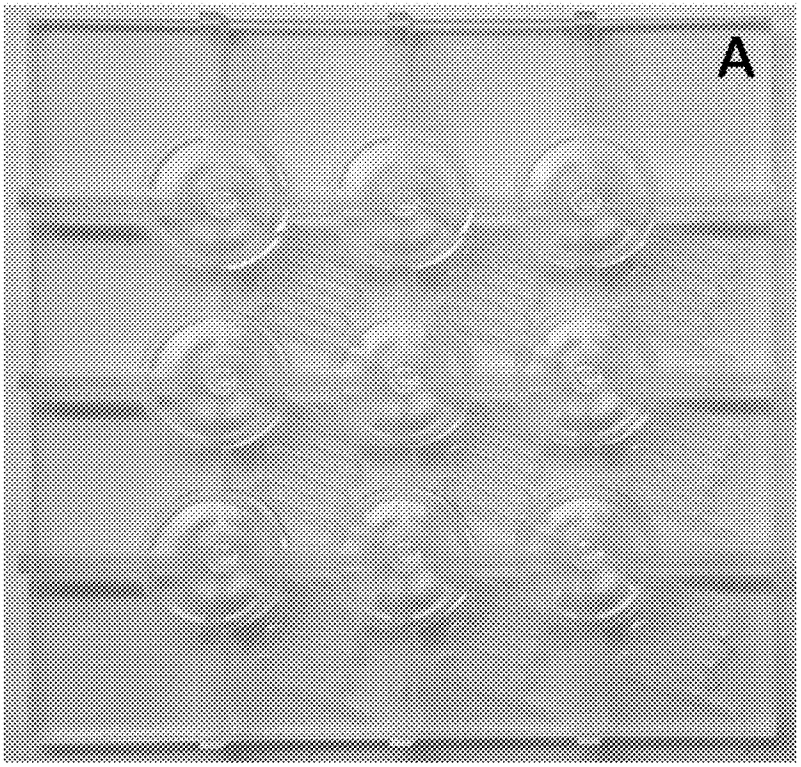
Figure 10B:
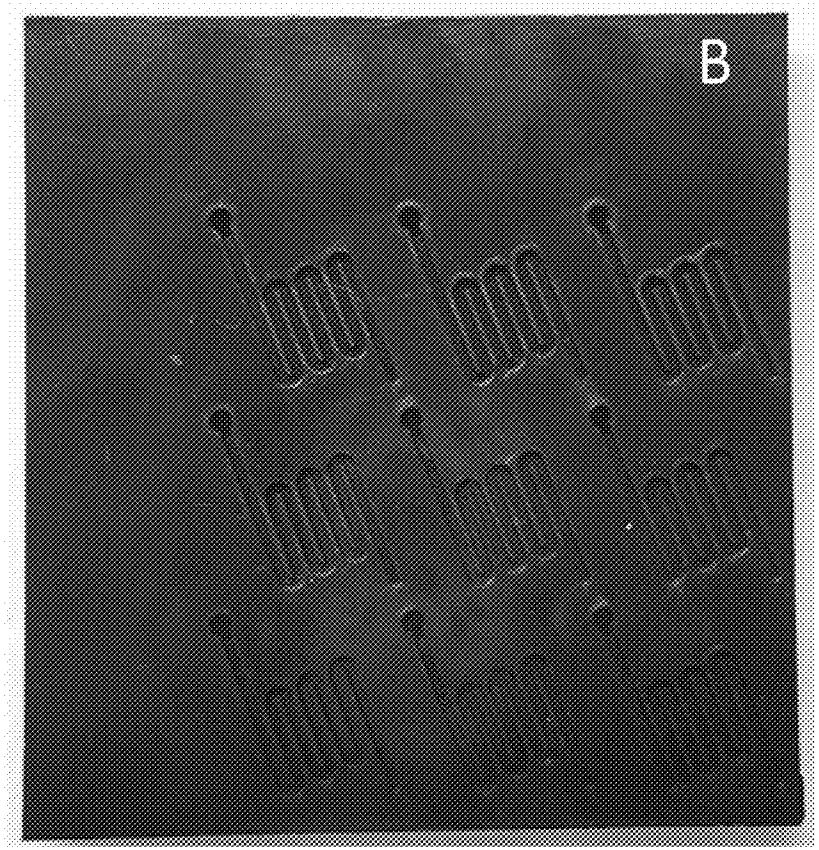
FIG. 10A-B shows photographs of manufactured Part A (0.018 in×0.022 in channel), (A) Front, and (B) Back views of black and opaque microfluidic well plate.
Figure 10A:
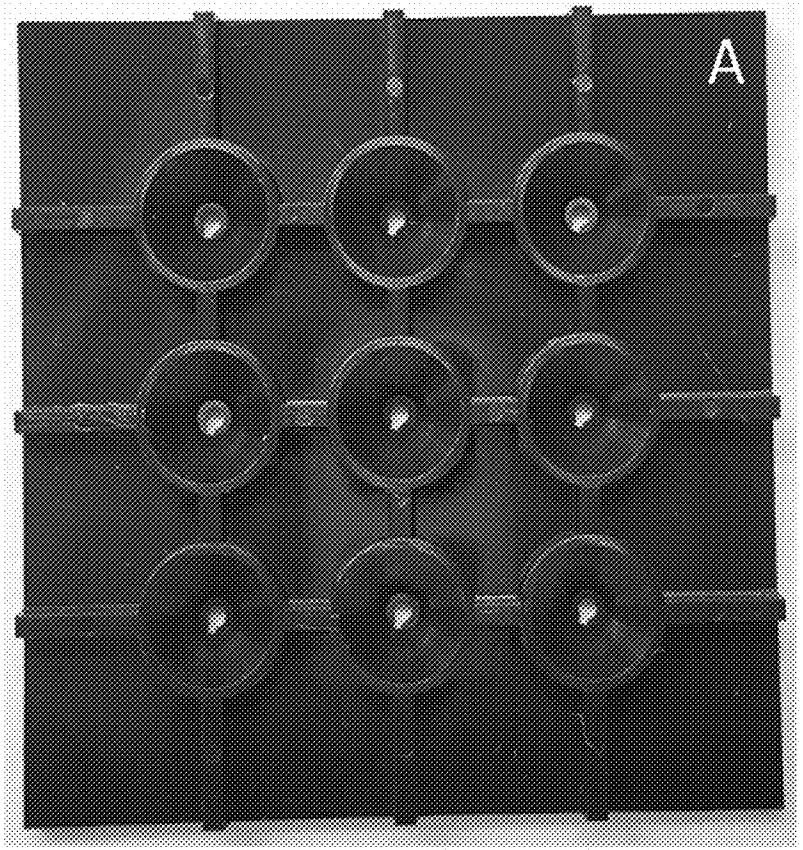
Figure 11:
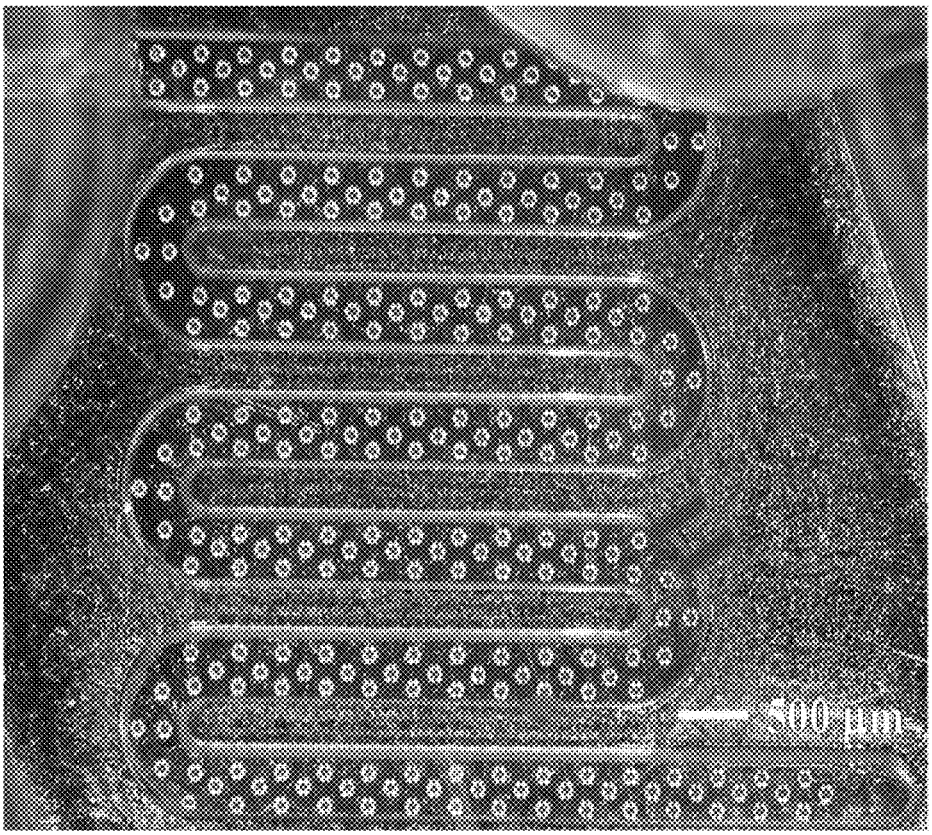
FIG. 11 shows microscope images of a microfluidic channel indicating micro-posts therein by way of arrow indicators.
Figure 12:
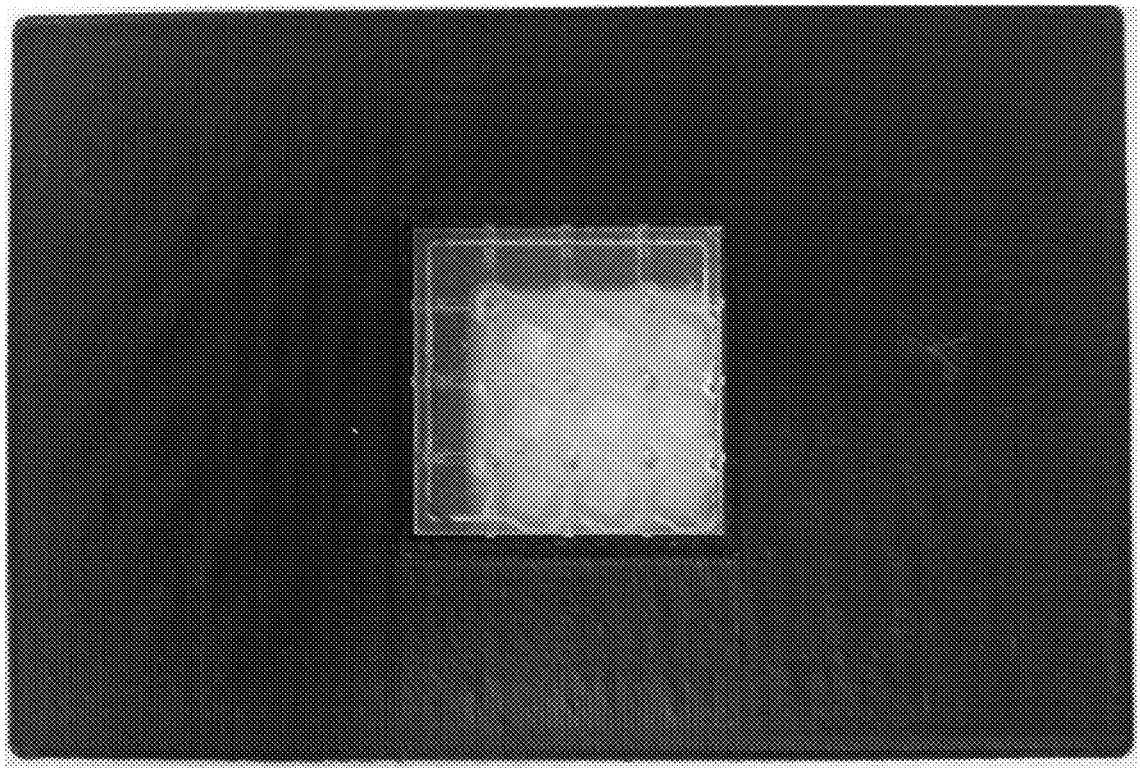
FIG. 12 shows a photograph of 3D printed well plate adapter (black).

A 3×3 (3 rows with 3 columns) well lay-out of Part A of micro-post array 54 embedded microfluidic multi-well plate was manufactured using polystyrene materials with injection mold (clear and transparent well plate as shown in front image of FIG. 9A and back image of FIG. 9B and black and opaque well plate as shown in front image of FIG. 10A and back image of FIG. 10B). One-sided adhesive film with 9 die cut holes (FIG. 7C) was used as Part B with these Part A of microfluidic well plates for further experiments. FIG. 11 exhibits micro-post array 54 inside the microfluidic channel 36 of the Part A. In order to fit Standard Multilabel Plate Reader with 3×3 well plate, 3D printed well plate adapter as shown in FIG. 12 was used.

Optical Performance Study: Dependent of Channel Size

In order to evaluate optical performance of the microfluidic well plate of the present disclosure, seven different microfluidic channel 36 sizes (FIG. 15) were studied using Rhodamine 6G (R6G) dissolved in methanol as described in the materials and methods section. In addition, optical cross talk characteristics of clear and transparent, and black and opaque polystyrene microfluidic well plates were analyzed (FIG. 16).

ELISA Study

Various concentration of Human IL-6 dissolved in buffer solutions as well as serum were tested with microfluidic well plates by two detection methods: 1. Fluorescence detection with clear and transparent well plate; and 2. Chemiluminescence detection with black and opaque well plate. See more details in the ELISA protocol section. Conventional 96-well plates were tested with the same Human IL-6 concentrations that were used in the microfluidic well plate, using conventional ELISA protocol of R&D Systems for benchmarking (FIG. 18-22).

Materials and Methods for Optical Performance Study

Rhodamine 6G (R6G) powder (Sigma-Aldrich #252433) was thoroughly dissolved in 99.8% methanol (Sigma-Aldrich #322415) to construct 1 mM concentration. Then, the solution was diluted sequentially to make desired concentrations. Those solutions were filled into desired amount into the wells or channels. 100 μL of R6G solution was used in conventional 96-well plate. Both 10 μL and 3 μL of R6G solution were used in OPTIMISER™ well plate, and the microfluidic well plate of this present disclosure.

Standard Multilabel Plate Reader (Perkin Elmer EnSpire® 2300) was used to acquire fluorescence intensity. Excitation wavelength of 480 nm with <8 nm bandwidth, emission wavelength of 550 nm with <8 nm bandwidth, and excitation flash intensity of 100 were used. Fluorescence intensity readings were taken from above the well plates. The height of measurement head which consists of excitation and emission channels, was adjusted to gain maximum sensitivity of each type of well plate. The heights of 3.8 mm, 11.1 mm, and 7.5 mm, were used in conventional 96-well, OPTIMISER™ well plate, and this present microfluidic well plate, respectively. Triplicate samples (3 wells) of each well plate were read three times (3 runs) and calculated coefficient of variations (CVs) of wells in each run and CVs of runs in each well.

For the channel size dependent of fluorescence intensity study, 0.5 μM of R6G solution was used with 7 different channel sizes; (1) 0.008 in wide×0.008 in depth, (2) 0.012 in wide×0.012 in depth, (3) 0.014 in wide×0.014 in depth, (4) 0.016 in wide×0.016 in depth, (5) 0.018 in wide×0.018 in depth, (6) 0.018 in wide×0.020 in depth, and (7) 0.018 in wide×0.022 in depth.

Materials and Method for Surface Modification of Microfluidic Well Plate

The microfluidic well plates were made of polystyrene, which has hydrophobic surface nature, making it impossible to flow reagents through the micron sized channels. Therefore, the well plates were pre-treated with the following surface modification method to form hydrophilic surfaces of channels.

1. Plates were washed with 99.8% methanol (Sigma-Aldrich #322415) in Ultrasonic Cleaner (GemOro Model: 10 QTH) for 15 min.
2. Plates were washed with milli-Q water in the Ultrasonic Cleaner for 5 min.
3. Plates were treated with 100 mL of 96% Sulfuric Acid (Sigma-Aldrich #7664-93-9) and 5 g of NOCHROMIX (Sigma #328693) mixture for 60 min.
4. Step "2" was repeated.
5. Plates were washed with 1 mg/mL of Sodium Hydroxide (Fisher Chemical CAS 1310-73-2) in the Ultrasonic Cleaner for 30 min.
6. Step "2" was repeated.
7. Plates were incubated with 0.2 mg/mL of Polyethyleneimine solution (Sigma-Aldrich #181978-5G) for 30 min.
8. Plates were washed with milli-Q water for 5 min.
9. Plates were incubated with 1% of Glutaraldehyde solution (Fisher Chemical CAS Registry Number1: 111-30-8, CAS Registry Number2: 7732-18-5) for 15 min.
10. Step "8" was repeated.
11. Plates were air dried.

The surface modification method of hydrophobic surface to hydrophilic surface alteration can be substituted with any other well-established techniques such as plasma and radiation methods.

Reagents Preparation and ELISA Protocol of Microfluidic Well Plate

Human IL-6 DuoSet ELISA Kit (DY206), ELISA Plate-coating buffer (DY006), wash buffer (WA126) and reagent diluent (DY995) were purchased from R&D Systems. The reagents were prepared according to the procedure described in the kits' user manuals. First, the stock wash buffer and reagent diluent were diluted with Milli-Q water to achieve 1× working solutions. Then, the capture antibody working solution of 12 μg/mL was prepared by diluting with PBS (R&D Systems # DY006). The detection antibody working solution of 0.4 μg/mL was prepared by diluting with the 1× Reagent Diluent. The Human IL-6 standard was diluted to a desired concentration by adding the 1× Reagent Diluent as buffer medium and serum. The horseradish peroxidase labeled streptavidin (SAv-HRP) working solutions was prepared just before application by diluting 1 μL of the SAv-HRP stock solution from DY206 kit with 40 μL of the 1× Reagent Diluent. The 1× Reagent Diluent (1% BSA in PBS) was used as a blocking solution.

QuantaRed™ Enhanced Chemifluorescent HRP Substrate Kit (Thermo Scientific #15159) was used at the last step of ELISA protocol to develop fluorescence. The working substrate solution for fluorescence detection was prepared just before application by mixing with 2 μl QuantaRed10-acetyl-3,7-dihydroxyphenoxazine (ADHP) concentrate, 100 μl enhancer solution, and 100 μl stable peroxide solution from the kit at room temperature. In the case of chemiluminescence detection, equal parts of the SuperSignal ELISA Femto Luminol/Enhancer and SuperSignal ELISA Femto Stable Peroxide from SuperSignal™ ELISA Femto Substrate kit were mixed at room temperature just before optical detection step. After preparation of the reagents, following procedure was used for IL-6 detection.

1. Plates were incubated with 10 μL of 12 μg/mL of capture antibody solution for 10 minutes for 0.008 in×0.008 in well plate (20 μL of 4 μg/mL of capture antibody solution for 60 minutes for 0.018 in×0.022 in well plate).
2. Plates were washed with 10 μL of 1× wash buffer for 5 minutes for 0.008 in×0.008 in well plate (20 μL of 1× wash buffer for 1 minute for 0.018 in×0.022 in well plate).
3. Plates were incubated with 10 μL of blocking buffer (1% BSA in PBS) for 10 minutes for 0.008 in×0.008 in well plate (20 μL of blocking buffer for 29 minutes for 0.018 in×0.022 in well plate).
4. Plates were filled with 10 μL of solution (1× Reagent Diluent or serum) containing the standard analyte, IL-6, and incubated for 10 minutes for 0.008 in×0.008 in well plate (20 μL of the standard analyte, IL-6, and incubated for 15 minutes for 0.018 in×0.022 in well plate).
5. Plates were washed with 10 μL of 1× wash buffer for 5 minutes for 0.008 in×0.008 in well plate (20 μL of 1× wash buffer for 1 minute for 0.018 in×0.022 in well plate).
6. Plates were incubated with 10 μL of 0.4 μg/mL of detection antibody solution for 5 minutes for 0.008 in×0.008 in well plate (20 μL of 0.1 μg/mL of detection antibody solution for 15 minutes for 0.018 in×0.022 in well plate).
7. Plates were washed with 10 μL of 1× wash buffer for 5 minutes for 0.008 in×0.008 in well plate (20 μL of 1× wash buffer for 1 minute for 0.018 in×0.022 in well plate).
8. Plates were filled with 10 μL of 1× SAv-HRP solution and incubated for 5 minutes for 0.008 in×0.008 in well plate (10 μL of 1.5×SAv-HRP solution for 5 minutes for 0.018 in×0.022 in well plate).
9. Plates were washed with 10 μL of 1× wash buffer for 5 minutes for 0.008 in×0.008 in well plate (30 μL of 1× wash buffer for 1 minute for 0.018 in×0.022 in well plate).
10. Step 9 was repeated.
11. For fluorescence detection, plates were filled with 3 μL of working substrate solution of QuantaRed™ and the solution was kept still in clear and transparent 0.008 in×0.008 in well plate (8 μL of working substrate solution of QuantaRed™ and the solution was kept still in clear and transparent 0.018 in×0.022 in well plate).
12. Five minutes after Step 10, fluorescence signal was acquired using Standard Multilabel Plate Reader (Perkin Elmer EnSpire® 2300). The reader was set at excitation wavelength of 550 nm with <8 nm bandwidth, emission wavelength of 605 nm with <8 nm bandwidth, and excitation flash intensity of 100. Fluorescence intensity readings were taken from above the well plates. The height of measurement head which consists of excitation and emission channels was adjusted at 11.1 mm to gain maximum sensitivity of the well plate.

In the case of chemiluminescence detection, above steps 11 and 12 are substituted with the following steps 11(A) and 12(A).

11(A). Plates were filled with 8 μL of working substrate solution of SuperSignal™ ELISA Femto and the solution was kept still in black and opaque 0.018 in×0.022 in well plate.

12(B). One minute after Step 10, chemiluminescence signal was acquired using Standard Multilabel Plate Reader (Perkin Elmer EnSpire® 2300). Chemiluminescence intensity readings were taken from below of the well plates.

Note: All measurements reported in this disclosure were performed at room temperature and the solutions were withdrawn using capillary forces.

Calculation of Results

Data were plotted and calculated mean value, standard deviation, coefficient of variations (CVs), and statistical p-value from triplicate samples (3 wells) of each IL-6 concentration. A four parameter logic (4-PL) was used as a curve fitting. Margin errors at different confidence levels of each concentration were calculated based on number of measurements, degrees of freedom of the data set, values of Student's t, and measured standard deviation. Confidence level (%) was classified by comparing the margin errors with mean differences between blank (0 pg/mL of IL-6) and each concentration.

Results and Conclusions: Optical Performance

To evaluate optical detection accuracy, fluorescence dye Rhodamine 6G (R6G) solution was used as a model analyte. FIG. 13 exhibits run-to-run variations of 3 wells each from three different well types, (1) conventional 96-well plate, (2) OPTIMISER™ well plate, and (3) microfluidic well plate (referred to as "Optofluidic-well-1, -2, and -3" in FIG. 13) of embodiments of the present disclosure. (The phrase "run-to-run" means that the same well in a plate was read by the plate reader and taken out, and then pushed in and read by the reader again. For each well, the above procedures were repeated 3 times.) Coefficient of variations (CVs) of conventional 96-well plate and microfluidic well plate are similar and less than 5% whereas CVs of OPTIMISER™ well plate are from ~15 to 35% in 3 μL of R6G (FIG. 13A) and ~15 to 50% in 10 μL of R6G (FIG. 13B). Indeed, run-to-run fluoresce reading of a well should not have any variations other than plate reader system variations. Therefore, CVs of 96-well plate are from the reader variations. Consequently, it was concluded that the microfluidic well plate of embodiments of the present disclosure does not introduce any additional variations since CVs of both 96-well and microfluidic plates are similar. On the other hand, it was found that CVs of OPTIMISER™ well plates are 3 to 10 times higher than that of the other two well plates. Thus, the source of the additional CVs is from the plate itself. Furthermore, the usage of 10 μL of R6G introduced more variations than the usage of 3 μL of R6G in the case of OPTIMISER™ well plate, which may be due to more R6G residual in the inlet which locates in the optical excitation and detection path. The design of the plates of embodiment of the present disclosure substantially eliminates this problem.

FIG. 14 exhibits well to well variations of 3 runs each from the three different well types. Maximum CVs of conventional 96-well plate and microfluidic well plate (referred to as "Optofluidic-run-1, -2, and -3" in FIG. 14) are ~5%. Maximum CVs of OPTIMISER™ well plate are ~20% in 3 μL of R6G (FIG. 14A) and ~100% in 10 μL of R6G (FIG. 14B). Again, more variations in the usage of 10 μL of R6G in the case of OPTIMISER™ well plate is due to more R6G residual in the inlet than the usage of 3 μL of R6G. Moreover, asymmetric channel size with spiral structure of OPTIMISER™ well plate needs precise detection position for signal consistency. In contrast, with symmetric channel size with linear U-turn feature of microfluidic channels 36 in the microfluidic well plate of embodiments of the present disclosure accepts large tolerance of optical detection position without signal variation, as explained more fully below.

Figure 15:
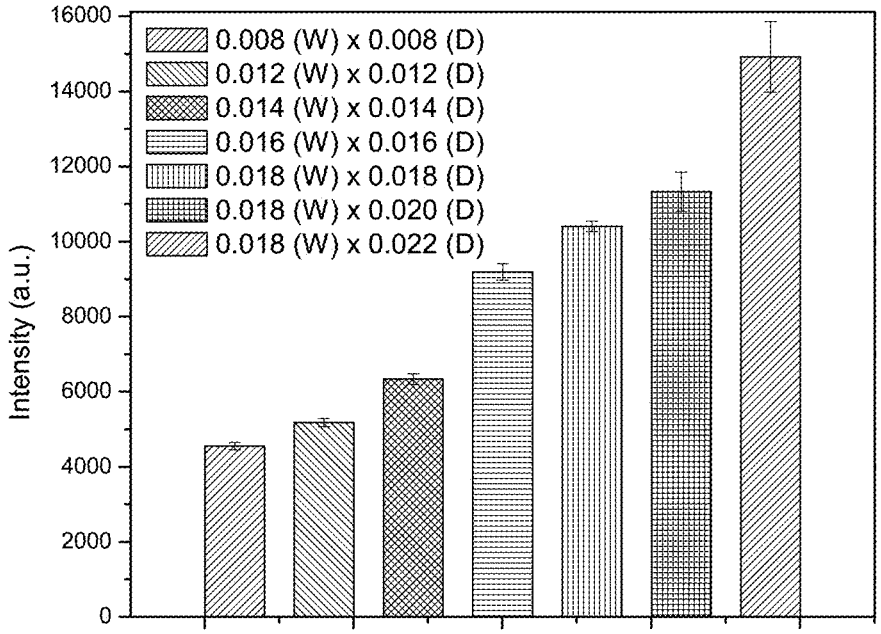
FIG. 15 shows a comparison of fluorescence intensities of 0.5 μM Rhodamine 6G with different channels sizes.

FIG. 15 exhibits fluorescence intensity of the same concentration (0.5 μM) of Rhodamine 6G (R6G) with 7 different sizes of microfluidic channels 36. The fluorescence intensity increases with bigger microfluidic channel 36 sizes due to higher optical detection depths. The 0.018 in×0.022 in channel generated over three times higher intensity than that of the 0.008 in×0.008 in channel.

Figure 16A:
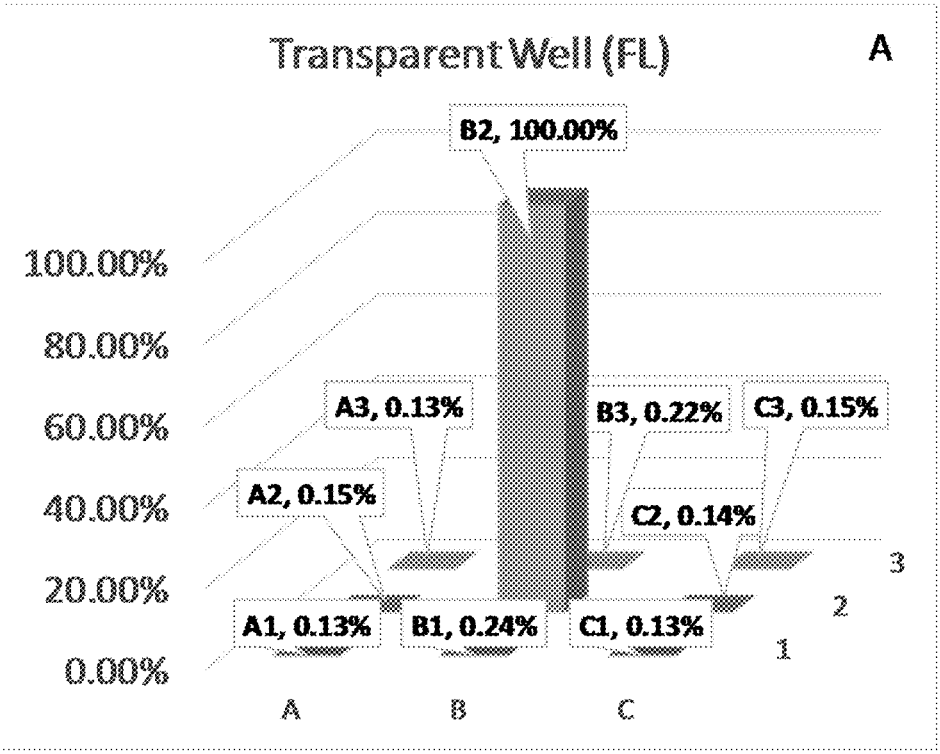
FIG. 16A-C shows a cross talk analysis of (A) fluorescence using a clear and transparent well plate, (B) chemiluminescence using a clear and transparent well plate, and (C) chemiluminescence using a black and opaque well plate.
Figure 16B:
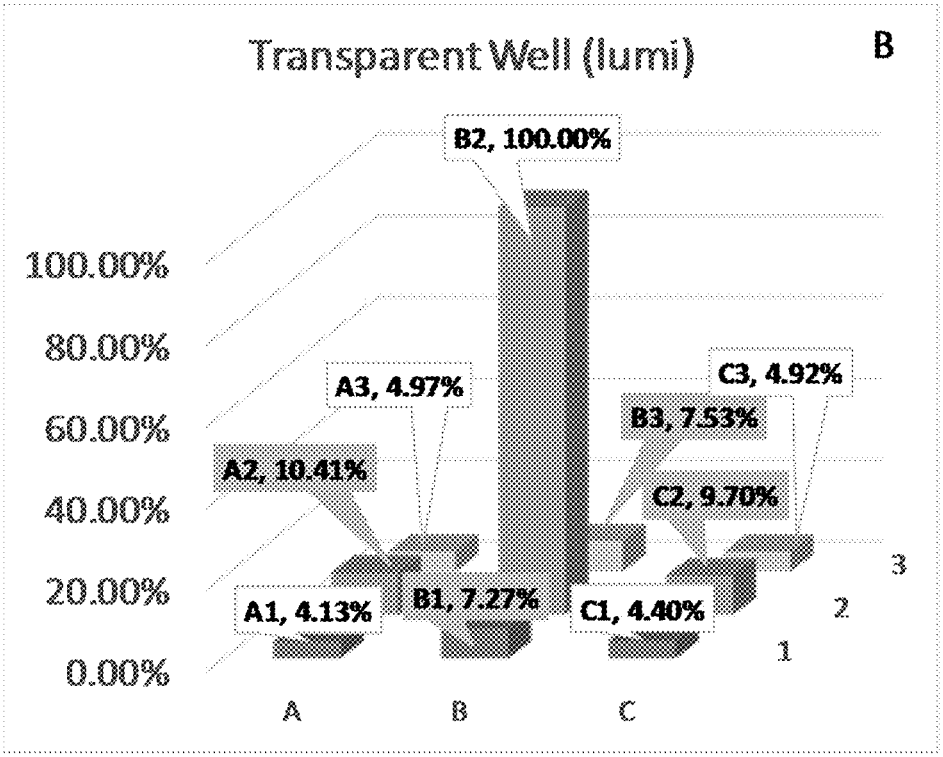
Figure 16C:
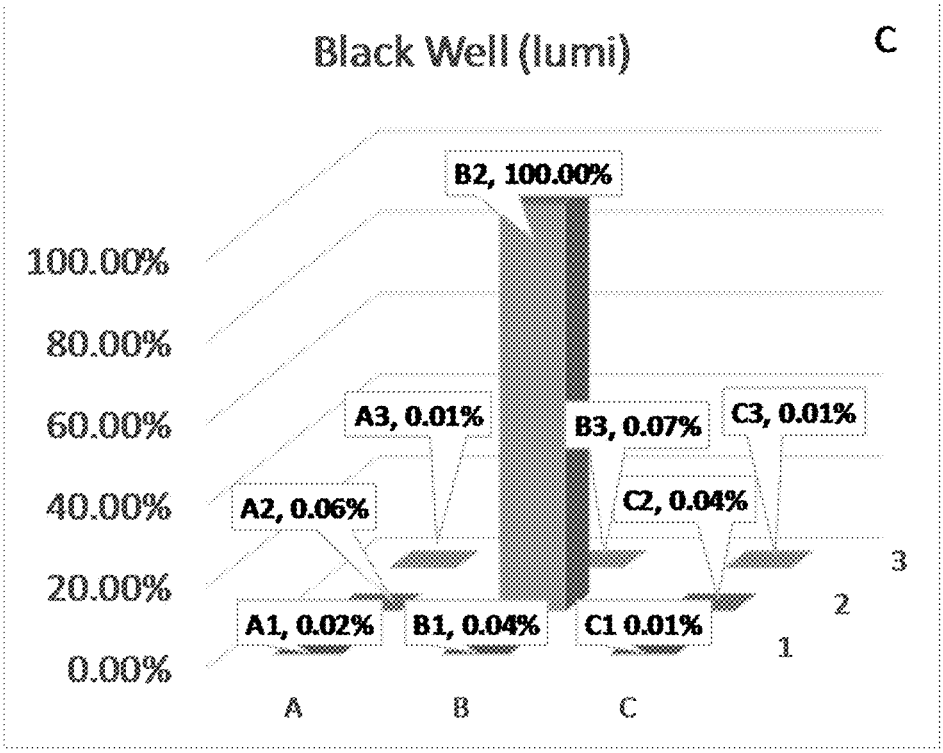

As shown in FIG. 16A, no cross talk (less than 0.25% in all wells) was observed in fluorescence detection using clear and transparent microfluidic well plate. However, significant cross talk (about 10% cross talk in adjacent wells) were observed in chemiluminescence detection using the same transparent well plate (FIG. 16B). In contrast, no cross talk (less than 0.08% in all wells) was found in the case of chemiluminescence detection with a black and opaque microfluidic well plate (FIG. 16C).

Results and Conclusions: ELISA

Surface modification is an important step before ELISA to alter hydrophobic to hydrophilic surfaces of channels, which allows flow of reagents. Immobilization of capture antibody and blocking of the microfluidic well plate takes 25 minutes for 0.008 in×0.008 in channel (90 minutes for 0.018 in×0.022 in channel) whereas a conventional 96-well plate takes over night. The total assay time of the microfluidic well plate is 45 minutes or less including substrate incubation, whereas a conventional 96-well plate takes about 300 minutes as per user manual from the # DY006 kit. The plate described herein is over 6 times faster than a conventional well plate. Furthermore, the microfluidic well plate needs only 10 μL of analyte sample, which is 10 times less than that used in traditional ELISA. In addition, the microfluidic well plate consumes less reagents (capture antibody, detection antibody, SAv-HRP, and QuantaRed™) than conventional well plate as shown in Table 1.

TABLE 1

Comparison of IL-6 ELISA using Microfluidic (0.008 in × 0.008 in channel and 0.018 in × 0.022 in channel) and conventional 96-well plates

| | Microfluidic well plate | | |
|---|---|---|---|
| | 0.008 in (W) × 0.008 in (D) | 0.018 in (W) × 0.022 in (D) | Conventional 96-well plate |
| Plate preparation time (coating of capture antibody and blocking) | 25 minutes | 90 minutes | Over night |
| ELISA assay time | 45 minutes | <45 minutes | 300 minutes |
| Analyte sample volume | 10 μL | 20 μL | 100 μL |
| Capture antibody | 0.12 μg (un-optimized) | 0.08 μg (un-optimized) | 0.2 μg |
| Detection antibody | 0.004 μg (un-optimized) | 0.002 μg (un-optimized) | 0.005 μg |
| SAv-HRP | 10 μL | 10 μL | 100 μL |
| Substrate (QuantaRed ™ for fluorescence detection and SuperSignal ™ for chemiluminescence detection) | 3 μL | 8 μL | 100 μL |

Figure 17A:
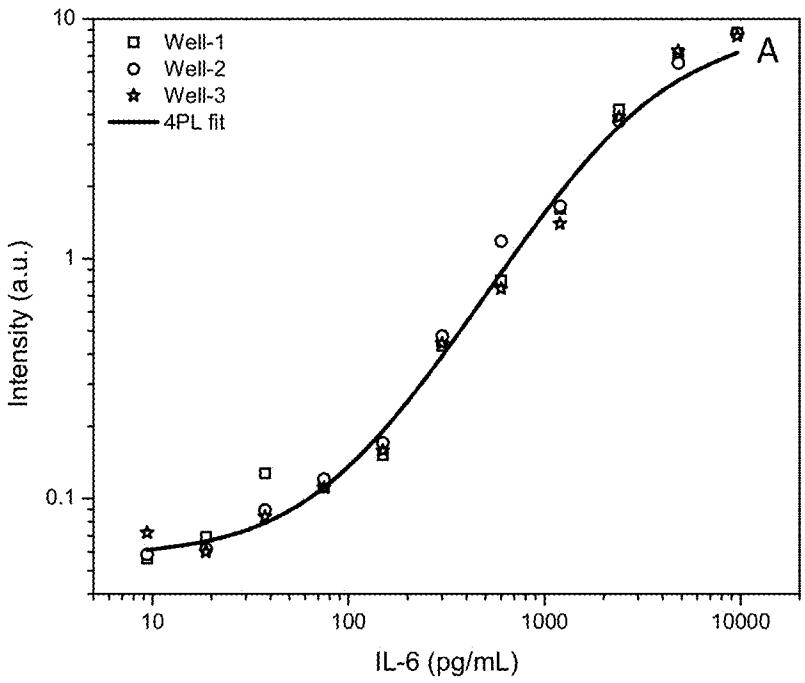
FIG. 17A-D shows a standard curve of IL-6 in buffer using fluorescence detection method and statistical analysis of clear and transparent microfluidic well plate (0.008 in×0.008 in channel) of embodiments of the present disclosure; (A) three data point from each concentration with four parameter logic (4-PL) curve fit, (B) average values with standard deviations of three wells, (C) coefficient of variation, and (D) p value of each IL-6 concentration.
Figure 17B:
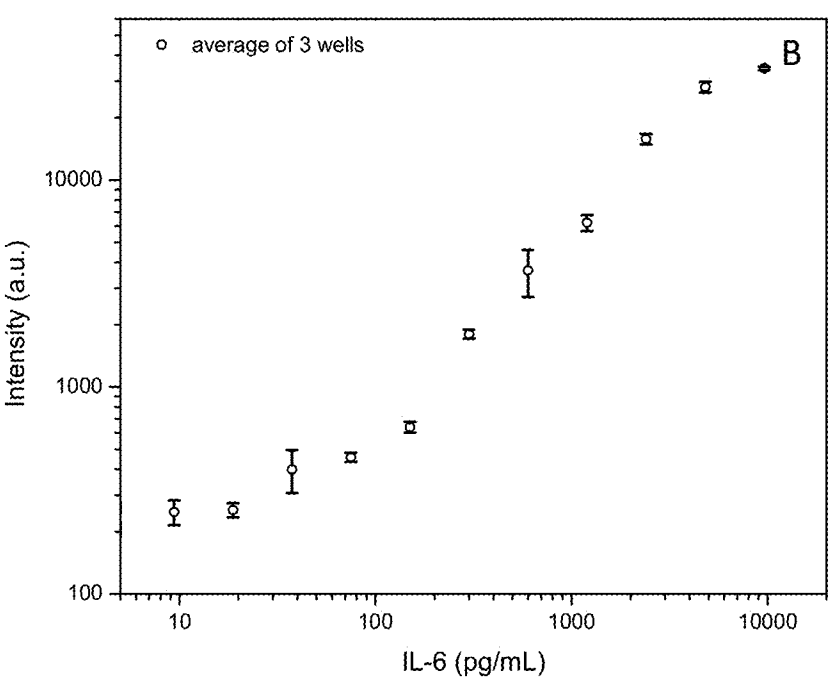
Figure 17D:
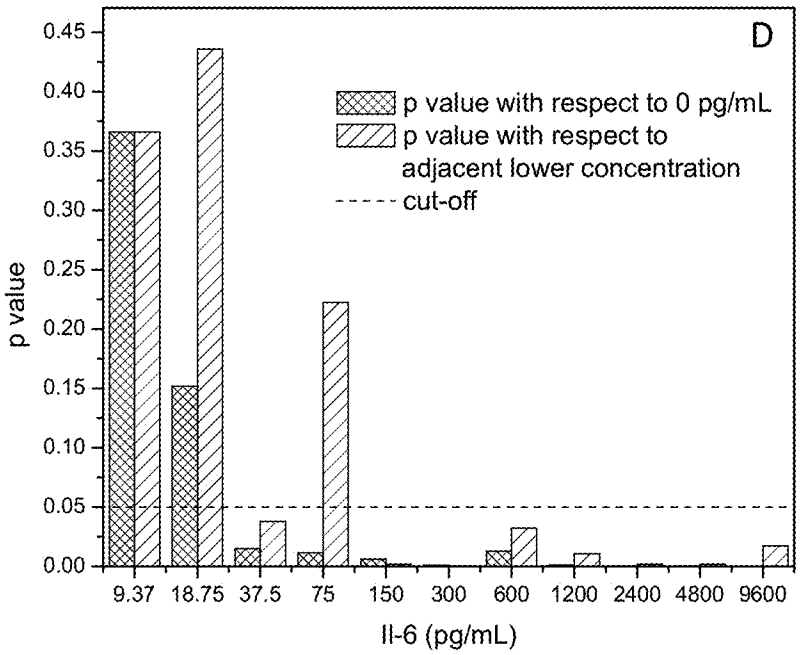
Figure 17C:
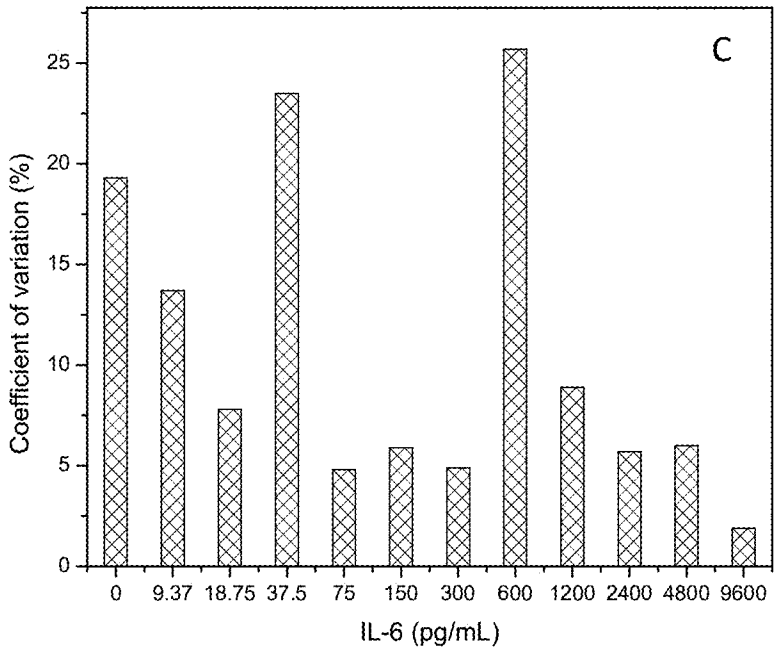
Figure 18B:
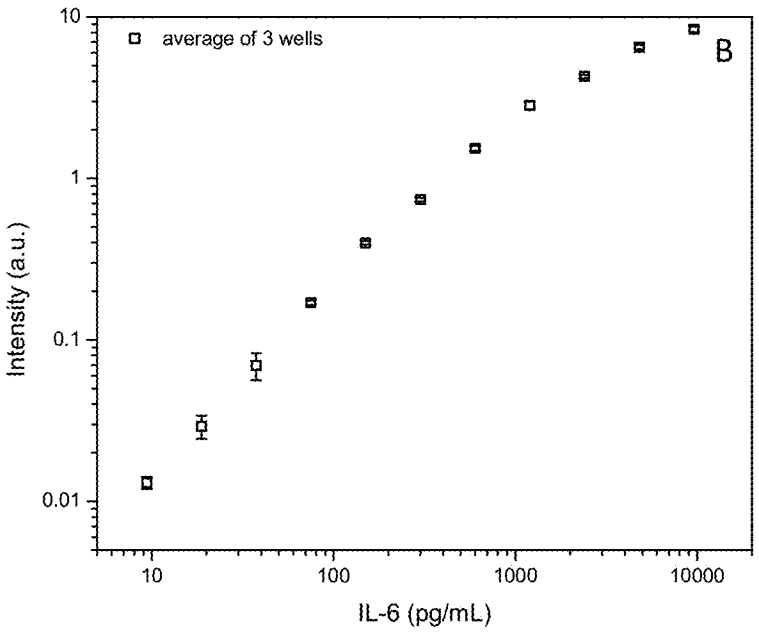
FIG. 18A-D shows a standard curve of IL-6 in buffer using fluorescence detection method and statistical analysis of clear and transparent microfluidic well plate (0.018 in×0.022 in channel) of embodiments of the present disclosure; (A) three data point from each concentration with four parameter logic (4-PL) curve fit, (B) average values with standard deviations of three wells, (C) coefficient of variation, and (D) p value of each IL-6 concentration.
Figure 18A:
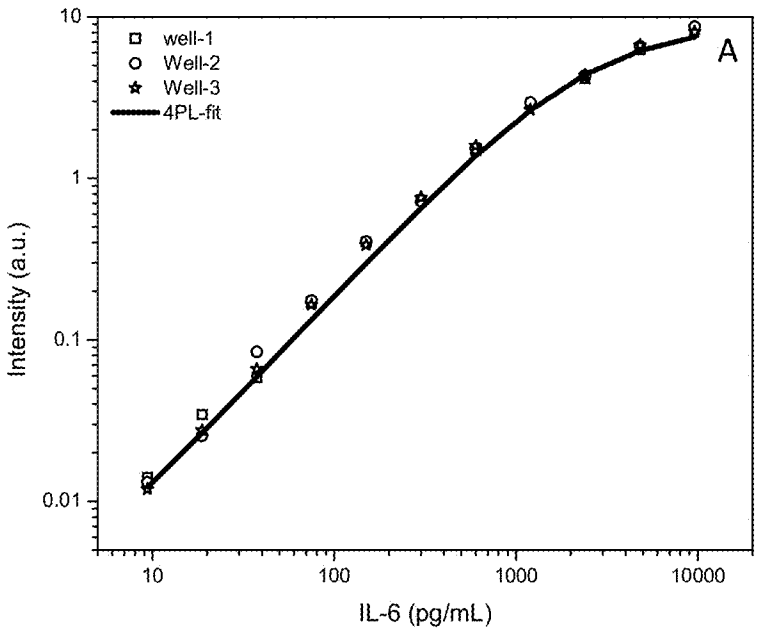
Figure 18D:
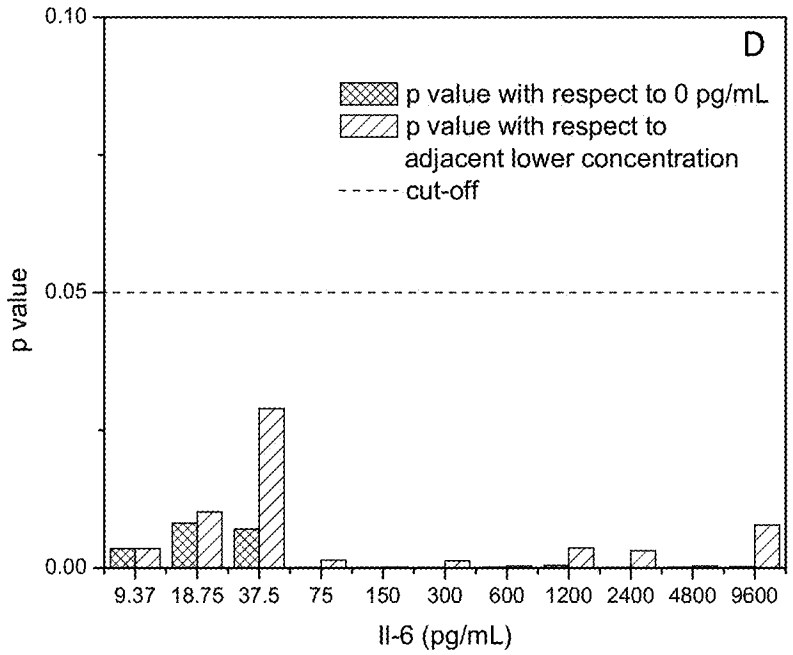
Figure 18C:
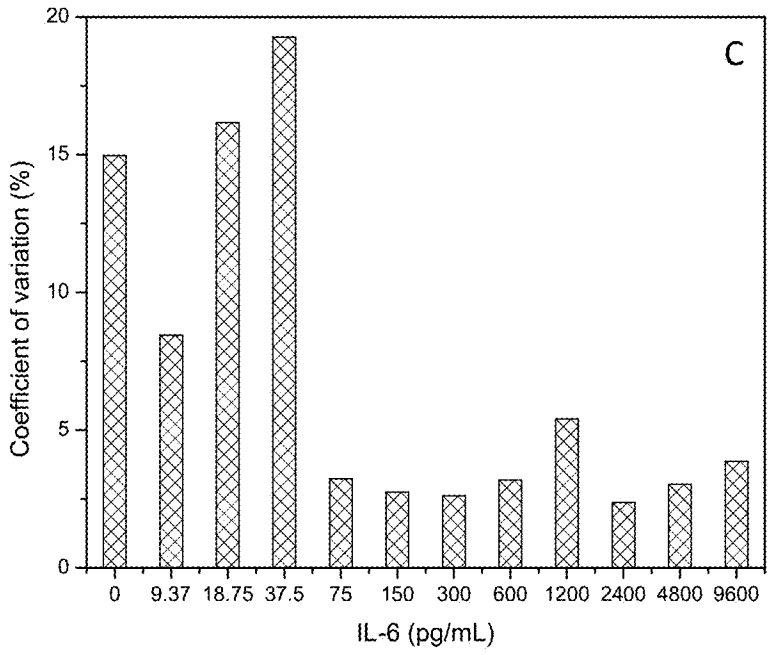
Figure 19A:
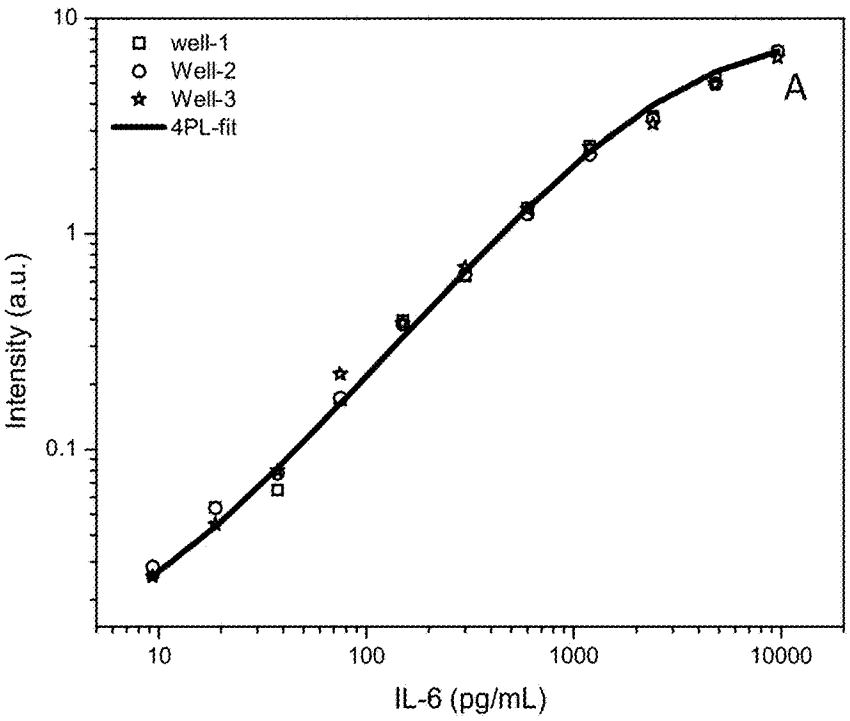
FIG. 19A-D shows a standard curve of IL-6 in serum using fluorescence detection method and statistical analysis of clear and transparent microfluidic well plate (0.018 in×0.022 in channel) of embodiments of the present disclosure; (A) three data point from each concentration with four parameter logic (4-PL) curve fit, (B) average values with standard deviations of three wells, (C) coefficient of variation, and (D) p value of each IL-6 concentration.
Figure 19B:
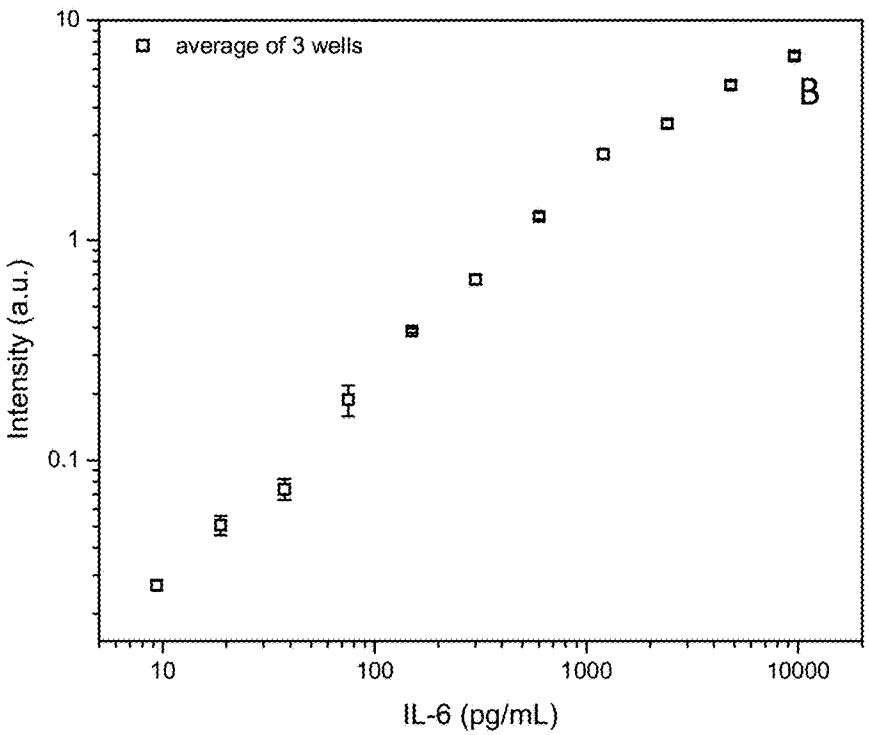
Figure 19C:
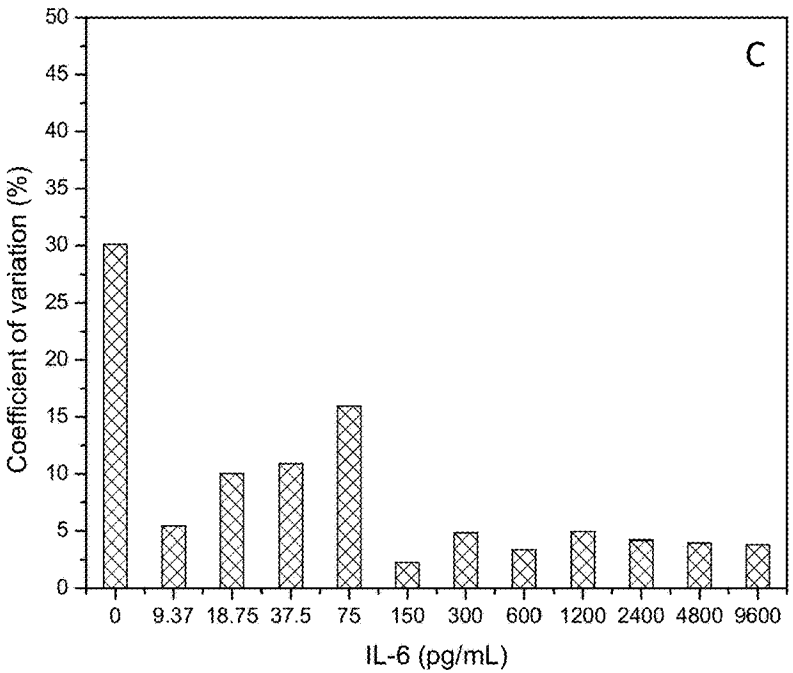
Figure 19D:
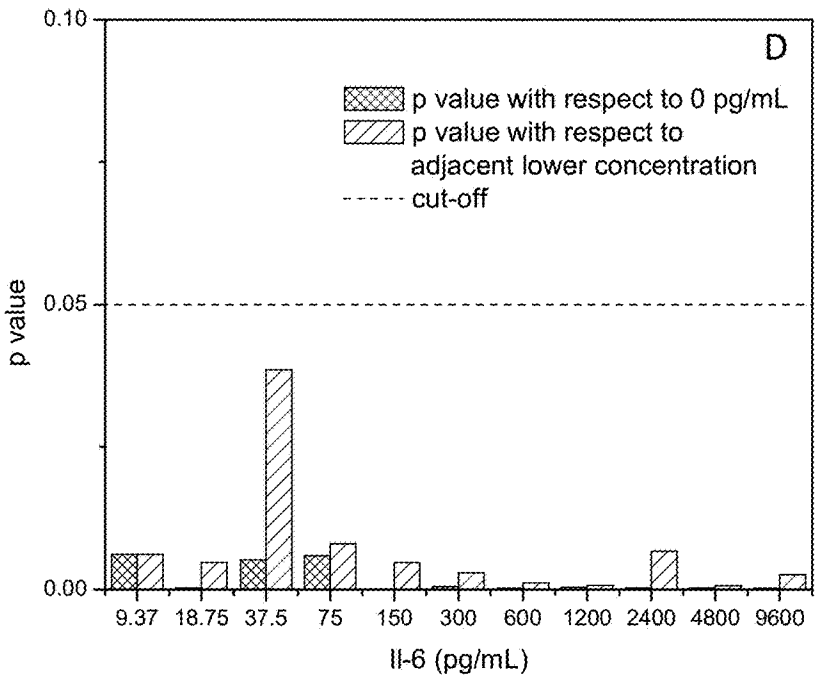

The experimental results of IL-6 in log-log scale fit very well with four parameter logic (4-PL) simulated curve. A linear projection was observed between 75 pg/mL and 2400 pg/mL in the log-log scale in both three points plot FIG. 17A and average plot FIG. 17B of 0.008 in×0.008 in channel microfluidic well plates. In FIG. 17C, all coefficient of variations except 0, 37.5, and 600 pg/mL are less than 10%. Only two p values respect to blank (0 pg/mL) of 9.37 pg/mL and 18.75 pg/mL are above cut-off p value (0.05) as shown in FIG. 17D. Thus, those two concentrations are unable to distinguish statistically with the blank. Three p values respect to adjacent lower concentration of 9.37 pg/mL, 18.75 pg/mL, and 75 pg/mL are above cut-off p value. That indicates that these concentrations are unable to distinguish statistically with adjacent lower concentrations (FIG. 17D). Confidence levels of above 95% are found 37.5 pg/mL and above concentrations (Table 2). In summary, a detection limit of 37.5 pg/mL and a detection range between 37.5 pg/mL and 9600 pg/mL were achieved in this IL-6 ELISA with the microfluidic well plate with 0.008 in×0.008 in channel.

Figure 20B:
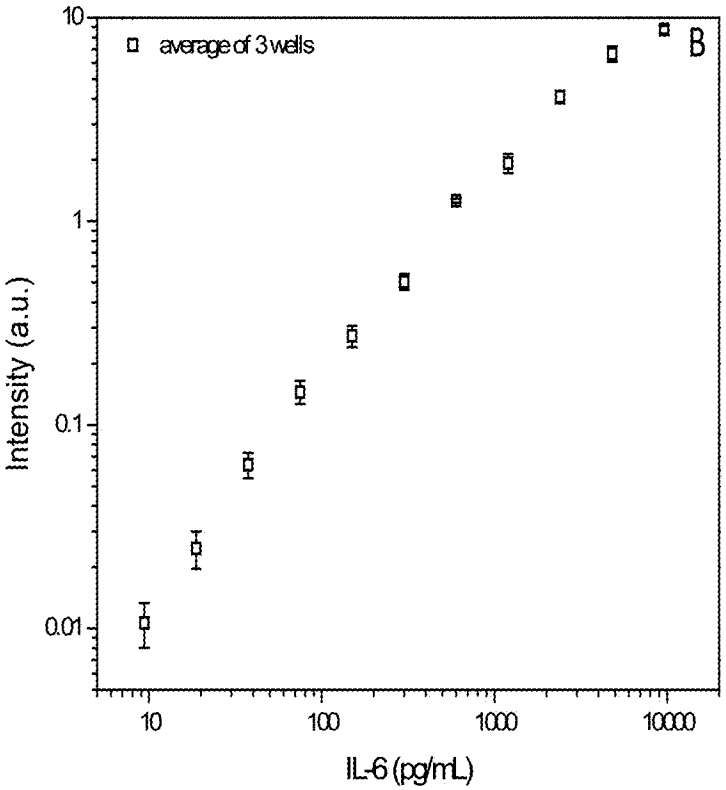
FIG. 20A-D shows a standard curve of IL-6 in buffer using chemiluminescence detection method and statistical analysis of black and opaque microfluidic well plate (0.018 in×0.022 in channel) of embodiments of the present disclosure; (A) three data point from each concentration with four parameter logic (4-PL) curve fit, (B) average values with standard deviations of three wells, (C) coefficient of variation, and (D) p value of each IL-6 concentration.
Figure 20A:
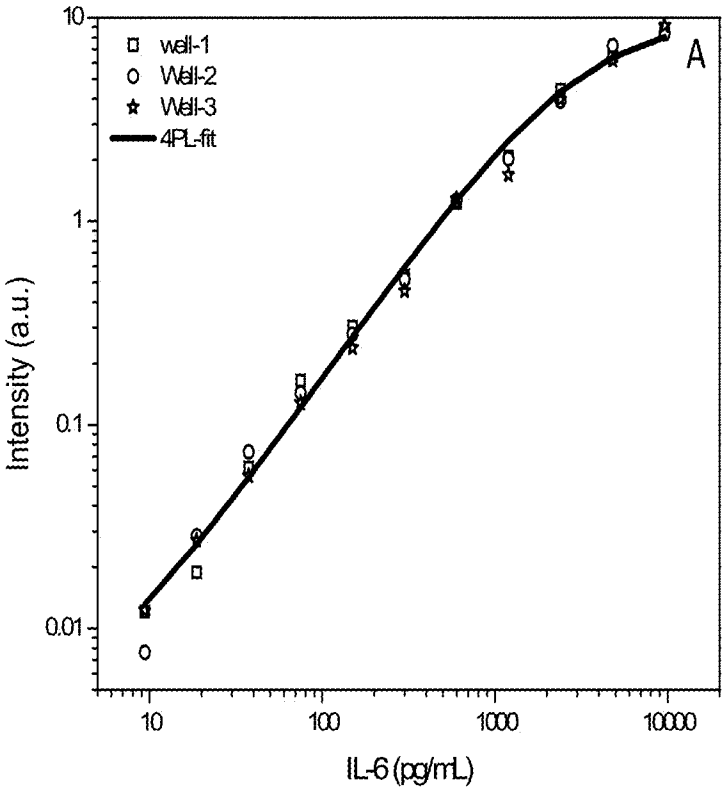
Figure 20C:
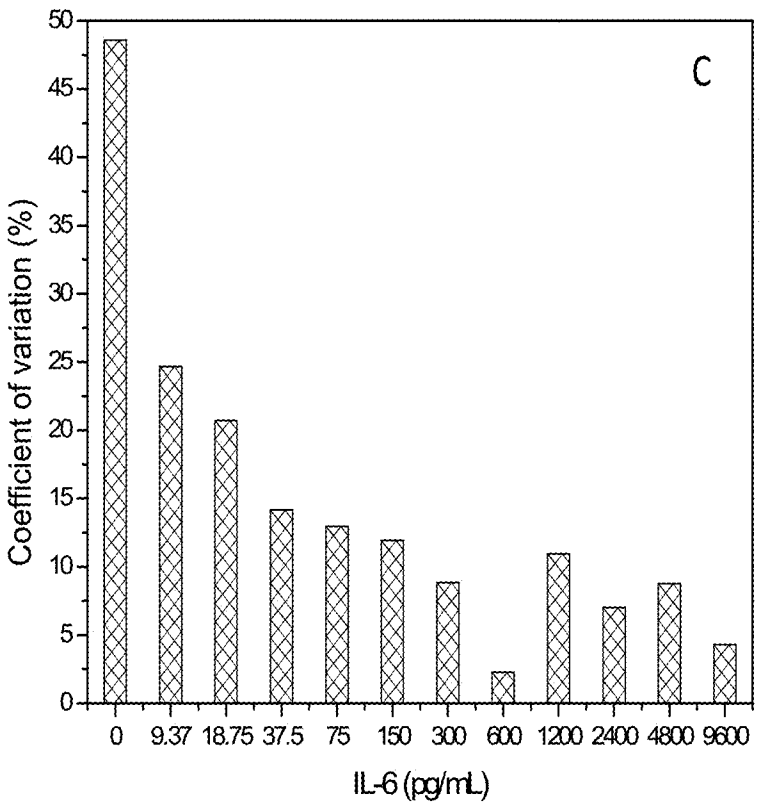
Figure 20D:
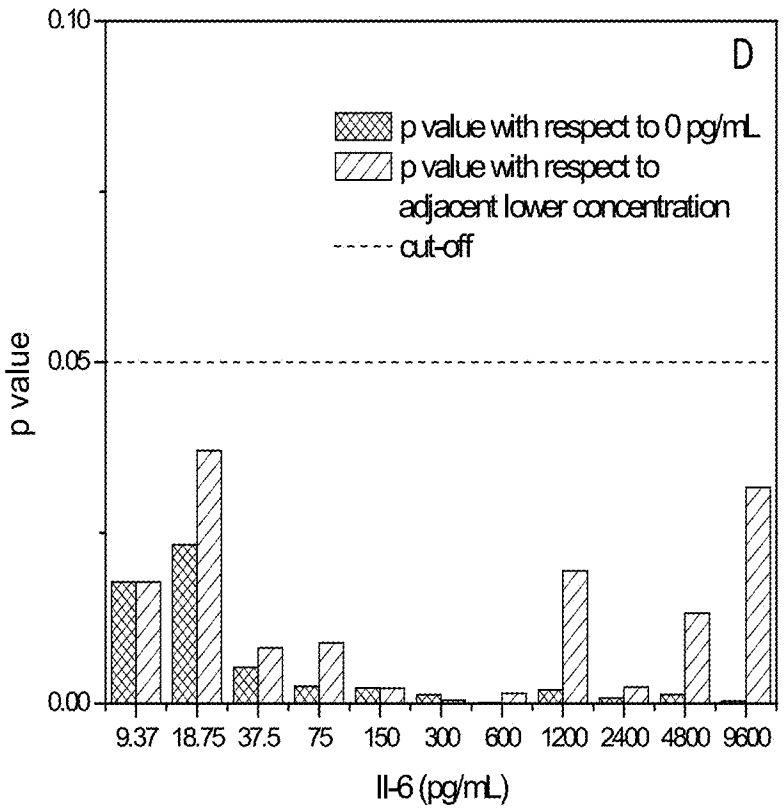
Figure 21A:
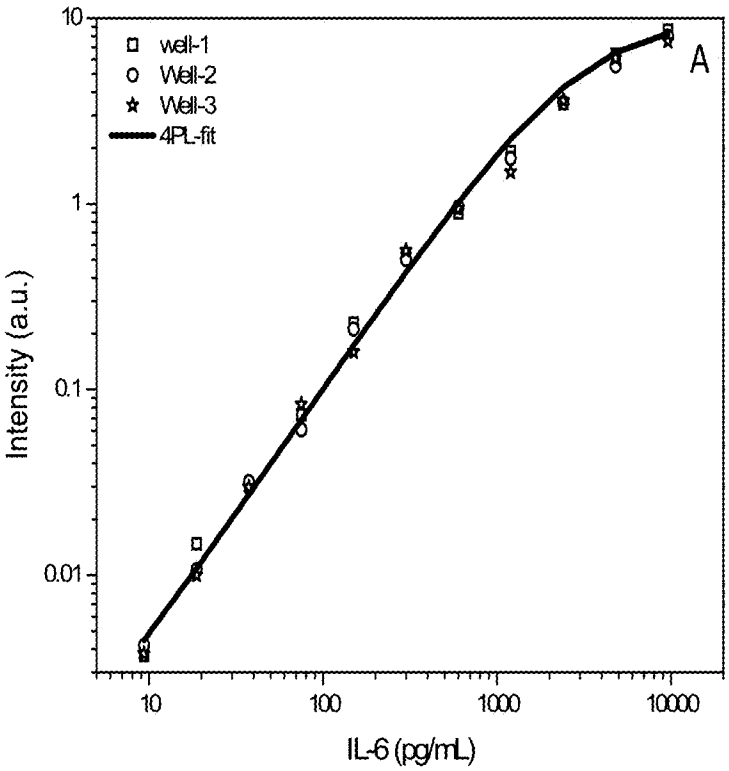
FIG. 21A-D shows a standard curve of IL-6 in serum using chemiluminescence detection method and statistical analysis of black and opaque microfluidic well plate (0.018 in×0.022 in channel) of embodiments of the present disclosure; (A) three data point from each concentration with four parameter logic (4-PL) curve fit, (B) average values with standard deviations of three wells, (C) coefficient of variation, and (D) p value of each IL-6 concentration.
Figure 21B:
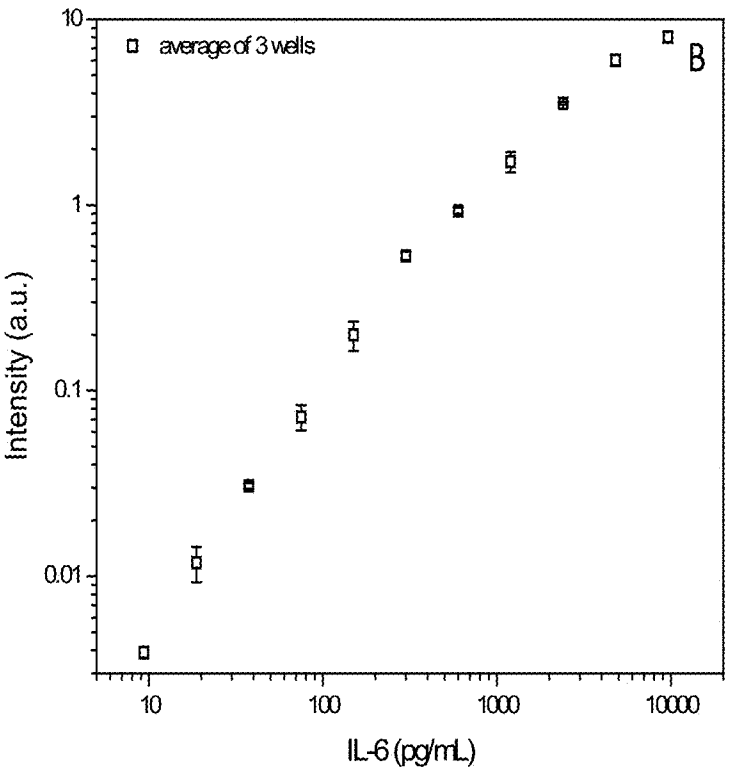
Figure 21D:
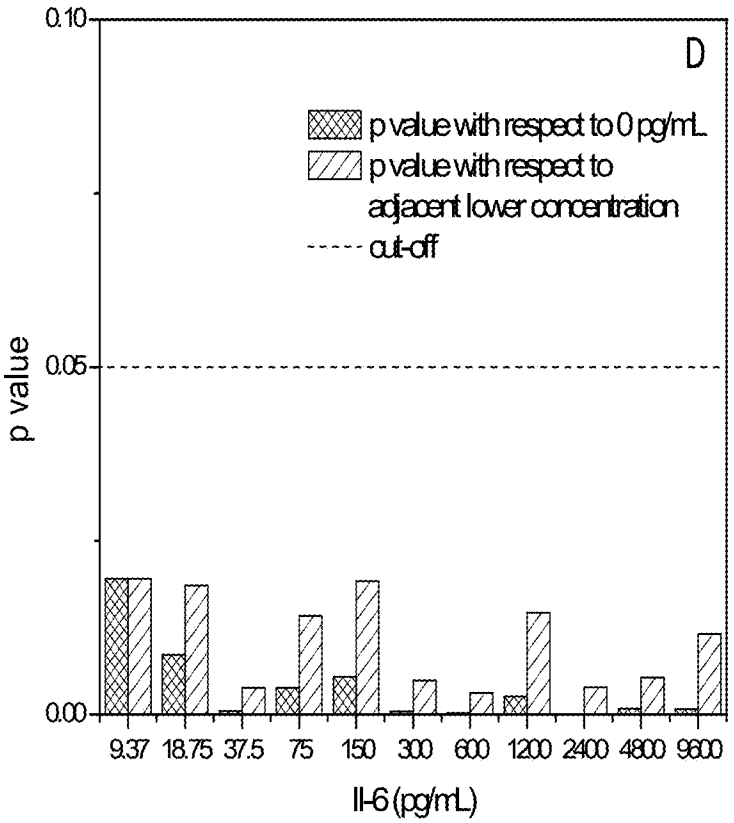
Figure 21C:
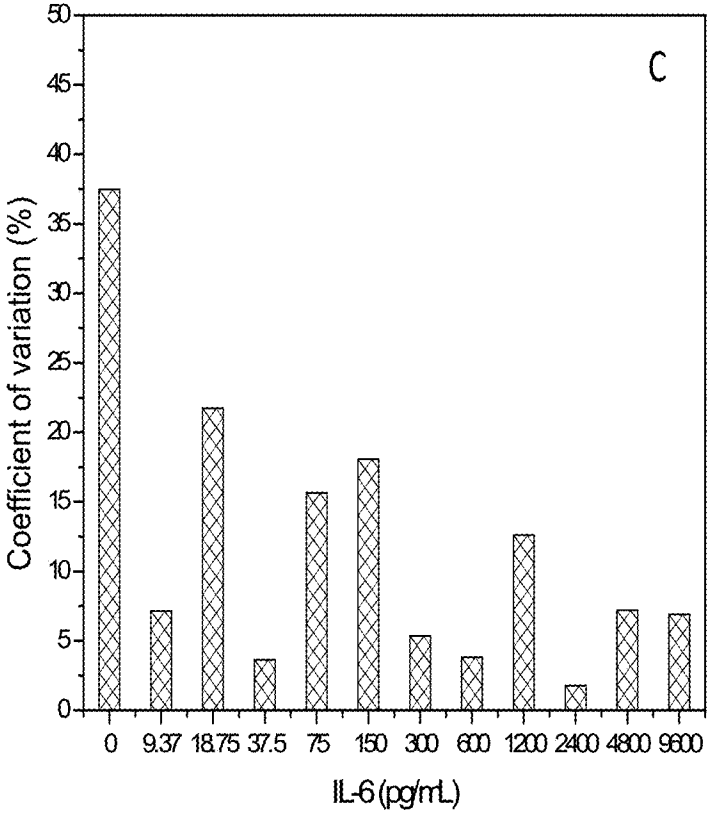
Figure 22B:
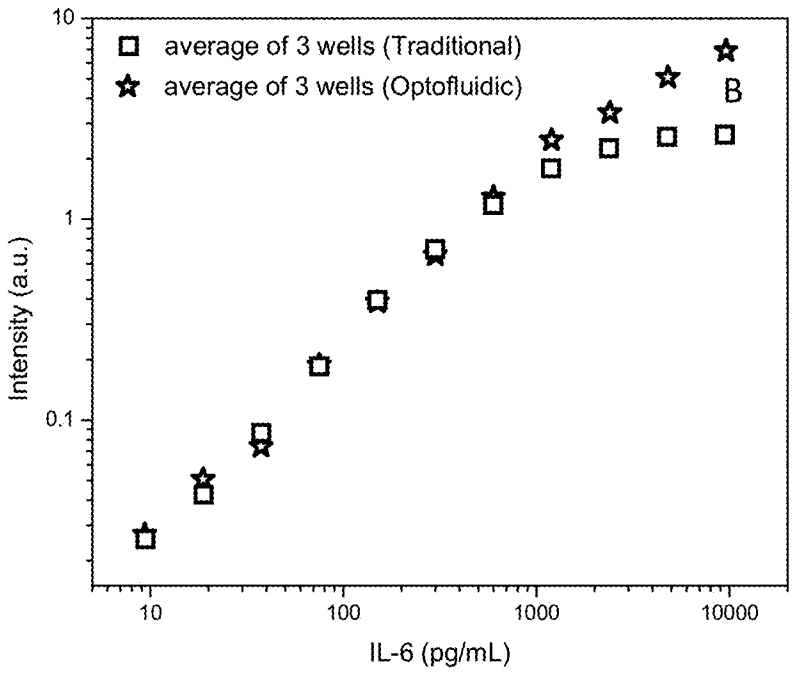
FIG. 22A-D shows a comparison of conventional 96-well plate and microfluidic well plate (0.018 in×0.022 in channel); (A) standard curves of IL-6 in buffer with conventional 96-well, plate and clear and transparent microfluidic well plate using fluorescence detection method, (B) standard curves of IL-6 in serum with conventional 96-well plate, and clear and transparent microfluidic well plate using fluorescence detection method, (C) standard curves of IL-6 in buffer with conventional 96-well plate (CORNING™ 96-Well Clear Bottom Black Polystyrene Microplate), and black and opaque microfluidic well plate using chemiluminescence detection method, and (D) standard curves of IL-6 in serum with conventional 96-well plate (CORNING™ 96-Well Clear Bottom Black Polystyrene Microplate), and black and opaque microfluidic well plate using chemiluminescence detection method.
Figure 22A:
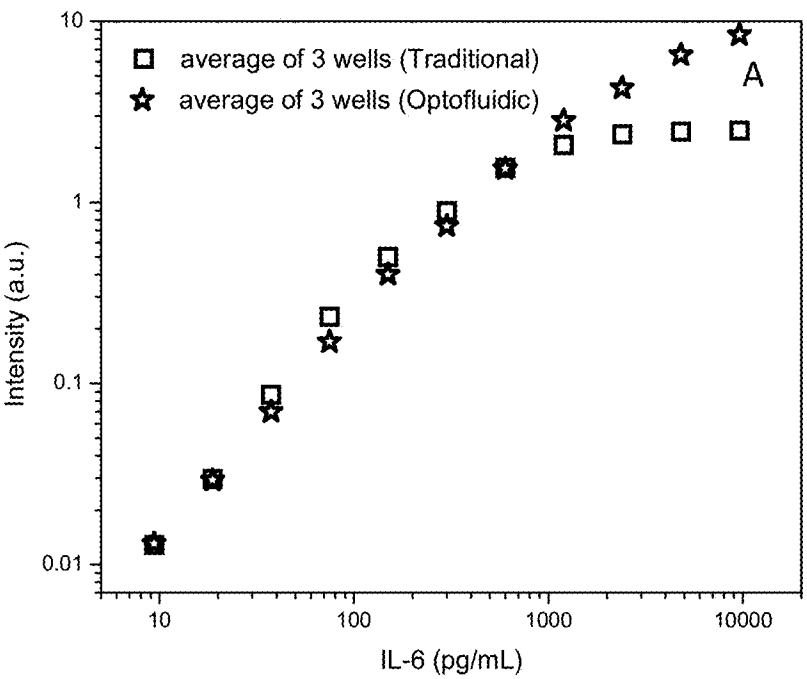
Figure 22D:
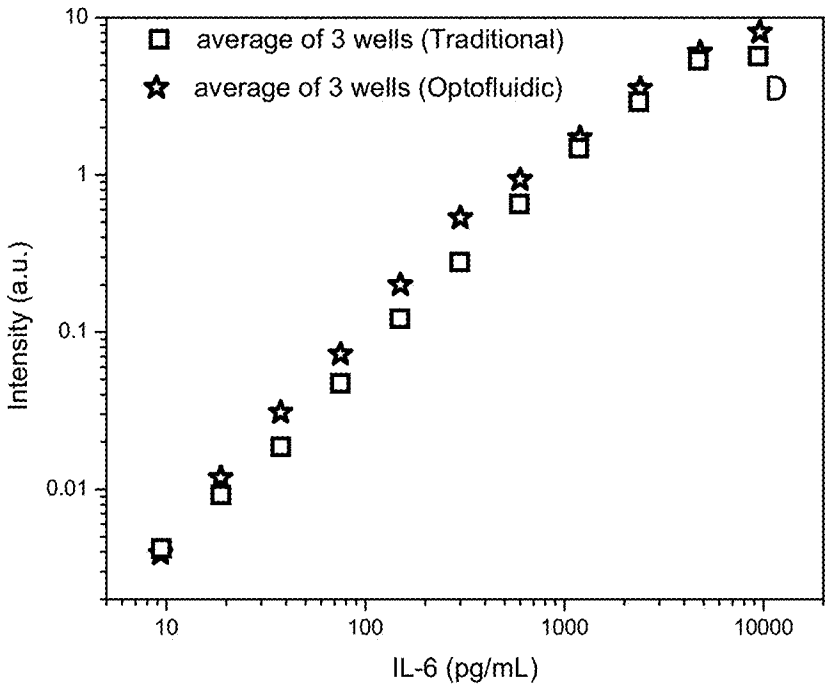
Figure 22C:
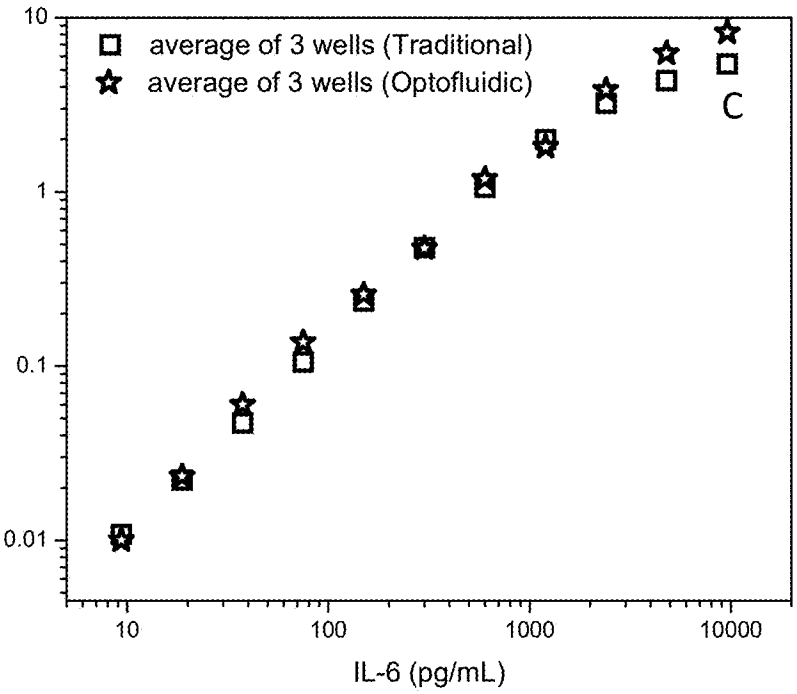

In the case of 0.018 in×0.022 in channel, linear projections were further extended between 9.37 pg/mL and 4800 pg/mL in the log-log scale in both IL-6 with buffer and serum as well as both fluorescence (FIG. 18A, B and FIG. 19A, B) and chemiluminescence detection methods (FIG. 20A, B and FIG. 21A, B). Most of the coefficient of variations were found less than 10% (FIG. 18C, FIG. 19C, FIG. 20C, and FIG. 21C).

The p values of microfluidic well plates with 0.018 in×0.022 in channel improved significantly over 0.008 in×0.008 in channel. All of the p values respect to adjacent lower connections or blank (0 pg/mL) of 0.018 in×0.022 in channel are less than 0.05 (FIG. 18D, FIG. 19D, FIG. 20D, and FIG. 21D). That is statically significance and concentrations between 9.37 pg/mL and 9600 pg/mL of IL-6 are distinguishable from blank (0 pg/mL) as well as adjacent concentrations (eg., 9.37 pg/mL vs. 18.75 pg/mL).

Furthermore, apart from 9.37 pg/mL in buffer of chemiluminescence detection (>90% confidence level), all other concentrations in buffer or serum using fluorescence or chemiluminescence method exhibited confidence levels of above 95% (see Table 2).

Overall, the detection limit is less than 9.37 pg/mL in buffer or serum with both fluorescence and chemiluminescence detection methods using 0.018 in×0.022 in channel. The linear detection range of the 0.018 in×0.022 in channel increased down to 9.37 pg/mL and up to 4800 pg/mL while maintaining the highest detection limit of 9600 pg/mL in line with four parameter logic (4-PL) curve. The statistical p values and confidence levels of 0.018 in×0.022 in channel are much better than 0.008 in×0.008 in channel.

FIG. 22 shows a benchmarking analysis of conventional 96-well plate (about 300 minutes of assay time) with microfluidic well plate (45 minutes or less assay time) using IL-6 in buffer and serum. The highest detection limit of conventional 96-well plate is 1200 pg/mL while microfluidic is 9600 pg/mL in both buffer (FIG. 22A) and serum (FIG. 22B) using fluorescence detection method. In the case of chemiluminescence detection method, both 96-well plate and microfluidic well plate have similar trends as shown FIGS. 22C and D. However, the highest detection limit of 96-well plate is approximately 4800 pg/mL of IL-6 in both buffer (FIG. 22C) and serum (FIG. 22D). On the other hand, microfluidic well plate enabled to detect 9600 pg/mL of IL-6 in both buffer (FIG. 22C) and serum (FIG. 22D).

TABLE 2

| Classification of confidence level (%) of each concentration | | | | | |
|---|---|---|---|---|---|
| | Confidence level (%) | | | | |
| Concentration of IL-6 (pg/mL) | Fluorescence detection of 0.008 in × 0.008 in channel with buffer | fluorescence detection of 0.018 in × 0.022 in channel with buffer | fluorescence detection of 0.018 in × 0.022 in channel with serum | Chemi-luminescence detection of 0.018 in × 0.022 in channel with buffer | Chemi-luminescence detection of 0.018 in × 0.022 in channel with serum |
| 9.37 | <50 | >98 | >99 | >90 | >99 |
| 18.75 | <50 | >98 | >99 | >95 | >98 |
| 37.5 | >95 | >98 | >99 | >99 | >99.9 |
| 75 | >98 | >99.9 | >99 | >99 | >99 |
| 150 | >99 | >99.9 | >99.9 | >99 | >98 |
| 300 | >99.9 | >99.9 | >99.9 | >99 | >99.9 |
| 600 | >99.9 | >99.9 | >99.9 | >99.9 | >99.9 |
| 1200 | >99.9 | >99.9 | >99.9 | >99 | >99 |
| 2400 | >99.9 | >99.9 | >99.9 | >99 | >99.9 |
| 4800 | >99.9 | >99.9 | >99.9 | >99 | >99 |
| 9600 | >99.9 | >99.9 | >99.9 | >99.9 | >99 |

Turning now to FIGS. 23-33, distinctive features of the microfluidic modules 22 will be described in greater detail. As mentioned previously, the assay plate assembly 84 includes a top plate (Part A) and a bottom plate (Part B). The bottom plate (Part B) preferably, but not necessarily, includes a two-part design composed of an adhesive film 58 and a structural body, as clearly depicted in FIG. 4A. The film 58 part may be treated with an adhesive to adhere directly to the underside of the top part (Part A). Furthermore, the film 58 may also optionally be treated with a hydrophilic or hydrophobic or semi-hydrophobic agent to influence the flow behavior of fluids placed into the wells 32. The film 58 portion of the bottom plate (Part B) includes a plurality of drain holes 44 that align with the outlets 34 from the microfluidic channel 36, as shown in FIGS. 1B, 4A, 4B and 5A. In cases where the bottom plate (Part B) includes the additional structural body as shown in FIG. 4A, the aforementioned skirt 42 may be formed about its periphery.

Figure 23:
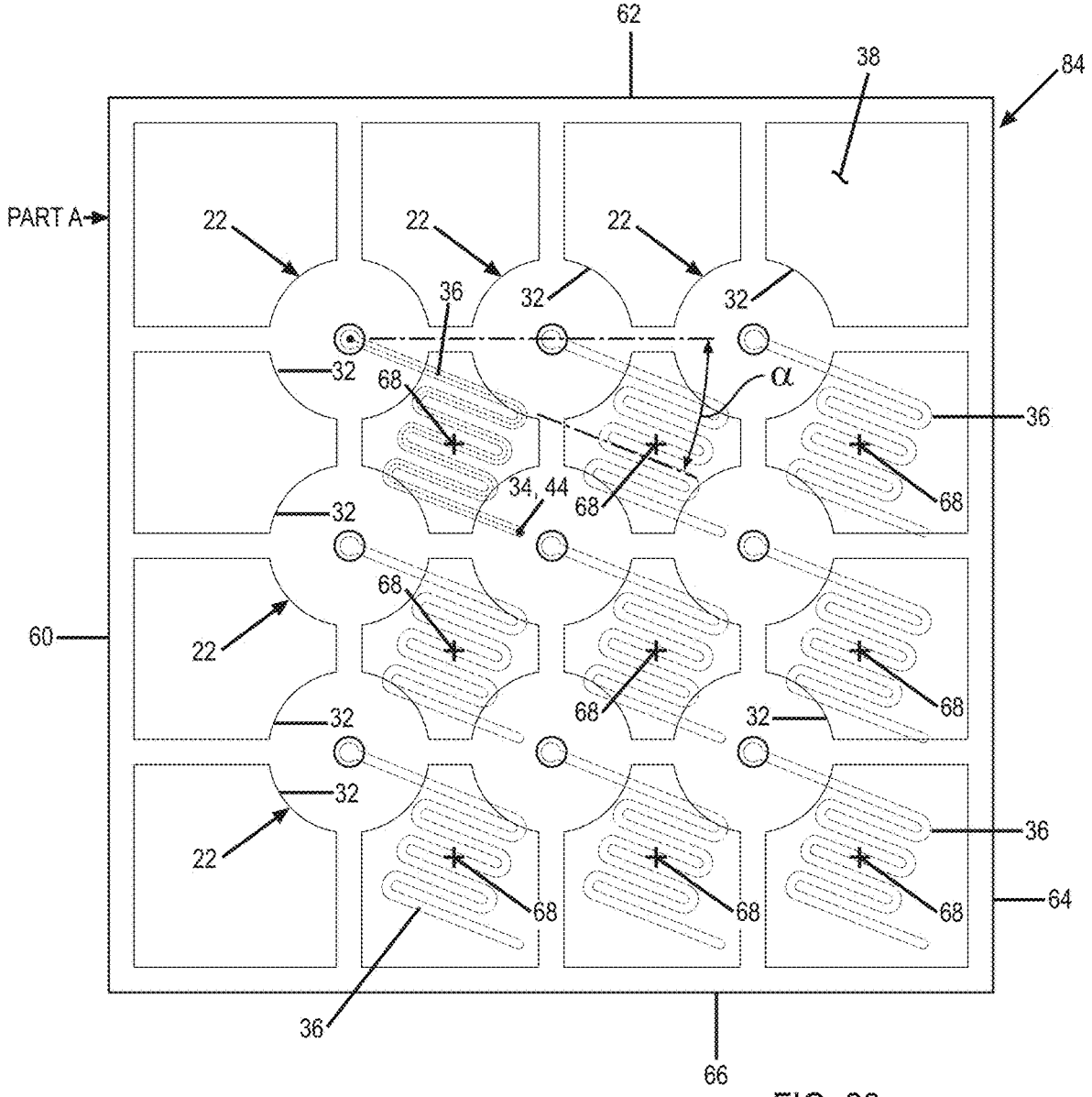
FIG. 23 is top view of a 3×3 matrix plate assembly according to an embodiment of this disclosure.
Figure 26:
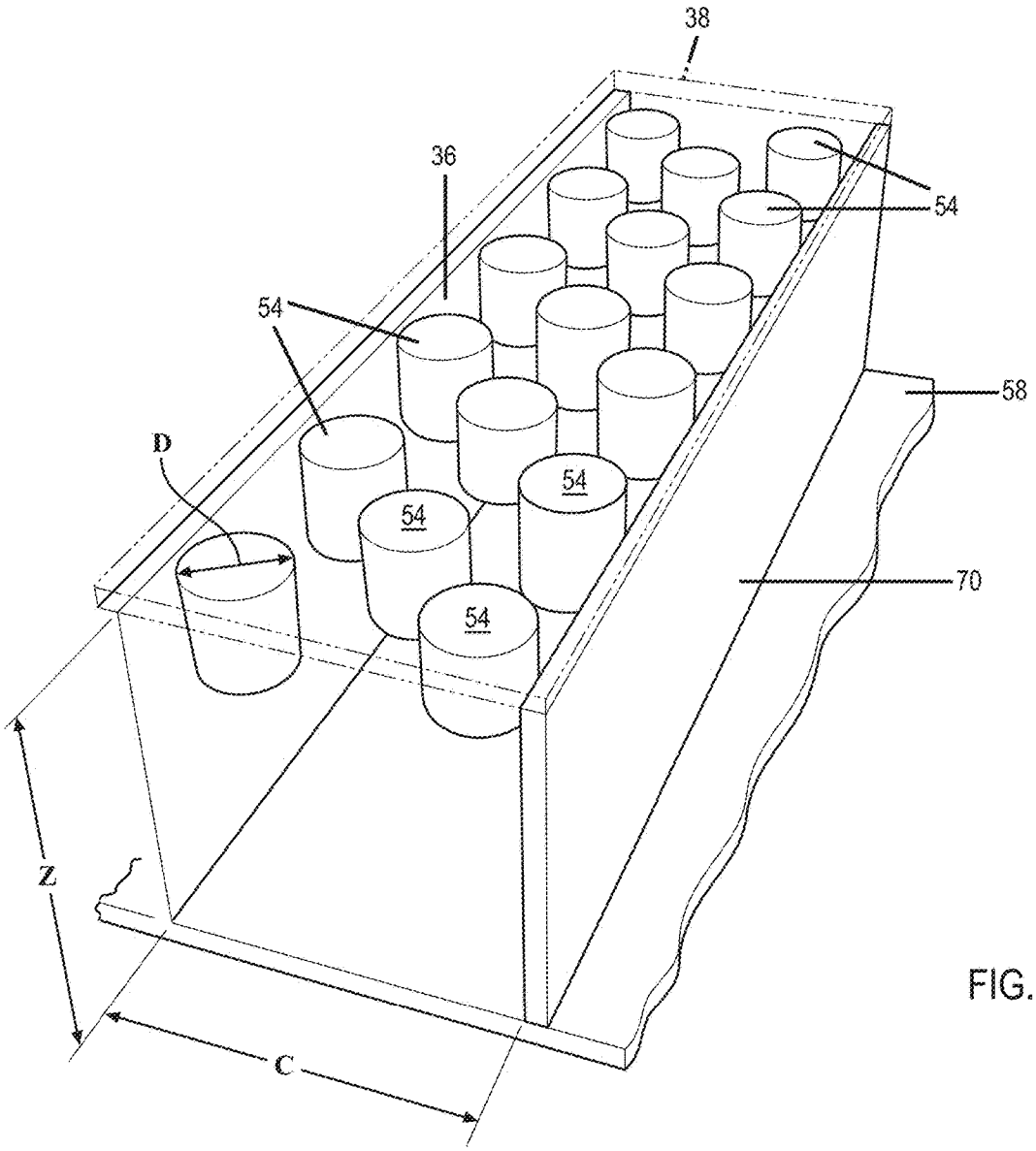
FIG. 26 is a simplified perspective view of the fragmentary section of microfluidic channel depicted in FIG. 25.

The top plate (Part A), designed to overlie the bottom plate (Part B), comprises a frame or carrier for the plurality of microfluidic modules 22. The top plate (Part A) has a top surface 38, perhaps best shown in FIGS. 2B and 3A, as well as an underside (FIGS. 3B, 10B). The top plate (Part A) can be any geometric shape. In the illustrated examples, the periphery of the top plate (Part A) is defined at least in part by a left edge 60 and a perpendicular upper edge 62, thus forming an orthogonal upper left corner. In order to best accommodate industry practices, however, the top plate (Part A) will usually take the form of a generally rectangular periphery defined by the left edge 60 and the upper edge 62, along with corresponding opposite right 64 and lower 66 edges as indicated in FIGS. 23 and 26. In general, the left 60 and right 64 edges are parallel to one another, whereas the upper 62 and lower 66 edges are perpendicular to the other edges 60, 64 thus forming either a square (FIG. 23) or rectangular (FIG. 26) shape.

A plurality of microfluidic modules 22 are disposed within the top plate (Part A). The embodiment of FIG. 23 has nine microfluidic modules 22, whereas the embodiment of FIG. 28 has ninety-six microfluidic modules 22. These are merely examples to demonstrate the wide variability in the number of possible microfluidic modules 22. The number of microfluidic modules 22 corresponds to the number of drain holes 44 in the bottom plate (Part B). One drain hole 44 for each microfluidic module 22. Thus, in the example of FIG. 23 where nine microfluidic modules 22 are shown, the corresponding bottom plate (Part B, not shown) will also have nine drain holes 44. And so forth.

Figure 28:
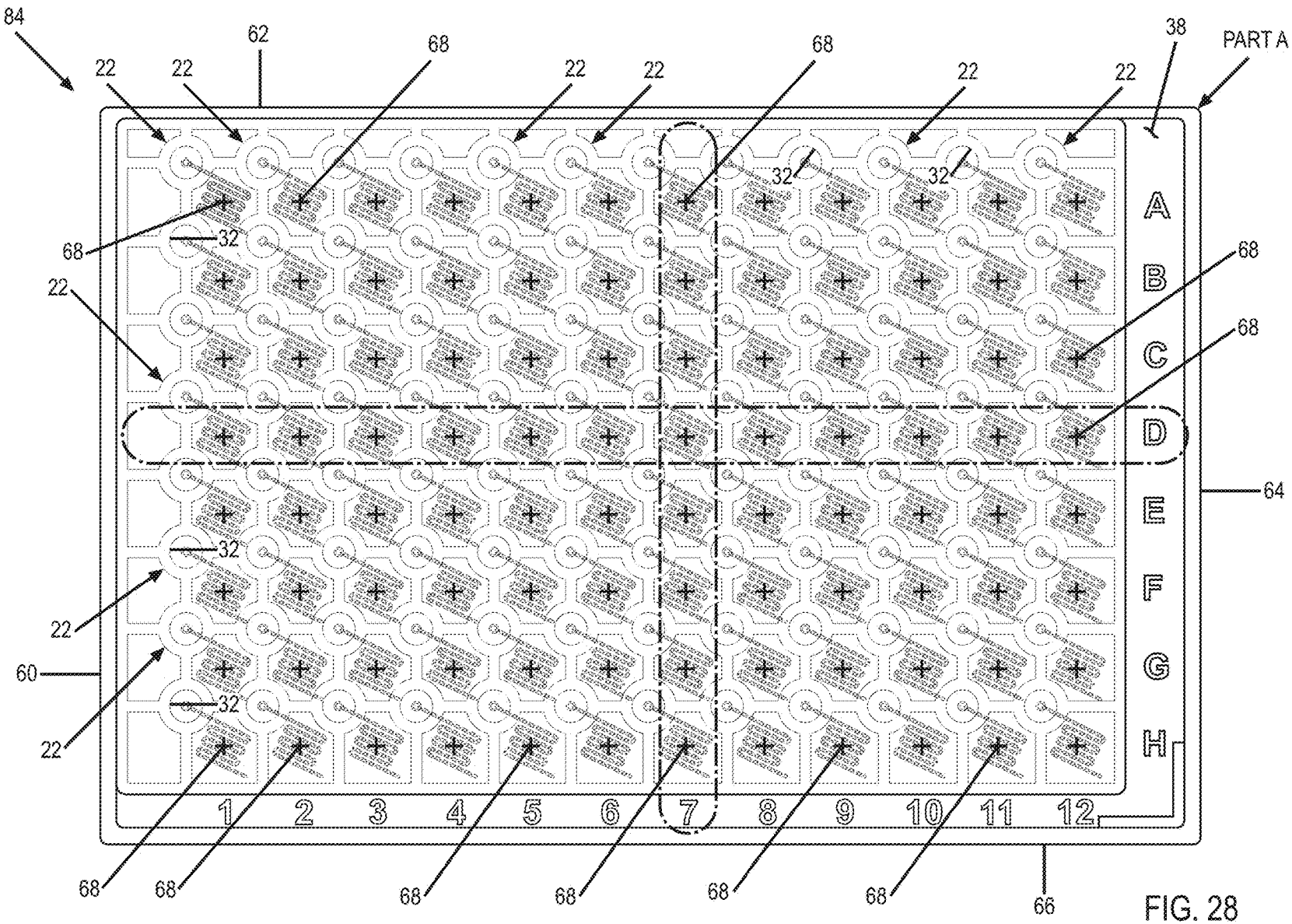
FIG. 28 is a top view of an 8×12 matrix plate assembly similar to that of FIG. 1A, but also showing the detection areas and highlighting row D and column 7.

As will be observed, the plurality of microfluidic modules 22 are arranged in a rectilinear matrix of rows and columns. FIG. 28 calls out the rows by reference to letters A-H located near the right edge 64. The columns are called-out by reference to numbers 1-12 located near the lower edge 66. Generally, each row is spaced apart from the next adjacent row by a lateral distance of 9 mm. Similarly, each column is spaced apart from the next adjacent column by a lateral distance of 9 mm. The smallest contemplated matrix comprises at least two microfluidic modules 22—which could take the form of either two adjacent modules 22 in the same row or in the same column. In practice, however, the embodiment of FIG. 23 will represent a more common small-size matrix comprised of three rows and three columns (3×3), to support a total of nine microfluidic modules 22. This is not to say that a single column of, for example, eight modules 22 (1×8) or a double column of, for example, sixteen modules (2×8) would not be practical in some applications. Quite often, however, the disclosure will be deployed in the standard 9×12 matrix comprising ninety-six modules 22, as shown in FIG. 28. And indeed, the matrix can be designed to support any number of modules 22 greater than one.

Figure 24:
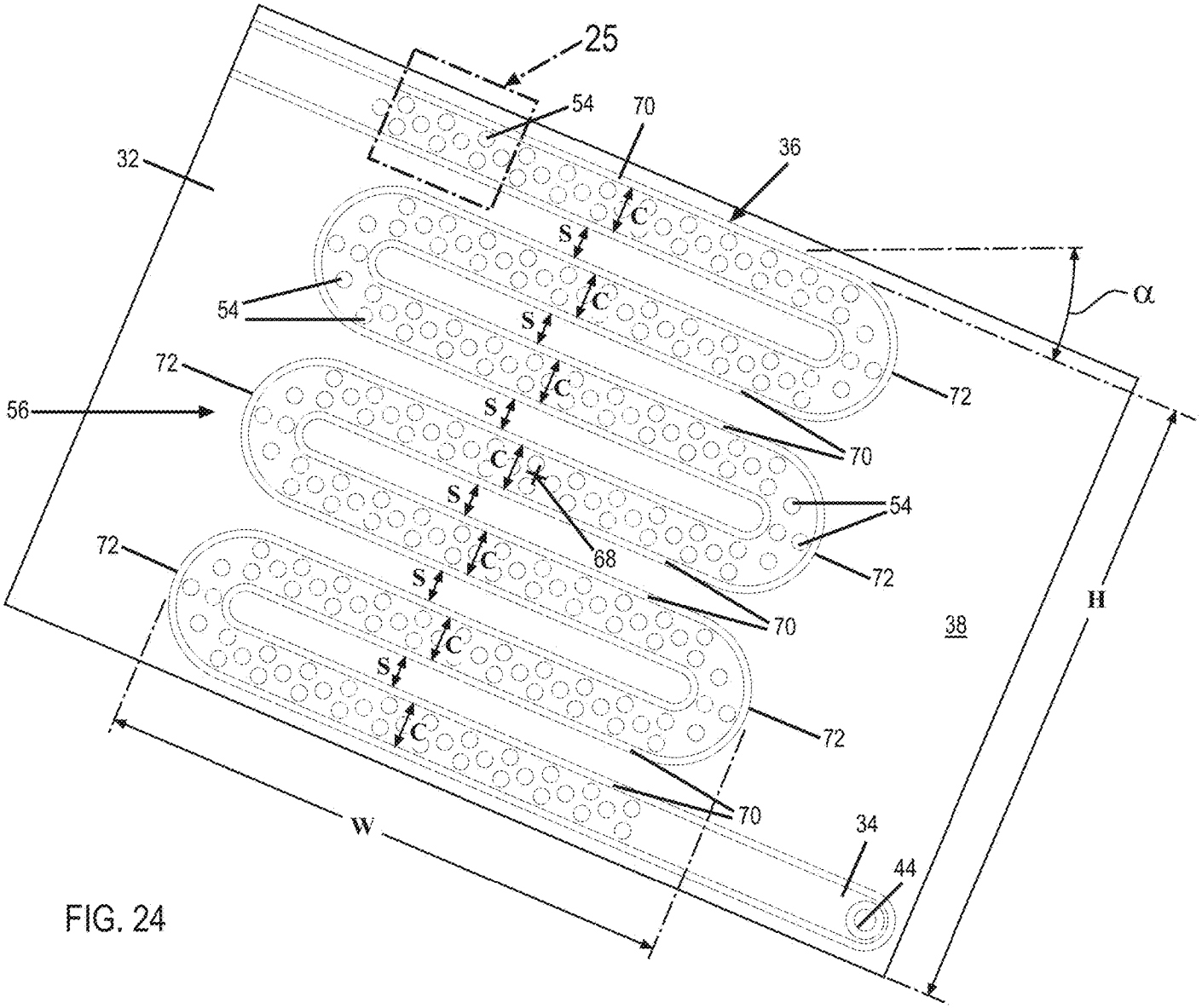
FIG. 24 is a top view of a microfluidic channel similar to that in FIG. 11 but indicating various dimensional attributes of the detection area.
Figure 25:
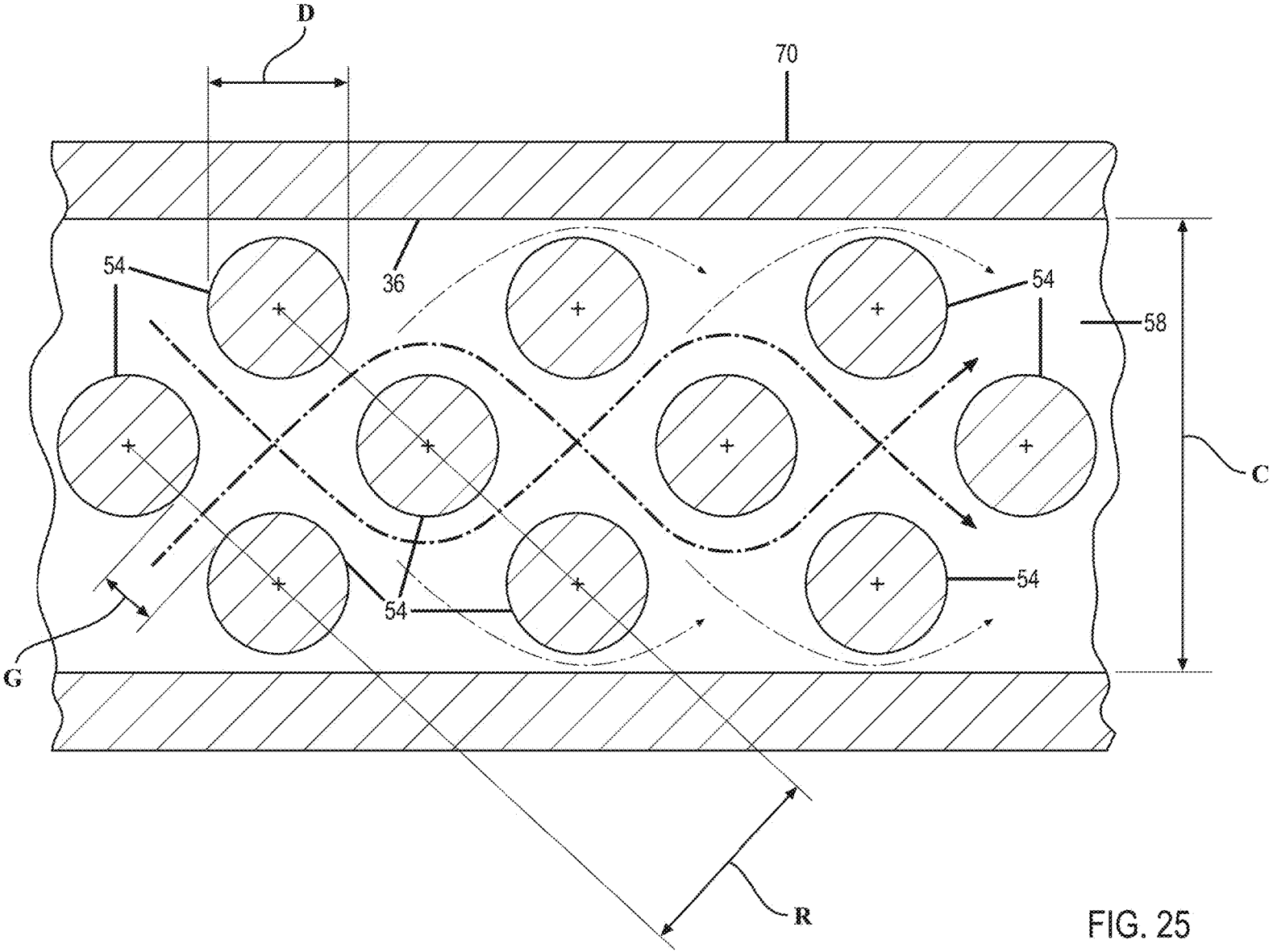
FIG. 25 is an enlarged view of the area bounded at 25 in FIG. 24, indicating various dimensional attributes of the channel and micro-posts and illustrating the dynamic flow of fluid therethrough.
Figure 31:
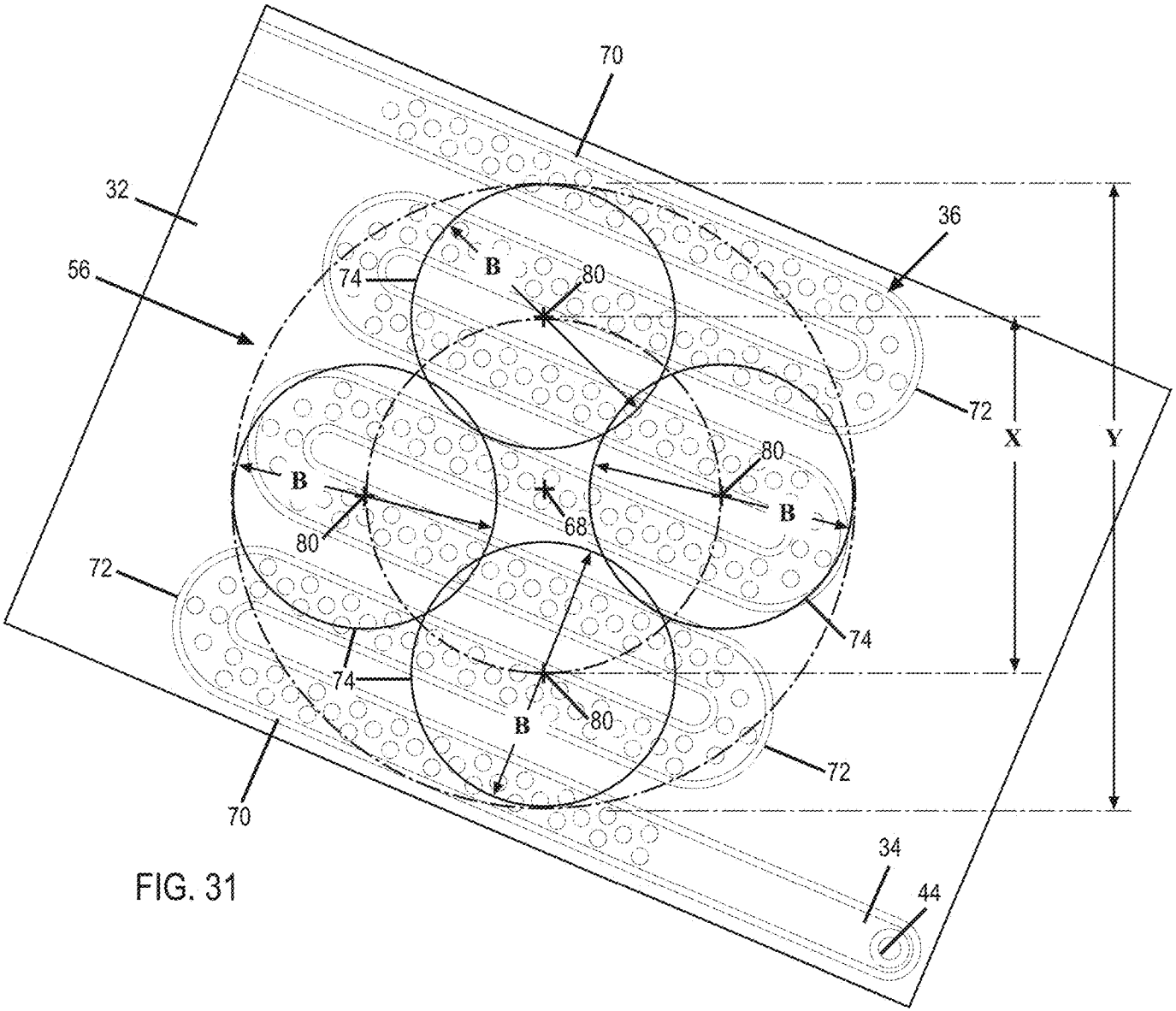
FIG. 31 is a top view of a detection area as in FIG. 24 indicating various dimensional attributes of the detection area with respect to a corresponding detection beam from an optical detector as in FIG. 27.

Returning to the schematic diagram of FIG. 5A, each microfluidic module 22 has been described as including an elongated microfluidic channel 36. The channel 36 extends between an upstream inlet and a downstream outlet 34. The portion of the microfluidic channel 36 between the upstream inlet and downstream outlet 34 comprises a detection area 56 that is adapted for taking optical measurements. The detection area 56 has a geometric center 68, as indicated in FIGS. 23, 24 and 31.

Before proceeding further with the detailed description of the microfluidic modules 22, it may be helpful to re-state the previously-mentioned ANSI/SLAS specifications for a standard 96-well plate. According to these standards, the wells in a 96-well microplate should be arranged as eight rows by twelve columns. The distance between the left outside edge of the plate and the center of the first column of wells shall be 14.38 mm. The left edge of the part will be defined as the two 12.7 mm areas (as measured from the corners). Each following column shall be an additional 9 mm in distance from the left outside edge of the plate. The distance between the top outside edge of the plate and the center of the first row of wells shall be 11.24 mm. The top edge of the part will be defined as the two 12.7 mm areas (as measured from the corners). Each following row shall be an additional 9 mm in distance from the top outside edge of the plate. The center of each well will be within a 0.70 mm diameter of the specified location.

Returning now to the detailed description of the microfluidic modules 22, the geometric center 68 of each detection area 56 is spaced apart from the left edge 60 of the top plate (Part A) according to the formula 14.38 mm+(9*x) mm where x is a non-negative integer, typically an integer between 0-11. The geometric center 68 of each detection area 56 is spaced apart from upper edge 62 of the top plate (Part A) according to the formula 11.24 mm+(9*y) mm where y is a non-negative integer, typically an integer between 0-7. By following these specifications, the geometric center 68 of each detection area 56 is located where the ANSI/SLAS specification would have a well centered. That is to say, the present disclosure departs from the ANSI/SLAS specification by locating the geometric center 68 of each detection area 56 according to the stated formulaic expressions rather than by locating the centers of its wells 32 at the specified locations. In FIG. 28, row D and column 7 are highlighted to show that a detection area 56 lays at the intersection D:7. Said another way, the geometric center 68 of the detection area 56 at location D:7 satisfies the stated formulaic expressions in this way: Column 7=14.38 mm+(9*6) mm from the left edge 60; Row D=11.24 mm+(9*3) mm from upper edge 62. Thus, the geometric center 68 of the detection area 56 at location D:7 is 68.38 mm from the left edge 60 and 38.24 mm from the upper edge 62. As can be clearly seen in FIG. 28, all of the geometric centers 68 are centered within each row and each column. For the highlighted row D and column 7, this centralized positioning of the geometric centers 68 is clearly visible. By departing from the ANSI/SLAS standards, the present disclosure is able to achieve substantially-improved optical detection signal consistency, as will be explained further below.

Figure 27:
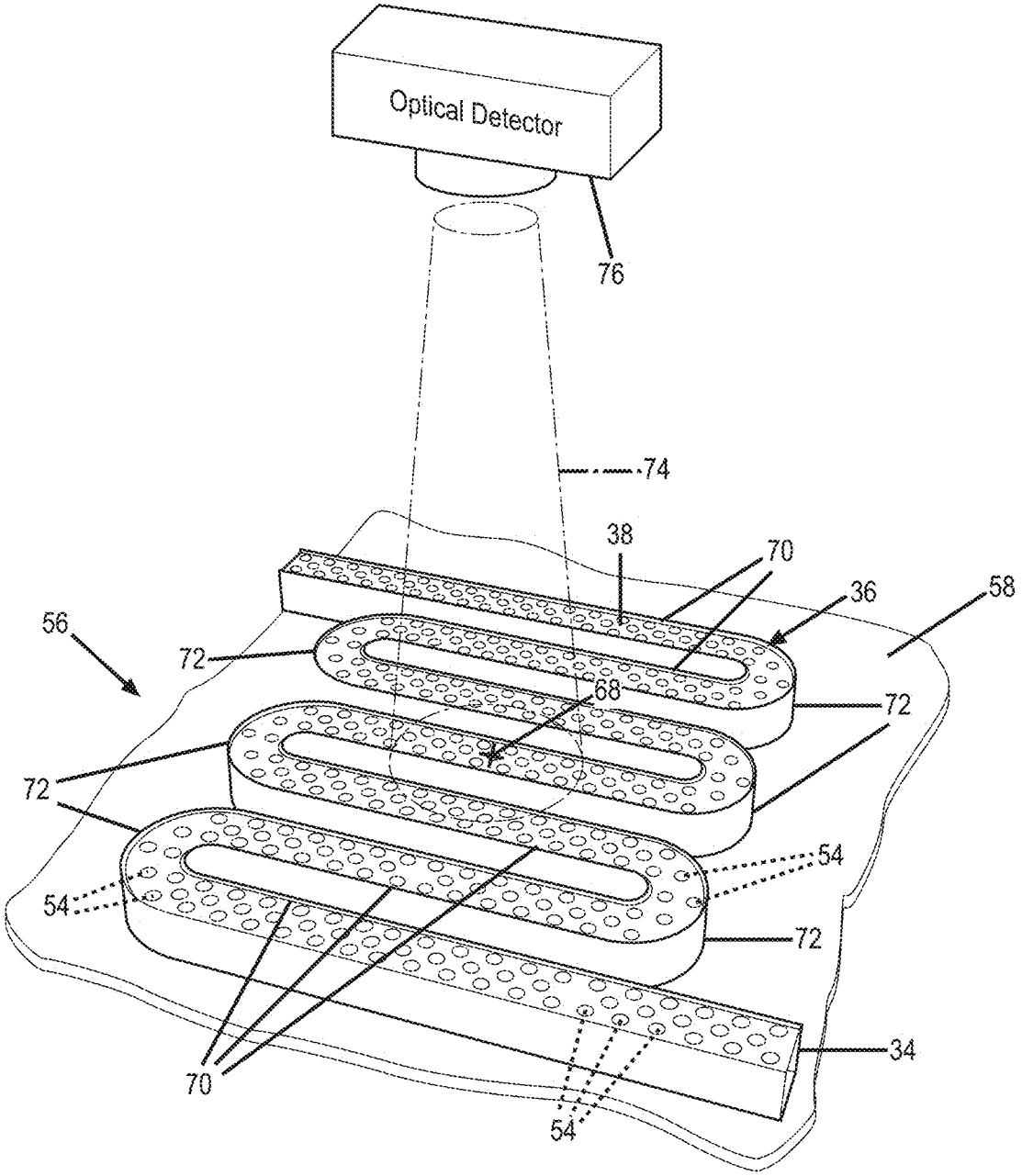
FIG. 27 is a highly simplified perspective view showing the interaction of an optical detection beam and the detection area of one microfluidic module.

Furthermore, in contrast to many prior art systems, the detection area 56 of the present disclosure has generally planar upper and lower surfaces, as illustrated in FIG. 27. At least one of these planar upper and lower surfaces is optically clear to perform optical detections. The planar upper surface of the detection area 56 is bounded by the top surface 38 of the top plate (Part A), whereas the lower surface of the detection area 56 is bounded by the bottom plate (Part B). See also FIG. 26. The microfluidic channel 36 is thus disposed between the top surface 38 of the top plate (Part A) and the bottom plate (Part B).

Within the detection area 56, the microfluidic channel 36 of each module 22 has a generally consistent height Z and a generally consistent width C along its entire length. That is to say, neither the height Z nor the width C changes, or changes only negligibly, within the detection area 56. These dimensional attributes are illustrated in FIG. 26. The generally consistent height Z may be any suitable measure. In exemplary embodiments of the disclosure, heights Z in the range of about 0.3-0.9 mm have been found to provide satisfactory results within the context of an assay plate device used for diagnostic, screening and/or research applications. More specifically, heights Z in the range of about 0.5-0.6 mm have been found to provide superior results in these applications. The generally consistent width C may also be any suitable measure. In exemplary embodiments of the disclosure, widths C have been demonstrated in the range of about 0.3-0.9 mm. for manufacturing purposes, it may be helpful in some cases to form the base of the channel 36 slightly wider than its upper end, i.e., the microfluidic channels 36 may be slightly broader adjacent the bottom plate (Part B). More specifically, widths in the range of about 0.4-0.6 mm have been found to provide superior results in these applications.

Each detection area 56 is preferably formed in a serpentine pattern composed of a plurality of alternating runs 70 connected by intervening loop ends 72. The term alternating in the preceding sentence refers to the direction of fluid flow through the microfluidic channel 36. Because each loop end 72 effectively reverses the course of fluid flow (180°), the flow direction of fluid through the runs 70 will alternate in a back-and-forth or zig-zag manner in use. Each run 70 is spaced apart from the next adjacent run 70 by a lateral spacing S in the range of about 0.3-0.7 mm. Please see FIG. 24. Each of the runs 70 thus extend parallel to one another within this serpentine pattern. It is not necessary that the channel width C be equal to the channel spacing S, however it is preferred that the spacing S remain generally constant throughout the detection area 56. In some embodiments, superior optical detection signal consistency has been achieved when the differential of S to C is not greater than about 50%. For example, if the channel width C is 0.5 mm, the channel spacings S (i.e., distance between runs 70) will range between about 0.25 and 0.75 mm.

Referring still to FIG. 24, the serpentine pattern of the detection area 56 can be seen having an overall width W measured parallel to the runs 70 in the range of about 3-7 mm. The serpentine pattern of the detection area 56 has an overall height H measured perpendicular to the runs 70 in the range of about 3-7 mm. Preferably, the overall height H will be generally equal to the overall width W. In this context, generally equal means that the differential of H to W is not greater than about 20%. For example, if the overall height H is 0.6 mm, the overall width W will range between about 0.48 and 0.72 mm. The geometric center 68 can thus be computed easily as the intersected mid-points of the width W and height H. For example, in a detection area having a height H of 5.3 mm and a width W of 4.67 mm, the geometric center 68 will be located at 2.65 mm down and 2.34 mm over.

Furthermore, the detection area 56 can be optimized within each microfluidic module 22 by canting each run 70 at an angle $\alpha$ in the range of about 15-35 degrees. As shown in FIGS. 23 and 24, the angle $\alpha$ is measured relative to the rows of the matrix. In FIGS. 23, 24 and 28, the rows appear horizontal on the page, such that the angle $\alpha$ is measured in a clockwise direction. As mentioned above, the present disclosure breaks with standard ANSI/SLAS protocols by locating the geometric center 68 of each detection area 56 according to the stated formulaic expressions rather than by locating the centers of the wells 32 in the specified locations. Optimization of the detection areas 56 by canting the runs 70 at the angle $\alpha$ further contributes to the ability of the present disclosure to achieve substantially-improved optical detection signal consistency, as will be explained further below. While the angle $\alpha$ may comfortably fall within the range of about 15-35 degrees, preferred results have been achieved when the range of the angle $\alpha$ is maintained between about 20-25 degrees. Superior results have been achieved when the angle $\alpha$ is about 22.5 degrees.

Figure 29:
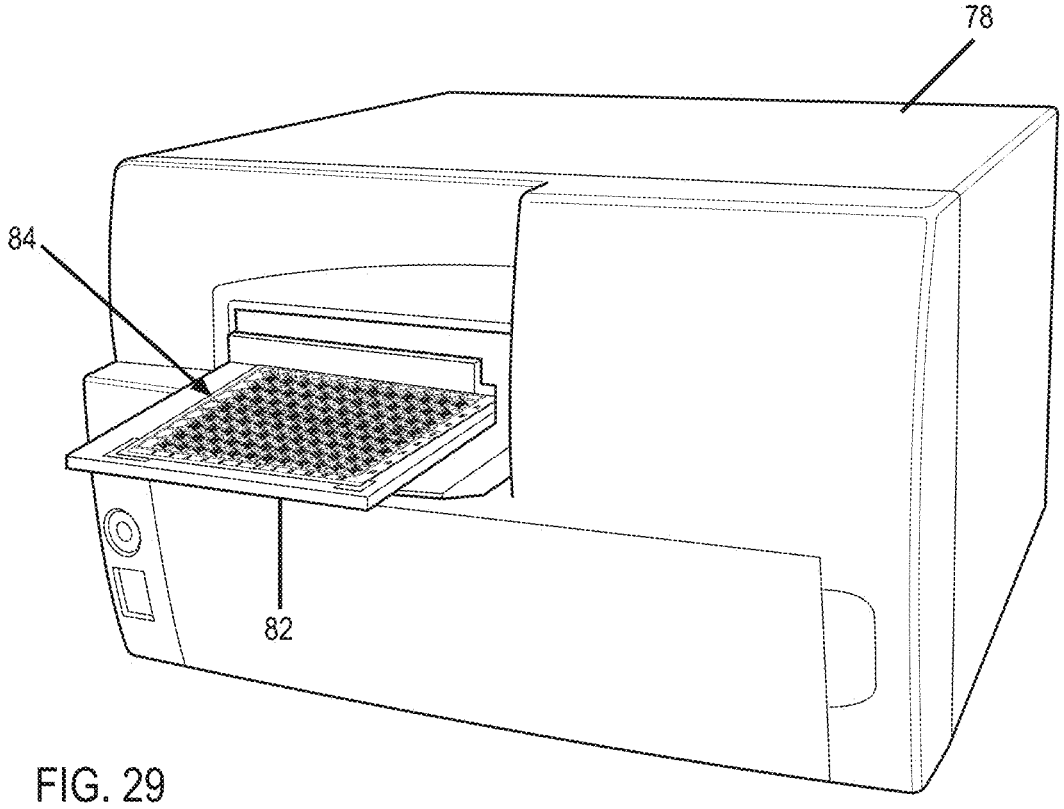
FIG. 29 is a representation of a standard spectrophotometric plate reader such as may be used to conduct optical detections, showing its cartridge tray expended to receive a plate assembly according to the present disclosure.
Figure 30:
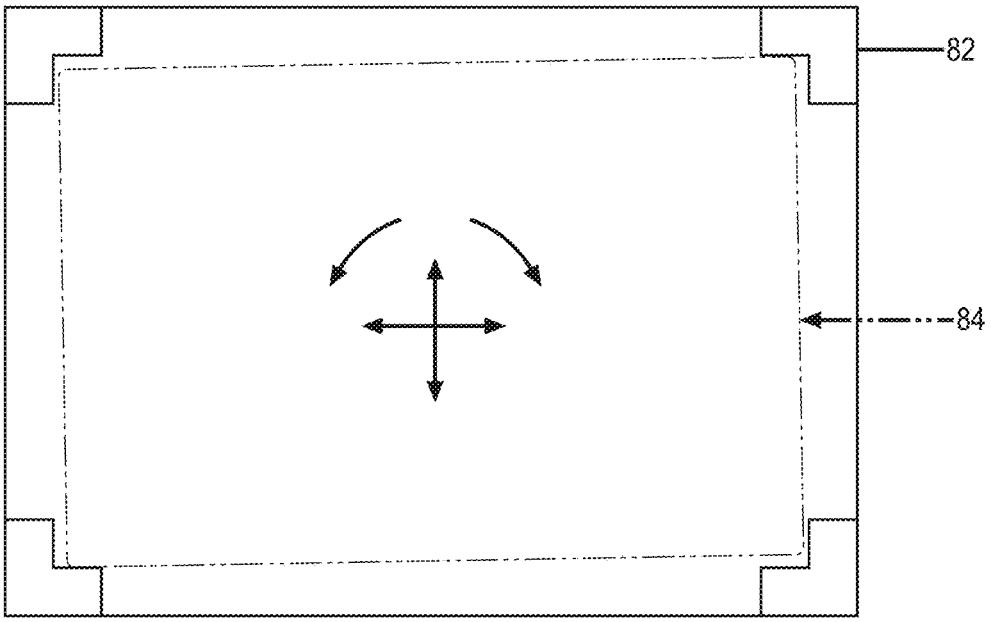
FIG. 30 is simplified top view of a cartridge tray of a standard plate reader, with a plate assembly according to the present disclosure shown in phantom lines to illustrate positional variabilities due to generous clearances therebetween.

Optionally, the microfluidic channels 36 can be fitted with an array of optically-transmissive micro-posts 54 throughout the detection area 56. In other words, the present disclosure can function with acceptable performance results when the channel 36 is devoid of any micro-posts 54. However, superior results can be achieved with the use of micro-posts 54 that are equally distributed throughout the entirety of the detection area 56. When used, micro-posts 54 serve as light pipes or optical wave guides. In effect, each micro-post 54 is solid transparent plastic rod capable of transmitting light toward its upper and lower ends to be detected through an optically clear top surface 38 and/or bottom plate (Part B) by a suitably-configured optical detector 76 within a standard plate reader 78 (FIGS. 27 and 29). The design and arrangement of the micro-post array 54 offers more uniform illumination characteristics, reduced shadowing and glare, improved design flexibility and relatively easy manufacturability options.

The microfluidic channel 36 will typically include a reactive coating agent that has been applied, i.e., immobilized, throughout the entire detection area 56. The reactive coating agent can be any suitable diagnostic substance, including but not limited to, assays used to assess the presence, amount or functional activity of a target entity (i.e., the analyte). The reactive coating agent contemplated for use in this disclosure specifically includes, but is not limited to, solid-phase enzyme immunoassays such as those used in typical ELISA test procedures. The reactive coating agent may either be applied by a manufacturer, by an intermediate vendor, or by the end-user as a preparatory step prior to the start of an actual diagnostic test. When the device is designed to include an array of micro-posts 54, then the exterior surfaces of the micro-posts 54 will likewise include the reactive coating agent. As such, light transmitted by each micro-post toward its upper and lower ends will be imbued with color characteristics of analytes that have reacted with the coating agent on the surface of the micro-posts 54. By transmitting this colored light to ends of the micro-posts 54, an optical reader can accurately discern its spectral characteristics.

The optional array of micro-posts 54 may be seen, therefore, to provide at least three benefits to the performance of the microfluidic channel 36: they increase the surface-to-volume ratio within the channel 36; they expedite the molecule capture efficiency vis-a-vis the analyte(s); and they guide the optical signals towards the detector 76 so that detected light intensity is increased.

Each micro-post 54 in the array can have a similar size and shape, or there can be some differences in size and/or shape from one micro-post 54 to the next within the array. In the illustrated examples, the micro-posts 54 each have the same size and generally cylindrical shape. Each micro-post 54 in the array extends perpendicularly from the top surface of the top plate (Part A) toward the bottom plate (Part B). Each micro-post 54 in the array has a diameter D in the range of about 0.05-0.25 mm. See FIGS. 25 and 26. Superior results have been achieved with micro-posts 54 that have a diameter D of about 0.1 mm. The height of each micro-post 54 will generally be less than or equal to the height Z of the microfluidic channel 36. However, for manufacturing purposes, the micro-posts 54 may be smaller, and even considerably smaller, thus leaving a very large gap between them and the film 58 of the bottom plate (Part B) like that shown in FIG. 26. In one embodiment, the post height of each micro-post 54 may be about 15-20% of the channel height Z. For example, if the channel height is 0.55 mm, the post height of each micro-post 54 may be only about 0.1 mm, thus leaving a free-space gap of about 0.45 mm. There is some indication that having micro-posts 54 that are substantially shorter than the channel height Z could be quite advantageous. For examples, the extra-short micro-posts 54 are believed to yield better color transmission through the top surface 38 due to the analytes captured on the flat blunt end. Also, the large free-space gap created by extra-short posts facilitates rapid fluid flow dynamics through the microfluidic channel 36. These and possibly other benefits indicate that post height shortened to about 15-20% of the channel height Z represent a distinct design advantage.

Returning to FIG. 25, the center-to-center spacing R between each micro-post 54 and the next adjacent micro-post 54 in the array may be in the range of about 0.05-0.35 mm. Thus, it will be seen that fluid flowing through the microfluidic channel 36 will weave its way around the micro-posts 54, resulting in a thorough reaction of analytes in the flowing liquid with the reactive coating agents applied to the exposed interior surfaces within the microfluidic channel 36.

Each microfluidic module 22 includes at least one (typically only one) well 32. Within each module 22, the well 32 is disposed in fluid communication with the corresponding the upstream inlet of the microfluidic channel 36. This is perhaps best shown in FIG. 5A. Each well 32 has a funnel-like, or generally conical, shape that opens through the top surface 38 of the top plate (Part A). Strategically, within each microfluidic module 22, the well 32 is laterally offset from the detection area 56. As previously mentioned, the present disclosure breaks with standard protocols in its wells 32 are not located according to the specifications set forth in ANSI/SLAS 1-2004, 2-2004, 3-2004 and 4-2004. Instead, the wells 32 of the present disclosure are offset from these locations so that the geometric center 68 of each detection area 56 can occupy this real estate. To say it in other words, the well 32 in each microfluidic module 22 is entirely offset from the detection area 56. And furthermore, no well 32 in the entire plate assembly overlaps (in top view) any detection area 56 whatsoever so that the entire footprint of each detection area 56 is available for unimpeded inspection by an optical reader 78.

Each microfluidic module 22 includes at least one (typically only one) drain hole 44 in the bottom plate (Part B). The drain hole 44 is disposed in fluid communication with the downstream outlet 34 of the corresponding microfluidic channel 36, as illustrated in FIG. 5A. In the illustrated examples, the drain hole 44 of one microfluidic module 22 is disposed directly below a well 32 in the next adjacent the microfluidic module 22. This can be observed in FIG. 23. In this manner, the drain 44 is also laterally offset from the detection area 56, just like the well 32. However, locating the drain 44 below an adjacent well 32 is just one option; other locations for the drain 44 are certainly possible in vast real estate of a plate assembly 84, so long as all of the drains 44 are laterally offset from all of the detection areas 56. By laterally offsetting both the wells 32 and their drains 44 from not only their own their respective detection areas 56 but also all other detection areas 56 in the plate assembly 84, the present disclosure is able to achieve substantially-improved optical detection signal consistency, as will be explained presently.

The several unique design attributes of the microfluidic modules 22 cooperate to provide the present disclosure with substantially-improved optical detection signal consistency. The design attributes include the serpentine pattern of the microfluidic channels 36 within the detection areas 56 that are laterally spaced outside the loading well 32 structure to avoid any adverse impact of the loading well 32 on the optical signal (i.e., light intensity that reaches the detector).

Experimental data shows that light intensity varies significantly from well-to-well in certain designs that allow the detection areas and wells to overlap. As will be described momentarily, variation in light signal intensity is attributed to slight lateral movement of the plate relative to the detector or any liquid residuals left within the loading well sidewalls that may deflect the light from reaching into the detector in a uniform manner. In contrast, the microfluidic modules 22 of this present disclosure (with or without the micro-posts 54) are designed such that any small lateral movement does not cause any change in light intensity into the detector located above the detection area 56. This ensures good test-to-test signal consistency.

Signal consistency is further enhanced by the relative flatness of the serpentine microfluidic channels 36 over the detection area 56. See, for example, FIG. 27 which depicts the detection area 56 in combination with a schematic representation of a detection beam 74 as associated with an optical detector 76. In this example the top surface 38 is optically clear. In some applications (e.g., chemiluminescence), it may be desirable to take optical measurements from the bottom side, in which case the bottom plate (Part B) must be optically clear and possibly the top surface 38 made optically opaque. The optical detector 76 is of the type employed within any suitable plate reader device 78 like that shown in FIG. 29. The optical detector 76 is preferably any such device that is commercially-available and used in connection with the spectral analysis of Microtiter-type plates. The diameter B of the detection beam 74 relative to the maximum diameter Y of the detection area 56 is illustrated in FIG. 31. On average, a detection beam 74 may span about 2 mm (B≈2 mm), whereas a detection area 56 may have a maximum detectable diameter Y of about 4-5 mm. This means that the center 80 of the detection beam 74 can shift over distance X an still fully imprint the detection area 56. The shift distance X could be 2.0 to 2.5 mm in this example. This represents a significant amount of plate movement relative to the optical detector 76 without disturbing the imaging quality. The uniform flatness of the serpentine microfluidic channel 36 over this detection area 56 means that a uniform signal strength will be achieved even in cases where the center 80 of the detection beam 74 shifts anywhere within the margin X as shown in FIG. 31.

FIG. 29 shows a simplified representation of a standard 96-well plate reader 78. Many companies sell spectrophotometers suitable for use as a microplate reader 78. Plate readers 78 of this type employ one or more optical detectors 76 capable of measuring spectral conditions at 96 discrete locations corresponding to the well center-points established by the aforementioned specifications set forth in ANSI/SLAS 1-2004, 2-2004, 3-2004 and 4-2004. Thus, optical measurements can be taken of flow sample and/or analyte samples that are inside the microfluidic channels 36 and that adhere on the surfaces inside the microfluidic channels 36 under the detection areas 56.

Such devices 78 typically utilize a retractable cartridge tray 82 onto which a standard 96-well microplate is placed. There is some degree of clearance provided in the cartridge tray 82 to accept the plate assembly 84 (i.e., Parts A&B) with a drop-in, loose fit. Because of this generous clearance, the plate assembly 84 is free to shift (general plane motion) inside the cartridge tray 82 by as much as 1-2 mm in any direction, as suggested in FIG. 30. The degree of shifting can vary from one plate to the next, resulting in unpredictable shifts between the optical detector(s) 76 located inside the plate reader 78 and the intended targets on the plate assembly 84 per ANSI/SLAS specifications.

Figure 32:
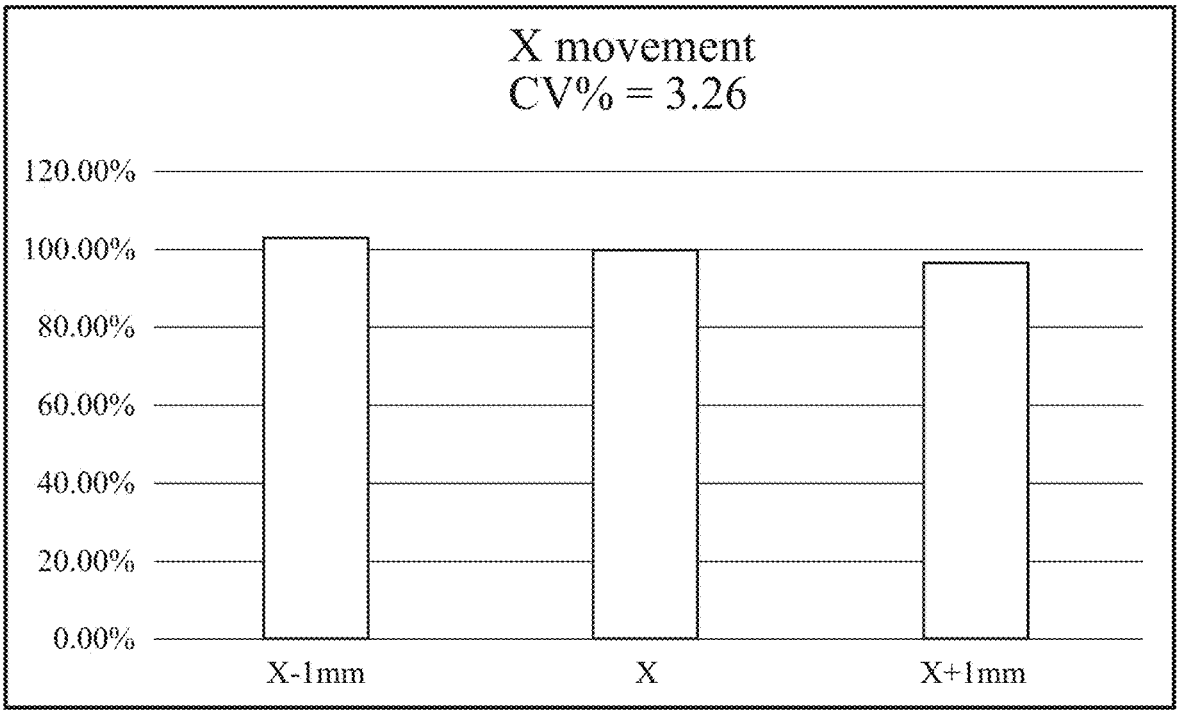
FIG. 32 is a graph produced by experimental data illustrating the substantial improvement in optical consistency in the X-axis direction produced by a plate assembly according to the principles of this disclosure.
Figure 33:
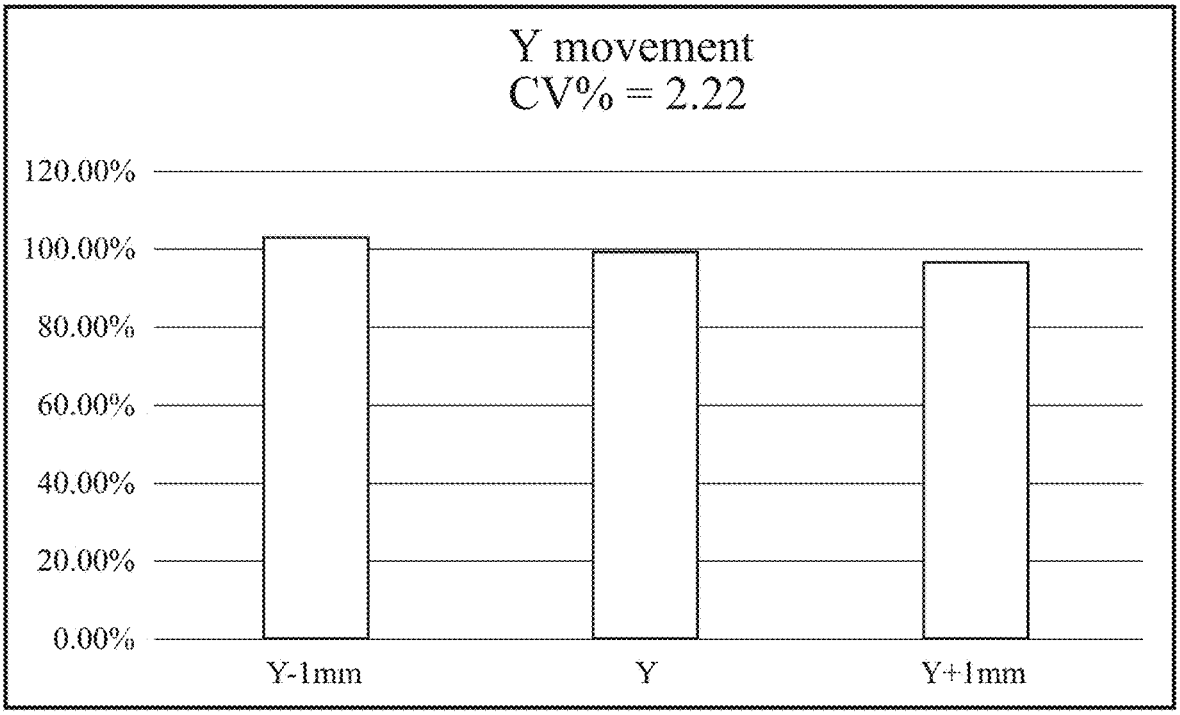
FIG. 33 is a graph produced by experimental data illustrating the substantial improvement in optical consistency in the Y-axis direction produced by a plate assembly according to the principles of this disclosure.

FIGS. 32-33 are graphs to illustrate the substantial improvement in optical consistency produced by a plate assembly according to the principles of this disclosure. In these graphs, the X-axis direction refers to side-to-side (or left-to-right) motion of the detection beam 74 relative to the geometric center 68 of a detection area 56, and the Y-axis direction refers to up-and-down (or top-to-bottom) motion of the detection beam 74 relative to the geometric center 68 of a detection area 56. Please refer again to FIG. 31. In this context, FIG. 32 shows optical intensities at three X-axis positions: X (geometric center 68 of detection area 56), X−1 mm (1 mm off-center in the negative X direction), and X+1 mm (1 mm off-center in the positive X direction). FIG. 33 shows optical intensities at three Y-axis positions: Y (geometric center 68 of detection area 56), Y−1 mm (1 mm off-center in the negative Y direction), and Y+1 mm (1 mm off-center in the positive Y direction).

The data used to generate these two graphs were produced by an experiment in which 10 μL volume with 5 μM concentration of R6G was added to the well 32 of a microfluidic module 22 according to this disclosure. Fluorescence intensity of the detection area 56 was read using a standard micro-plate reader 78 at each specific X and Y position. Results of the experiment showed that CVs (coefficient of variations) of both X and Y movements are less than 5% which is a possible limit of the plate reader variation as described above in connection with FIGS. 13 and 14. In conclusion, these graphs demonstrate that positive or negative shifts of up to 2 mm (i.e., 1 mm off-center in either X or Y direction) will not add any further optical signal variations. This represents a substantial improvement over prior art systems plagued by optical interference due to poor design and arrangement of the components within the microfluidic module.

Contributing to these superior characteristics is the fact that each detection area 56 is laterally offset, i.e., non-overlapping, from its respective well 32 and drain hole 44. The arrangement of components within each microfluidic module 22 strategically locates the detection areas 56 in position so that standard optics 76 will focus solely on the detection areas 56 and not receive interference from wells 32 or drains 44 (either of which may contain light disruptive residues and/or lens-like contours). The offset is uniquely designed in a serpentine pattern canted at a cant angle so that the size of the detection area 56 can be maximized and so that the optical signal remains constant even though the detection beam 74 shifts laterally relative to the geometric center 68 of the detection area 56. The cant angle may be in the range of about 15-35° measured clockwise from a row. Furthermore, the detection area 56 is a serpentine pattern having consistently-spaced runs 70. The runs 70 are canted at a cant angle α to maximize use of available space and optimize placement of the drain hole 44 in any convenient location that does not interfere with any detection areas 56, including but not limited to below the well 32 of an adjacent microfluidic module 22. The entire detection area 56 is designed with a flat bottom and top, at least one of which is optically clear. That is to say, over the detection area 56 the microfluidic channel 36 is optically clear on at least one of its top and bottom surfaces. For chemiluminescence measurement, the top plate (Part A) is made of a dark/black/opaque material to avoid cross-talk among adjacent detection areas 56, while the chemiluminescence measurement is performed through an optically clear film 58. The detection is then performed either from the bottom of the plate through the film 58, or the plate assembly 84 is inverted so that the optically clear film 58 is facing up and the detection is done from above. These features help assure a consistent measurement over multiple tests.

The (optional) micro-posts 54 of the present disclosure fill the entire footprint of the detection area 56 within each microfluidic channel 36. The micro-posts 54 are evenly spaced from one another. As a result, these micro-posts 54 increase the surface-to-volume ratio within the microfluidic channel 36, they expedite the molecule capture efficiency, and they guide the optical signal 74 toward the detector 76 so that detected light intensity is increased. Furthermore, the short, stubby (i.e., post height ~15-20% of the channel height Z) micro-post 54 embodiment may yield better light transmission through the top surface 38 and facilitate rapid fluid flow dynamics through the microfluidic channel 36.

All publications and patents mentioned in the above specification are herein incorporated by reference in their entirety. Various modifications and variations of the described devices, methods and/or systems will be apparent to those skilled in the art without departing from the scope and spirit of the disclosure. Although the disclosures have been described in connection with specific preferred embodiments, it should be understood that the disclosures as claimed should not be unduly limited to such specific embodiments. Indeed, various modifications of the described modes for carrying out the disclosures which are obvious to those skilled in the relevant fields are intended to be within the scope of the following claims.

What is claimed is:

1. A microfluidic plate assembly, comprising:

a top plate, a plurality of microfluidic modules disposed within said top plate, said plurality of microfluidic modules being arranged in a rectilinear matrix of rows and columns, each said microfluidic module having an elongated microfluidic channel extending between an upstream inlet and a downstream outlet, the portion of said microfluidic channel between said upstream inlet and downstream outlet comprising a detection area adapted for taking optical measurements, each said microfluidic module including a well disposed in fluid communication with the corresponding said upstream inlet of said microfluidic channel, and each said detection area being formed in a serpentine pattern composed of a plurality of alternating runs connected by intervening loop ends, each said run spaced apart from the next adjacent run by a generally consistent lateral spacing, each of said runs in said serpentine pattern extending parallel to one another, each of said runs being canted relative to said rows of said matrix at a cant angle, wherein said cant angle of said runs of said serpentine pattern are in the range of about 15-35 degrees.

2. The plate assembly of claim 1, wherein within each said microfluidic module said well is laterally offset from said detection area.

3. The plate assembly of claim 2, wherein said top plate has a top surface and an underside, further including a film affixed to said underside of said top plate, said film including a plurality of drain holes, each said drain hole being associated with a respective one of said microfluidic modules, said drain holes being laterally offset from said detection areas.

4. The plate assembly of claim 1, wherein said top plate has a top surface and an underside, further including an array of optically-transmissive micro-posts disposed within each said microfluidic channel, each said micro-post in said array extending perpendicularly from said top surface of said top plate toward said underside, said array of micro-posts equally distributed throughout the entirety of said detection area.

5. The plate assembly of claim 4, wherein each said micro-post in said array has a generally cylindrical shape.

6. The plate assembly of claim 4, wherein each said microfluidic channel has a generally consistent channel height along the length thereof, each said micro-post having a post height that is about 15-20% of said channel height.

7. The plate assembly of claim 1, wherein each said detection area has a geometric center, each said row of said matrix being spaced apart from the next adjacent said row a lateral distance of 9 mm, each said column of said matrix being spaced apart from the next adjacent said column a lateral distance of 9 mm, said geometric center of each said detection area being spaced apart from the left edge of said top plate according to the formula 14.38 mm+(9*x) mm where x is a non-negative integer, said geometric center of each said detection area being spaced apart from upper edge of said top plate according to the formula 11.24 mm+(9*y) mm where y is a non-negative integer.

8. A microfluidic plate assembly, comprising:

a top plate, said top plate having a top surface and an underside, a plurality of microfluidic modules disposed within said top plate, said plurality of microfluidic modules being arranged in a rectilinear matrix of rows and columns, each said microfluidic module having an elongated microfluidic channel extending between an upstream inlet and a downstream outlet, the portion of said microfluidic channel between said upstream inlet and downstream outlet comprising a detection area adapted for taking optical measurements, each said microfluidic module including a well disposed in fluid communication with the corresponding said upstream inlet of said microfluidic channel, and each said detection area being formed in a serpentine pattern composed of a plurality of alternating runs connected by intervening loop ends, each said run spaced apart from the next adjacent run by a generally consistent lateral spacing, each of said runs in said serpentine pattern extending parallel to one another, an array of optically-transmissive micro-posts disposed within each said microfluidic channel, each said micro-post in said array extending perpendicularly from said top surface of said top plate toward said underside, said array of micro-posts equally distributed throughout the entirety of said detection area, each said micro-post in said array having a generally cylindrical shape, and wherein each of said runs in said serpentine pattern is canted relative to said rows of said matrix at a cant angle in the range of about 15-35 degrees, and wherein within each said microfluidic module said well is laterally offset from said detection area.

9. The plate assembly of claim 8, wherein each said microfluidic channel has a generally consistent channel height along the length thereof, each said micro-post having a post height that is about 15-20% of said channel height.

* * * * *